United States Patent [19]

Furuichi et al.

[11] Patent Number: 4,952,988

[45] Date of Patent: Aug. 28, 1990

[54] IMAGE FORMING APPARATUS HAVING DISPLAY DEVICE FOR DISPLAYING PREDETERMINED DATA

[75] Inventors: Katsushi Furuichi, Yokohama; Yoshikazu Yokomizo, Kawagoe; Toshio Honma, Tokyo; Katsumi Murakami, Kawasaki, all of Japan

[73] Assignee: Canon Kabushiki Kaisha, Tokyo, Japan

[21] Appl. No.: 325,116

[22] Filed: Mar. 20, 1989

Related U.S. Application Data

[63] Continuation of Ser. No. 106,010, Oct. 7, 1987, abandoned, which is a continuation of Ser. No. 627,563, Jul. 3, 1984, abandoned, which is a continuation of Ser. No. 100,236, Dec. 4, 1979, Pat. No. 4,477,178.

[30] Foreign Application Priority Data

| | | | |
|---|---|---|---|
| Dec. 8, 1978 | [JP] | Japan | 53-151775 |
| Dec. 10, 1978 | [JP] | Japan | 53-152818 |
| Dec. 29, 1978 | [JP] | Japan | 53-165093 |
| Dec. 29, 1978 | [JP] | Japan | 53-165095 |

[51] Int. Cl.[5] ..... G03G 21/00

[52] U.S. Cl. ..... 355/209

[58] Field of Search ..... 355/203, 204, 206, 208, 355/209, 314

[56] References Cited

U.S. PATENT DOCUMENTS

| | | | |
|---|---|---|---|
| 4,044,232 | 8/1977 | Hubbard | 355/208 X |
| 4,090,787 | 5/1978 | Hubbard et al. | 355/14 R |
| 4,105,914 | 8/1978 | Murata et al. | 355/14 X |
| 4,128,756 | 12/1978 | Nagano et al. | 355/14 X |

*Primary Examiner*—Fred L. Braun

*Attorney, Agent, or Firm*—Fitzpatrick, Cella, Harper & Scinto

[57] ABSTRACT

An image forming apparatus includes an image forming mechanism, an input device for setting image formation data necessary to command desired image formation, first and second displays for displaying the data input through the input device and for indicating that the apparatus is ready to form images, respectively, a starter for commanding image formation to commence, a timer, and a controller. The timer controls the first display to return the image formation data to predetermined values if the starter has not been actuated during a predetermined time interval. The controller controls the image forming mechanism to form an image according to the displayed data if the starter is actuated after the ready indication, controls the input device to allow the input of data even before the ready indication in which case the timer begins to time after the ready indication, and controls the timer to reset if new image formation data is input during the predetermined time.

14 Claims, 63 Drawing Sheets

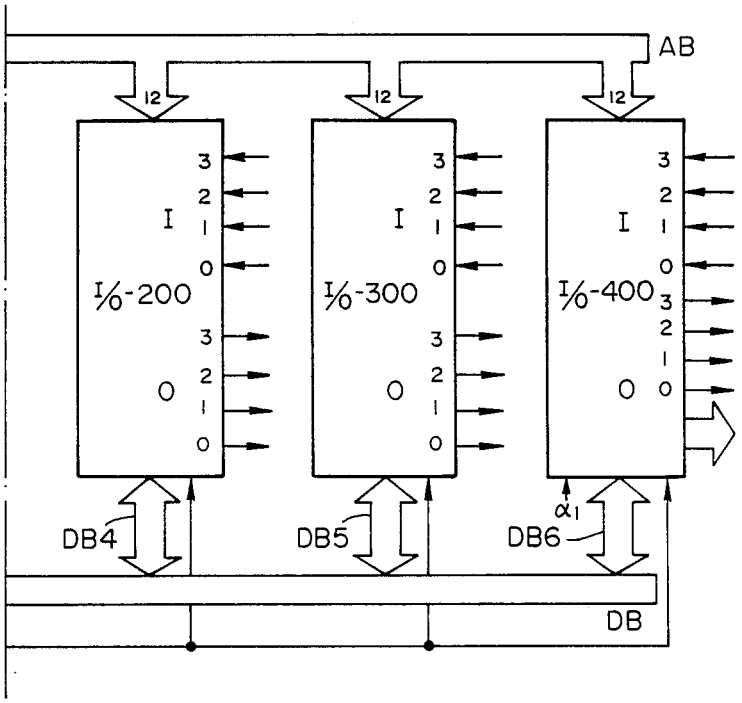
FIG. 3C
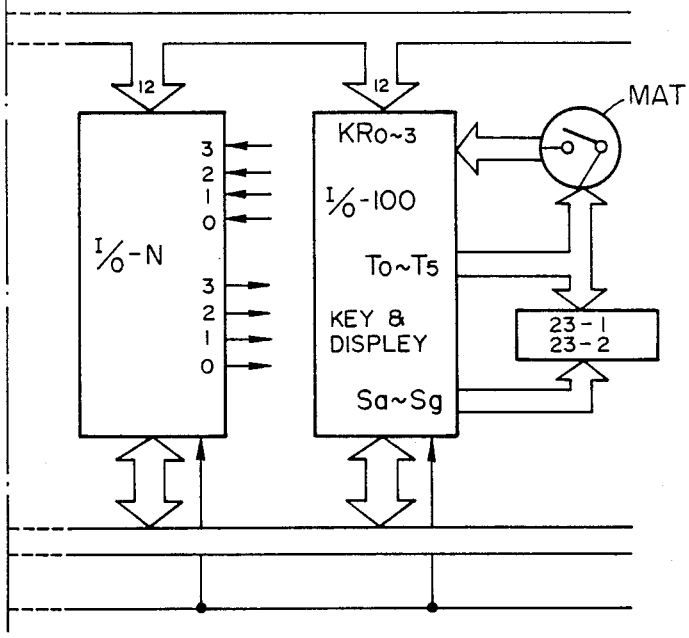

| X'' | 0 | 1 | 2 | 3 | 4 | 5 | 6 |
|---|---|---|---|---|---|---|---|
| 0 | | COUNTER WA (0) | | | | | WA (1) |
| 1 | | | WA (4) | | | | WA (5) |
| 2 | | | X'400' | X'300' | | | |
| 3 | | | KEY INPUT (OUT) | (CHG) | | | |
| 4 | | | OUT | RED SFT | | | |
| 5 | | | DCK | CONC | | | |
| 6 | | | NP | | | | |
| 7 | | | | | | | |
| 8 | ERR FLG | J1 1 | J1' 2 | J2 3 | J3 4 | J4 5 | JT 6 |
| 9 | | TH1 11 | | CWB 13 | STRD 14 | STRJ1 15 | STRJ2 16 |
| A | | CP 21 | DHP 22 | OHP 23 | | RGP 25 | OBP 26 |
| B | | M1 31 | M2 32 | M4 33 | M6 34 | FM1 35 | |
| C | | HVTA 41 | HVTB 42 | HVTC 43 | HVTD1 44 | HVTD2 45 | HVTF 46 |
| D | FOR DIAGNOSTIC MODE INDICATION (F) | (−) | | FOR ERROR MODE INDICATION (E) | | | |
| E | | | | | | | |
| F | | | | | | | |

FIG. 7-1A

| 7 | 8 | 9 | A | B | C | D | E | F |
|---|---|---|---|---|---|---|---|---|
| | | | WA(2) | | | | WA(3) | |
| | KEY INPUT | | WA(6) | | KEY INPUT | | WA(7) | |
| | | | SET COUNTER 0 | 0 | 1 | | | |
| | | | COPY COUNTER 0 | 0 | 0 | | | |
| | | | | | | | | |
| | | | | | | | | |
| | | | | | | | | |
| | | | | | | | | |
| J5 7 | | | | | | | | |
| | TE 18 | SE 19 | | | | | | |
| RD1 27 | RD0.7 28 | RD0.6 29 | | | | | | |
| | | | | | | | | |
| HVTG1 47 | HVTG2 48 | | | | | | | |
| | | | | | | | | |
| | | | | | | | | |
| | | | | | | | | |

FIG. 7-1B 11-5

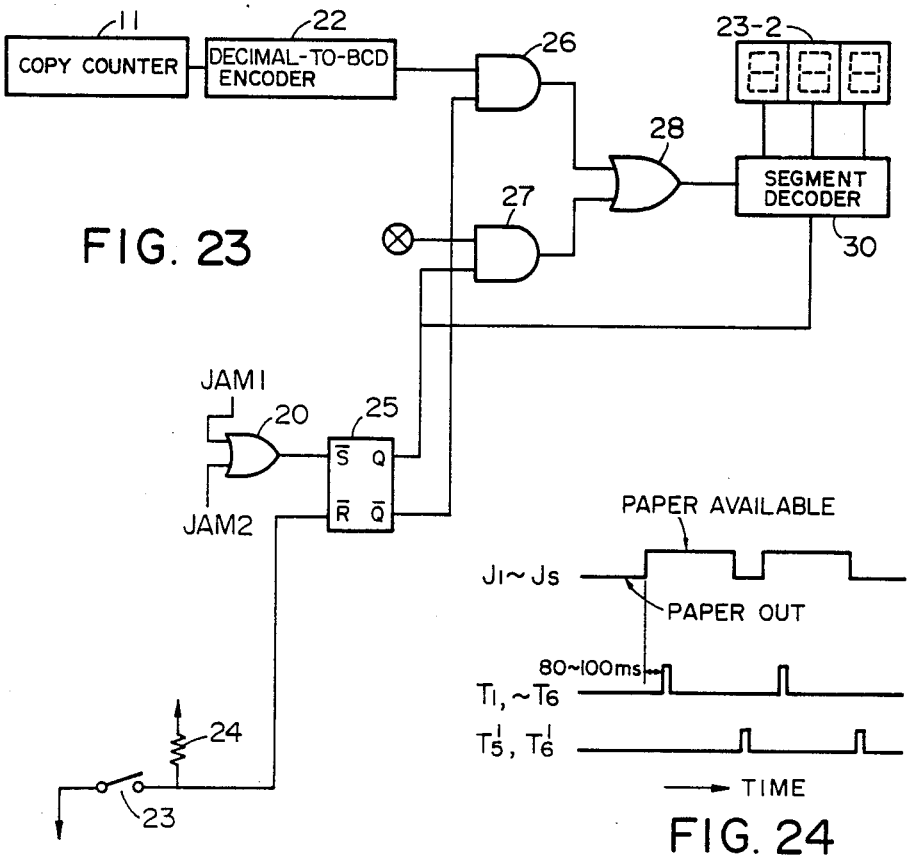
FIG. 23
FIG. 24
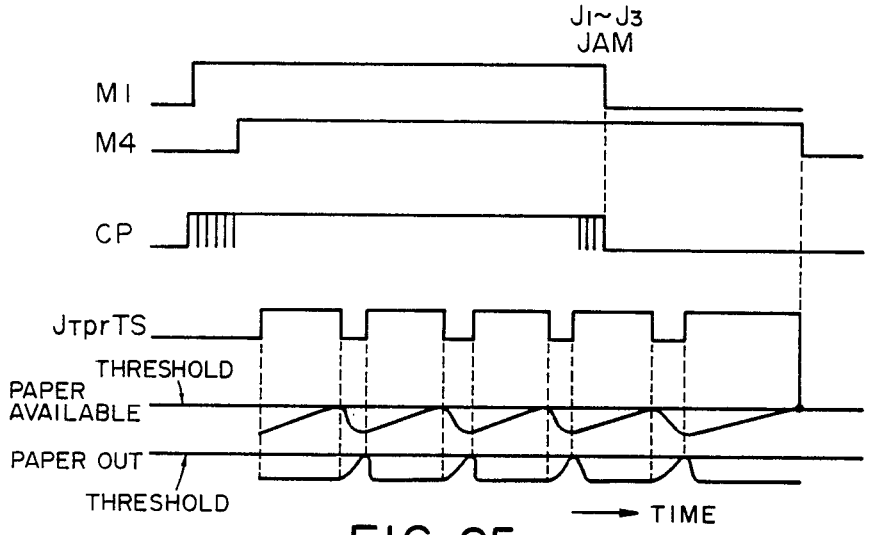
FIG. 25

IMAGE FORMING APPARATUS HAVING DISPLAY DEVICE FOR DISPLAYING PREDETERMINED DATA

This application is a continuation of application Ser. No. 07/106,010 filed Oct. 7, 1987, now abandoned, which is a continuation of Ser. No. 06/627,563 filed July 3, 1984, now abandoned, which in turn is a continuation of Ser. No. 06/100,236 filed Dec. 4, 1979, now U.S. Pat. No. 4,477,178.

BACKGROUND OF THE INVENTION

1. Field of the Invention:

The present invention relates to image forming apparatus such as a copying machine having various indication functions and various paper feed and transport functions.

2. Description of the Prior Art:

Such type of copying machines are known in the art which can detect any trouble occuring in the machine and indicate it. Diagnosis instruction keys, a number of LEDs and others necessary for carrying out such detection and indication are disposed at the operation part of a copying machine as separate and particular members. Therefore, the objects whose trouble is to be detected are limited to a necessary minimum number. Furthermore, since a large number of LEDs and switches are arranged on the operation and display parts to watch troubles, the operation and display parts are made complicated and expensive.

Applicant of the present application has already proposed a copying machine in which the place where paper is jamming is indicated and running low of toner is notified making use of numeral indicators which are normally used to show the number of copies to be made and the number of copies already completed. This is the subject of Japanese Patent Application Laid-Open No. 66,432/1977.

However, the known copying machine is provided with no means for checking trouble of various sensors and detectors themselves provided for timing control and jam detection. It is not impossible to check trouble or error of such sensors and detectors themselves. But, the number of the objects to be checked is too large to do it. Detection circuits and indication circuits required therefor will become unduly large and complicate. Therefore, the number of objects must have been limited to a minimum. This, in turn, limits further improvement of reliability of the copying machine.

On the other hand, if check and indication are made for all of objects which one considers to be checked, the operator can hardly recognize what kind of trouble it is when any trouble is detected and indicated.

There is also known the type of copying machine in which keys are used to preset the number of copies wished to make. These keys occupy a relatively large area of the operation part. If a number of input means for presetting a copy mode and for trouble diagnosis and various indicators are provided on the operation part in addition to numeral keys, then the operation part will become too much complicated to operate.

Recent developments of copying machines have made it possible to produce a large number of copies at high speed without interruption. In such a copying machine, sometimes two or more paper sheets are present in the paper path within the machine at the same time. Therefore, when even one of the sheets present in the path is jammed, all the sheets in the machine must be discarded including the copy sheet already completed. This is a loss of money and also against the purpose of speed-up in operation. Moreover, it is difficult in this case to locate the jam place and to know the number of sheets remaining in the machine. In the worst case, the copying machine restarts copying with any one of the jammed paper sheets remained in the machine, which will bring forth a jam trouble again.

Generally, sheet storing, sheet supply, sheet feed and sheet discarge sections in the known automatic copying machine are so designed as to hold the same operation mode. There are known few machines in which the above mentioned sections can be controlled differently according to the various conditions of process sequences, troubles and the like. Therefore, the known copying machine necessitates the operator's time-consuming and troublesome work.

SUMMARY OF THE INVENTION

Accordingly, it is a general object of the present invention to provide an image forming apparatus which eliminate the disadvantages mentioned above.

It is also an object of the present invention to provide such image forming apparatus which allows to select the objects to be checked at will and to execute diagnosis on any object to which it is necessary.

It is another object of the invention to provide such image forming apparatus which is operable without removing a cause of troubles so long as the trouble is not of importance for an ordinary copying operation.

It is a further object of the invention to provide such image forming apparatus which can check troubles even at the time of copying operations being interrupted by paper jam or for another reason.

It is a still further object of the invention to provide such image forming apparatus which can execute diagnosis of trouble in any mode and at any phase of the process sequence and which can make its indicators indicate the object being checked and the mode at that time.

It is a further object of the invention to provide such image forming apparatus which can initiate and cancel the diagnostic sequence by making use of input means which are usually used for copy data entry and cancellation of the data.

It is also an object of the invention to provide such image forming apparatus which can inhibit change of copy data, execution of trouble check during stand-by and automatic reset of copy data after removal of jam until a paticular instruction is given to the apparatus.

It is also an object of the invention to provide such image forming apparatus in which automatic resetting of a plural number of copy data can be controlled in an advantageous manner.

It is also an object of the invention to provide such image forming apparatus which can treat and indicate a paper jam ocurred along the paper path in a well-controlled manner.

It is also an object of the invention to provide such image forming apparatus which includes means for effectively detecting jam troubles in a device having a long paper transportation path such as a sorter.

It is also an object of the invention to provide such image forming apparatus which can control the sheet supply section containing a large number of copy sheets to move it upward or downward according to the kind of troubles then occurred and the phase of sequence.

It is a further object of the invention to improve the sequence control used in the apparatus for distributing the completed copy sheets such as a sorter.

It is a further object of the invention to improve a copying machine of the type in which the number of copies set and/or completed is indicated by segment-type indicators or the type in which copy data entry is made by means of a set of keys.

It is still a further object of the invention to improve the type of copying machine which has function to execute diagnosis on various kinds of sensors, detectors and process loads.

Other and further objects, features and advantages of the invention will be understood more fully from the following description taken in connection with the accompanying drawings.

BRIEF DESCRIPTION OF THE DRAWINGS

FIG. 1-2 is a cross-sectional view of a sorter;

FIG. 2 is a plan view of the operation part of the apparatus;

FIGS. 5-1A through 5-1D, when combined as shown in FIG. 5-1, and FIG. 5-2 show a control flow chart;

FIGS. 6-1A, 6-1B and 6-1C and FIGS. 6-2A and 6-2B, when combined as shown in FIGS. 6-1 and 6-2, respectively, are detailed flow charts relating to the flow chart shown in FIGS. 5-1 and 5-2;

FIGS. 7-1A and 7-1B, when combined as shown in FIG. 7-1 and FIG. 7-2 show the memory in FIG. 3;

FIGS. 8-1 and 8-2 are partial cross-sections of the apparatus shown in FIG. 1;

FIGS. 9-1 and 9-2 are time charts of operation for two parts shown in FIGS. 8-1 and 8-2, respectively;

FIGS. 10A and 10B, 11-1A through 11-1D, 11-2A, 11-2B and 11-2C, and 12A through 12D, when combined as shown in FIGS. 10, 11-1 to 11-2 and 12, respectively, show other control flow charts;

FIGS. 15-1A and 15-1B, when combined as shown in FIG. 15-1 and FIG. 15-2 are a flow chart showing in detail a part of the flow chart shown in FIG. 13;

FIG. 23 shows display circuit thereof;

FIGS. 24 and 25 are time charts of the circuits shown in FIGS. 22 and 23 respectively;

DESCRIPTION OF THE PREFERRED EMBODIMENTS

Figure 1:
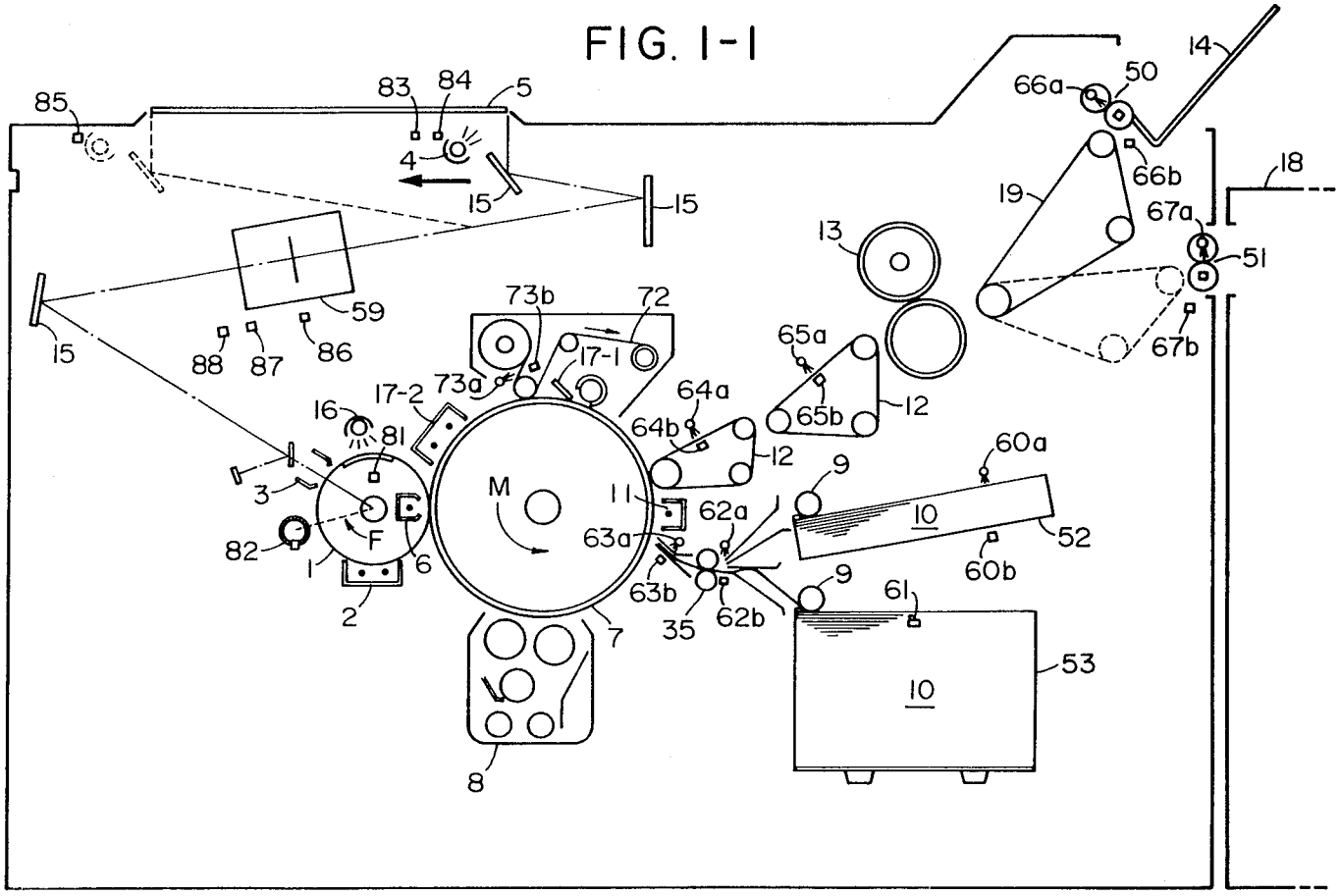
FIG. 1—1 is a cross-sectional view of an image forming apparatus in the present invention is embodied.

Referring first to FIG. 1, there is shown a copying machine to which the present invention is applicable. The copying machine is of the type in which a plural number of secondary electrostatic latent images can be formed continuously from one and the same primary electrostatic latent image. Of course, the copying machine is only an example of various image forming apparatus to which the present invention is applicable.

The shown copying machine is provided with a separate outlet for a sorter so that a sorter can be used with the copying machine when it is desired. To facilitate to make a large number of copies at a high speed, the copying machine has, in its paper feeding part, a large capacity paper deck which can receive about five times as much paper as in an ordinary copying machine. The copying machine has also ordinary paper cassettes. Therefore, in the copying machine, it is allowed to feed paper mainly from the deck. When a given number of copies are to be made for each original, sorting of the completed copies can be made automatically by using a sorter, which saves the operator from time consuming and troublesome sorting work after copying.

Also, the copying machine may be provided with a reduction mechanism which is able to reduce an original image size in any one of three steps. Therefore, with the copying machine three differently reduced copied images can be obtained as desired.

In FIG. 1, the reference numeral 1 designates a photosensitive screen which is, for example, of the type disclosed in Japanese Patent Application Laid-Open No. 19,455/1975. A primary corona discharger 2 uniformly charges the screen 1 with positive electric charge, a secondary corona discharger 3 removes the charge on the screen 1 in accordance with an original image, and a lamp 4 exposes an original to light. Designated by 5 is an original table on which the original is placed. A modulation corona discharger 6 forms a secondary electrostatic latent image, and a dielectric drum is denoted by numeral 7. A developing device 8 applies toner to the secondary latent image, and a transfer sheet 10 is fed by a paper feeding roller 9. Designated by 11 is a DC corona discharger for transferring the toner image onto the transfer paper 10 and a conveying belt for discharging the transfer paper is designated by 12. The reference numeral 13 designates a fixing roller for fixing the toner image, 14 a tray, 18 a sorter for automatically sorting and distributing the coming transfer paper, and 20 a bin in the sorter.

In the above-described copying machine, copies are produced in the following manner:

The original on the original table 5 is slitwise exposed to light while the lamp 4 and a mirror 15 are moved and the light image of the original is projected on the three-layered screen 1 which has previously been charged by the primary discharger 2 and is rotating at that time. The secondary corona discharger 3 is operated simultaneously with the exposure and a primary electrostatic latent image is formed on the screen. The primary latent image modulates the ion stream flowing from the modulation discharger 6 so that a secondary electrostatic latent image is formed on the drum surface 7. The secondary latent image is developed by toner at the developing device 8. With the aid of the DC corona discharger 11 the toner image is transferred onto transfer paper 10 which is fed from the lift deck 53 or the cassette 52. After transferring, the paper 10 is conveyed to the heat roller fixing device 13 at which the toner image is fixed by heat. Then, the paper 10 is discharged toward the sorter 18 or the tray 14. Even after the secondary latent image is formed, the primary latent image remains unerased. Therefore, the formation of secondary latent image can be carried out continuously by the modulation corona discharger 6 while further rotating the screen 1 and feeding the transfer paper to the transferring station successively. The above cycle of transferring, fixing and discharging is repeated until the number of copies made reaches a certain preset number. In case that the number of copies present at the machine is beyond the limit at which the repeating formation of secondary latent image from the same primary latent image becomes no longer possible, the repeating operation is interrupted and a reformation of the primary latent image is made automatically.

After a completion of the whole copying operation, the remaining primary latent image is erased by a lamp 16 which can be used also to form a particularly high-contrast primary latent image. The remaining toner on the drum 7 is removed by a cleaning blade 17-1 and the remaining electric charge on the drum is removed by an AC corona discharger 17-2.

By the way, it should be noted that the paper fed from the paper feeding roller 9 is once stopped at the position of a registering roller designated by 35. The registering roller is brought into operation by a registration signal from a switch 83 to further transport the paper toward the transferring station in a predetermined good timing to obtain a registration of the toner image on the drum and the transfer sheet.

Since with the copying apparatus the secondary latent image can be formed repeatedly independently of the formation of primary latent image, the rotational speed of the screen and the dielectric drum at the time of secondary latent image formation and transference is increased up to a value twice a high as that at the time of primary latent image formation.

Referring again to FIG. 1-1, the reference numerals 84 and 85 are Hall elements arranged along a path along which the optical system 4, 15 moves forward and backward for exposure scanning. The first mirror 15 that is a mirror near most to the lamp 4 carries a magnet thereon. The Hall element is turned on when the magnet passes over or reaches it. Of the Hall elements the first one 84, when on, issues a home position signal informing of exposure start or optical system stop position, the second one 85 issues a reversal signal for ending exposure, turning the lamp 4 off and moving the optical system back. The element 83 issues a registration signal for bringing the above-mentioned registering roller 35 into operation. The signal is stored in a memory as a position signal related to the distance from the exposure start position (84) and is developed during the secondary process. A microswitch 81 is actuated by a cam provided on the drumshaped screen 1 and issues a position signal DHP for stopping the screen drum 1. Designated by 82 is a rotary encoder having a photo-interrupter for detecting a disc and its openings. The rotary encoder 82 generates a clock pulse in synchronism with the rotation of the screen drum, the clock pulse (one clock per degree) being designated by KCL. The clock pulse KCL is counted by CPU (FIG. 3) to determine various process timings. The CPU also issues a check pulse for checking jam.

Hall elements HIC 86–88 detect the position of the lens 59 alloted for reduction (copy/original) of ratios 1:1, 0.7:1 and 0.6:1, respectively. These Hall elements are turned on by a magnet moving together with the lens.

Figures 1, 2:
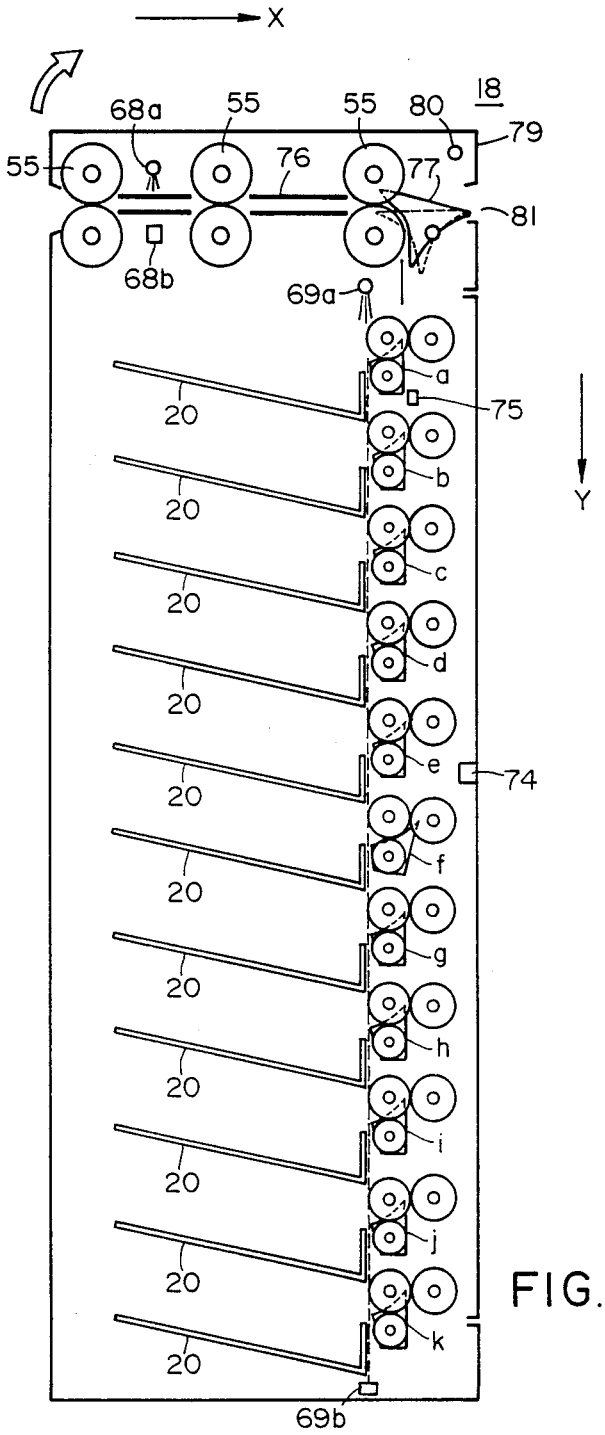
Figure 2:
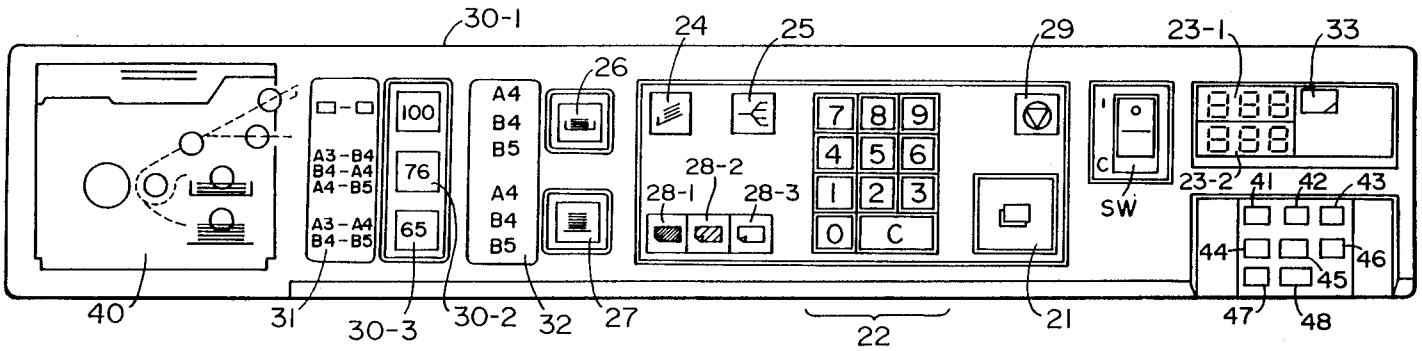

FIG. 2 shows an operation part and a display panel used in the copying apparatus shown in FIG. 1.

In FIG. 2, SW designates a main switch by which a power source is connected to process loads and control circuits present within the copying machine. Numeral 21 designates a copy start key, 22 a key to set the number of copies to be made, and 23-1 a set number indicator. Numeral 23-2 indicates an indicator of the number of complete copies. Display of the number is made using seven-segment LED in each digit. The indicator 23-1 displays diagnostic mode and 23-2 displays error mode. Reference numeral 24 denotes a selection key for tray, and 25 that for sorter. When actuated, the selection key itself lights on to indicate which is selected sorter or tray. Numeral 26 denotes a cassette selection key, and 27 a deck selection. Each selection key, when actuated, also can light itself to indicate the selection made then. In each case, the size of paper in the cassette or deck is displayed by the indicator 32. Numerals 28-1 to 28-3 indicate copy density selection keys to set Dark, Medium and Light, respectively. These keys also can light themselves on when actuated. A stop key 29 is used to interrupt copy operation. When this stop key 29 is keyed on, the mode is brought to the same sequence mode as that at the time of completion of all copies in the set number. Keys 30-1 to 30-3 are reduction setting keys for ratios 1:1, 0.76:1 and 0.65:1, respectively. When keyed on, the corresponding mark on the indicator 31 is lighted on. Cassette selection and reduction selection are independent of each other and it is therefore allowed to make any desired reduction copy independently of the paper size of the selected cassette.

When the tray is selected, the belt 19 takes the position indicated by the solid line in FIG. 1 so that transfer paper is discharged passing through the discharging roller 50. When the sorter 18 is selected, the belt is brought to the position indicated by dotted line so that transfer paper is discharged passing through the discharging roller 51. Deck 53 can receive about 2000–3000 paper sheets whereas the cassette can receive about 500–1000 paper sheets.

In the sorter 18, the paper is further transported to one of the bins 20 by rollers 55 or belt 55 always rotating. Guide pawls a to k are provided one for each bin as shown in FIG. 1-2 These guide pawls are actuated successively every time when sensor 68 detects a coming paper and the paper is delivered to a bin alloted for it. Setting of the discharge belt to the position directed to the sorter is made by keying on the key 25 which actuates a solenoid SL2.

If the operator does not key on the copy key 21 or any other key in a predetermined time period (30 sec.) after setting the paper outlet to the sorter's side, then the solenoid SL2 is automatically made inactive and the outlet is moved back to the tray's side. Also, the paper outlet is automatically set to the tray's side when the power source switch SW is turned on or when the machine is left alone for 30 seconds after the end of a copying operation with the outlet being set to the sorter's side. Therefore, the operator need not to worry about the position of the paper outlet and can start the copying operation promptly.

By turning on any one of the keys 28-1 to 28-3, the quantity current flowing to the exposure lamp 4 is adjusted to a level corresponding to the set copy density. However, if neither copy key 21 nor any other key is keyed on by the operator, then the level of the light quantity is automatically returned to a level as given by key 28-2.

When the key 26 is keyed on, the machine is set to the position in which only the paper feeding roller 9 associated with the cassette 52 is operable. On the contrary, when the key 27 is actuated, the feeding roller 9 associated with the deck 53 is made operable. However, like the above, if the machine is left alone for 30 seconds long after this setting, the paper feeding position is automatically returned to the position in which the paper feeding roller for deck 53 containing sheets of A4 size, which is usually most frequently used among others.

When any one of the reduction keys 30-1 to 30-3 is depressed to produce copies at a desired reduction rate, the mirror 15 and the lens system arranged in the optical axis of the reflection image formed by the lamp 4 are moved by a motor and a solenoid and set to the positions destinated therefor. However, like the above, if the machine is left alone for 30 seconds long after this setting, then the set position is automatically returned to such a position as given by the key 30-1 (1:1).

Similarly, if the machine is left alone for a predetermined time period after a repeating copying mode has been set by the key 22, the mode once set is automatically cancelled and instead the position of the machine is returned back to one sheet copying mode. In this manner, the copying machine always returns to the standard mode whenever the machine is left alone 30 seconds long after the last setting action for various special condition modes.

When any jamming of paper happened in the copying machine, the occurrence of the jam and the location of it are indicated by a jam position indicator 40 which flickers in response to a jam detection sensor as described later. The portion of the indicator 40 at which light flickers corresponds to the portion of the paper path at which the sensor detected the jam. Indicators 42 and 41 indicate a jam occurred within the sorter shown in FIG. 1-2 and that within the main body of the copying apparatus shown in FIG. 1-1, respectively. Simultaneously with the jam indication, the contents of indications appearing in the indicators 23-1 and 23-2 are automatically altered.

Indicator 48 is one to indicate that there is need of supplying toner (toner is unavailable), and an indicator 4 indicates that there is no paper available in the selected paper feed section. An indicator 43 indicates that there occurs a heavy trouble in the machine which is in need of a serviceman's help. An indicator 46 indicates that there is missing the key counter for accounting copy fee. A wait indicator 47 indicates that the machine is not ready for copying operation and now in wait.

Figure 3:
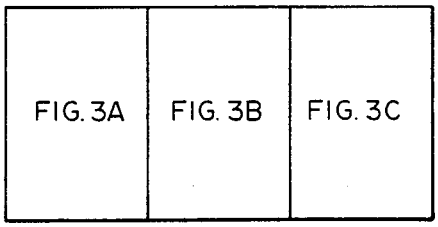
FIG. 3A, 3B and 3C, when combined as shown in FIG. 3, show control circuitry used in the apparatus.

FIG. 3 is a control circuit diagram showing an embodiment of the present invention in which a 4-bit parallel-processing micro-computer is used.

In FIG. 3, ROM is a read-only memory of the type μPD 454 by Nippon Electric Co., Ltd. It contains indicating operation program sequences of key input data, setting and resetting operation program sequences of standard mode, error diagnostic program sequences and sequence control program sequences of copy processing operation in a predetermined order and at addresses alloted therefor. These program sequences are shown in the following drawings as flow charts with reference to which description will be made hereinafter in detail. From the memory, its content can be taken out whenever addressed.

RAM is a read and write memory for storing various data such as data of the number of copy sheets, data of error and data for process sequence control. The memory stores a set of binary codes and is shown in detail in FIGS. 7-1B, 7-1B and 7-2. The memory is composed of a plural number of units each containing plural number of flip-flops. Any unit can be selected by an address assignment signal to read out or write data in the flip-flops in the selected unit. In this embodiment, as the memory RAM, there is used μPD 462 by the above mentioned manufacturer.

Figures 1, 7:
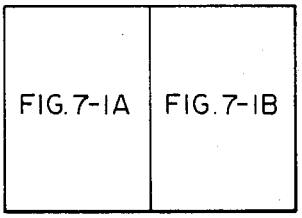

In FIG. 7-1, an address of memory and memory area is expressed, for example, in terms of X' 043'. The units digit represents a column, the tens digit does a line and the hundreds digit does a memory chip. Therefore, from FIGS. 7-1A and 7-1B, it is seen that X' 043' is an area for storing data of reduction useful for assignment of lens magnification and indicating operation of the indicator 31. Similarly, X' 033' is an area for storing data assigned by the reduction key. In case of unity, the binary data of X' 043' is 0000 and in case of 0.7, it becomes 1000. X' 062' is an area for storing data of 1000 when no paper is available in the paper feed section set at that time. As to other data areas, see Table I later given.

Numerical data for making indication on segment indicators 23-1 and 23-2 are stored areas of SET and COPY, respectively. Key input data are provisionally stored in C'018' and X'01C'. WA(0) is a three figure working register and has a function to excute timer for returning copy mode to standard mode. WA(1) to WA(7) are the registers adapted to store other data. Relations between key inputs and stored data are shown in the following Table I.

TABLE I

| KEY | (X' 018) | KEY | (X' 01C') |
|---|---|---|---|
| 0 | 0 | 1:1 key | 0 |
| 1 | 1 | 0.7 | 1 |
| 2 | 2 | 0.6 | 2 |
| 3 | 3 | Dark key | 3 |
| 4 | 4 | Medium | 4 |
| 5 | 5 | Light | 5 |
| 6 | 6 | Clear | 6 |
| 7 | 7 | Copy key | 7 |
| 8 | 8 | Cassette | 8 |
| 9 | 9 | Deck | 9 |
| no key input | F | Sorter | A |
| | | Tray | B |
| | | no key input | F |

When no key input, F that is, 0000 is stored.

Figure 3A:
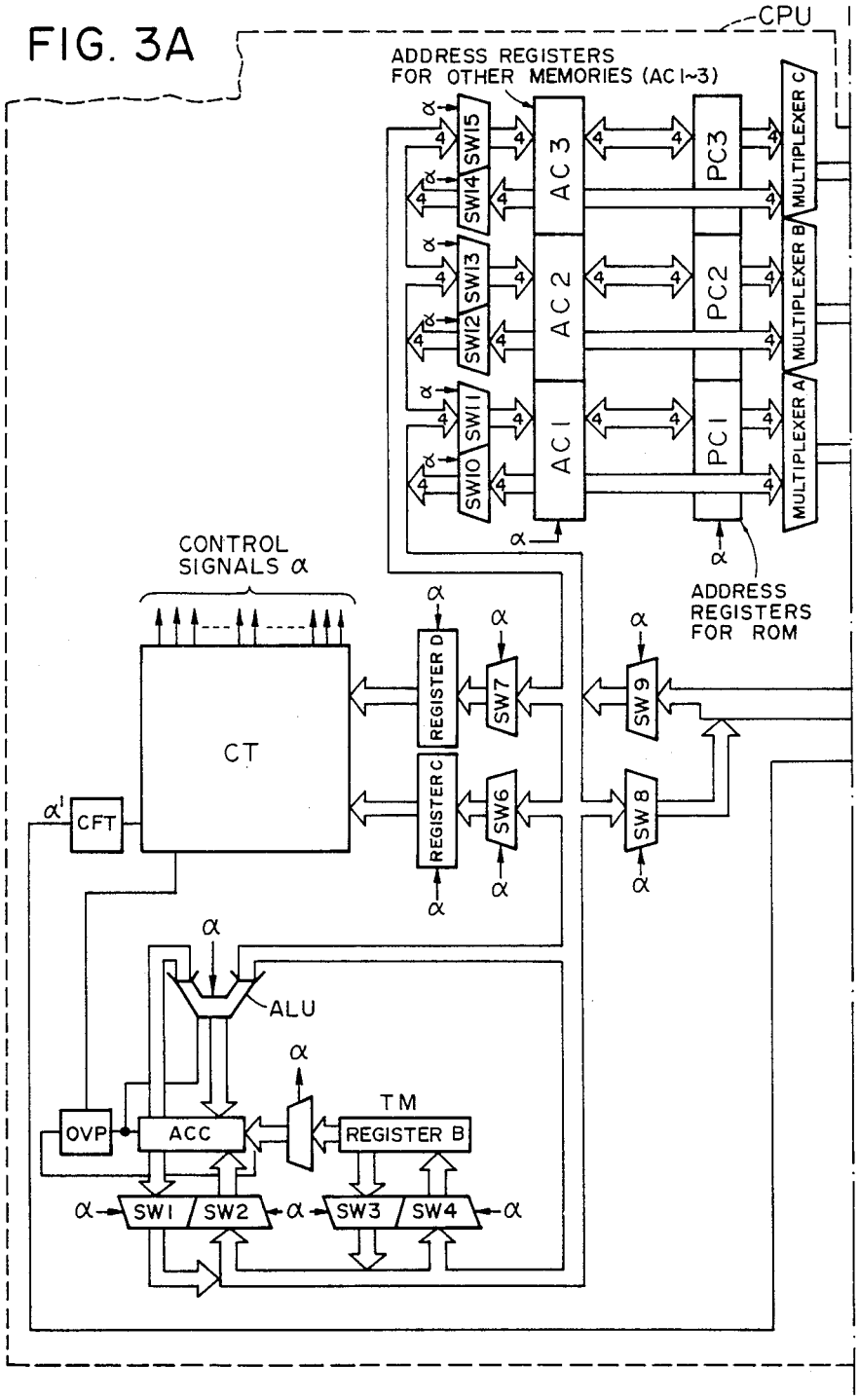
Figure 3B:
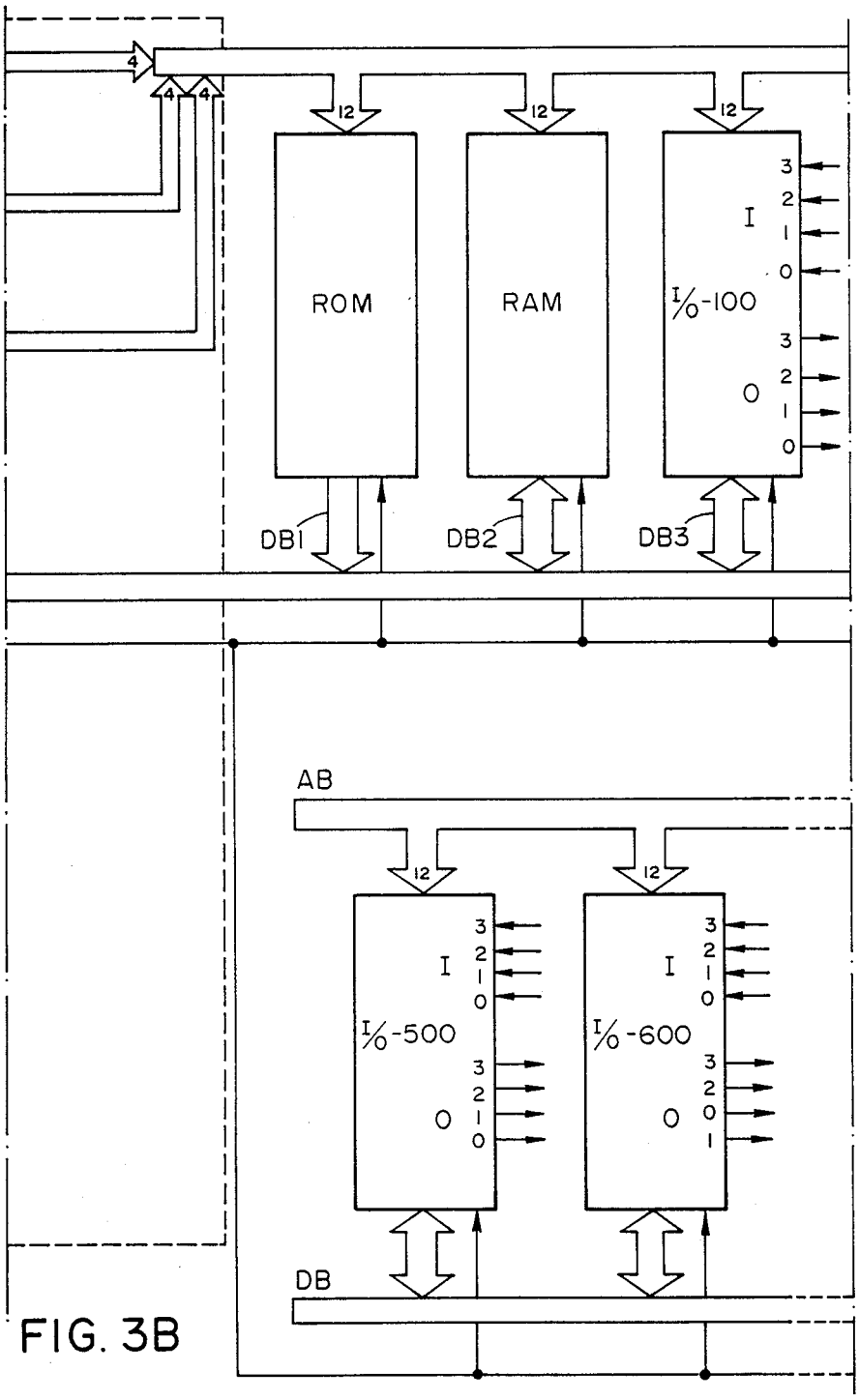

Referring again to FIGS. 3A, 3B and 3C I/O 100–I/O are input-output apparatus which receive data input signals by keys etc., and issue signals to drive solenoids etc.

Figures 1, 4:
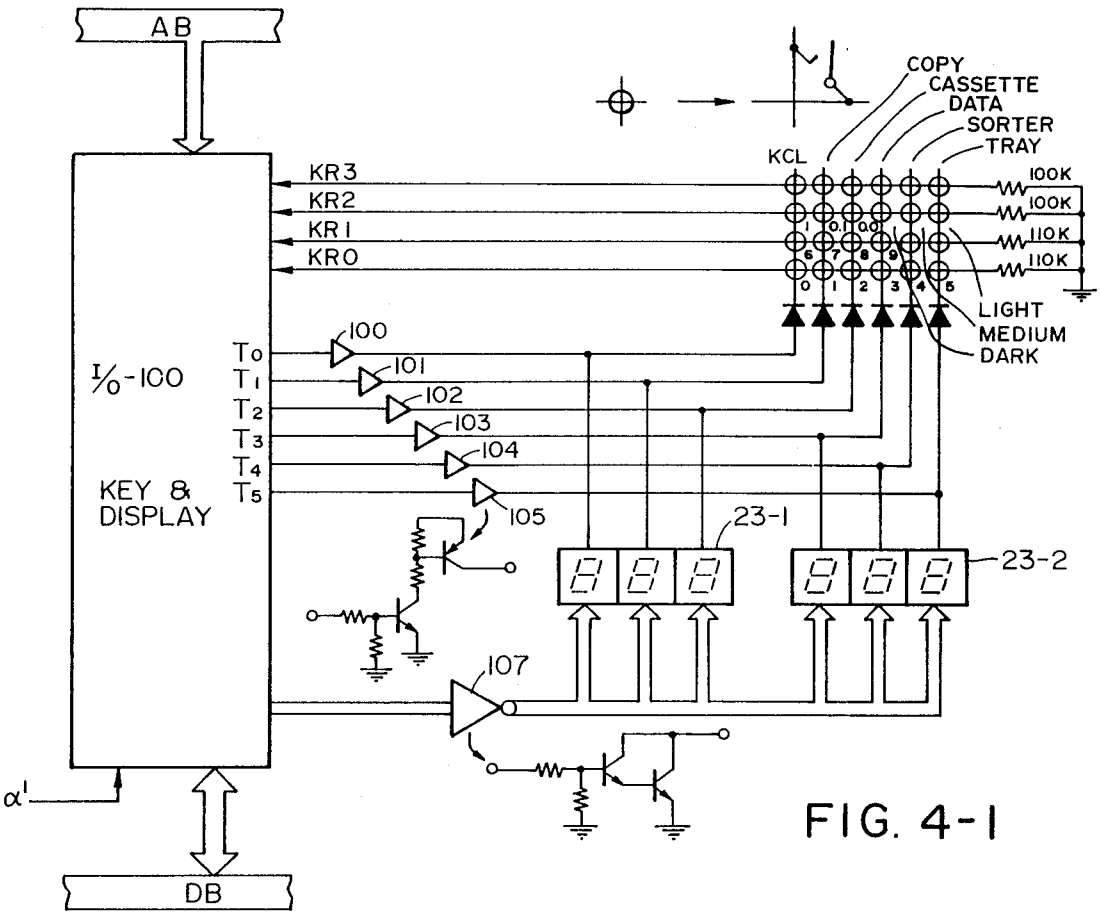
Figures 3, 4:
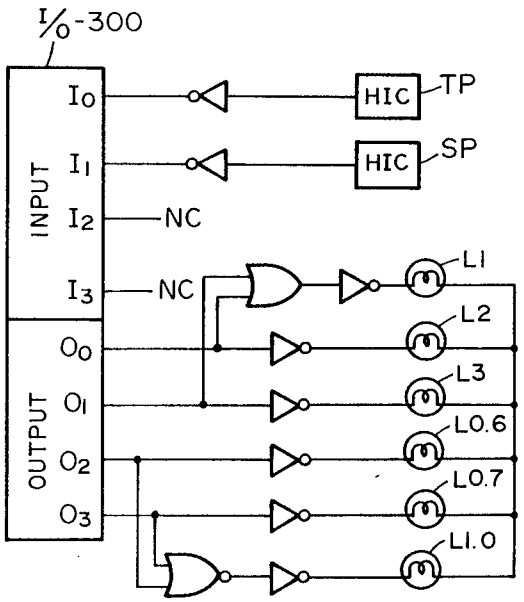
Figures 2, 4:
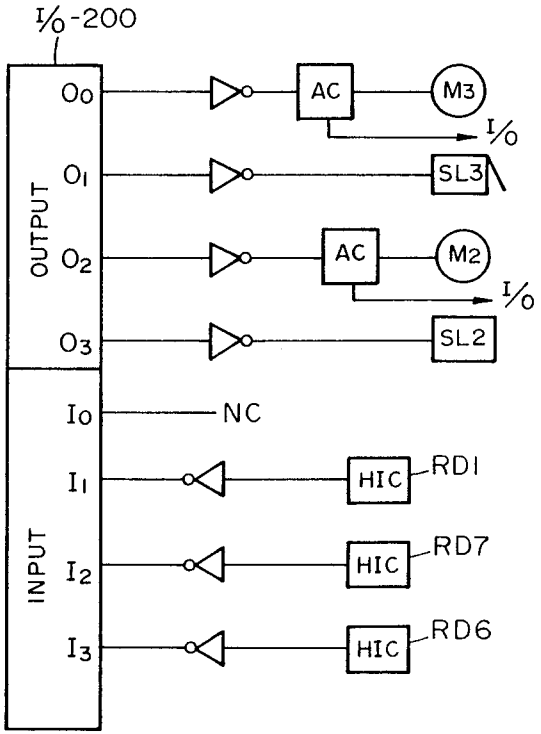
Figures 4, 5:
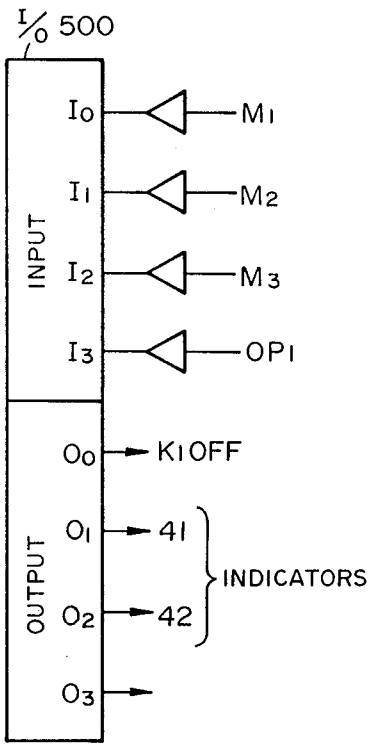
Figure 4:
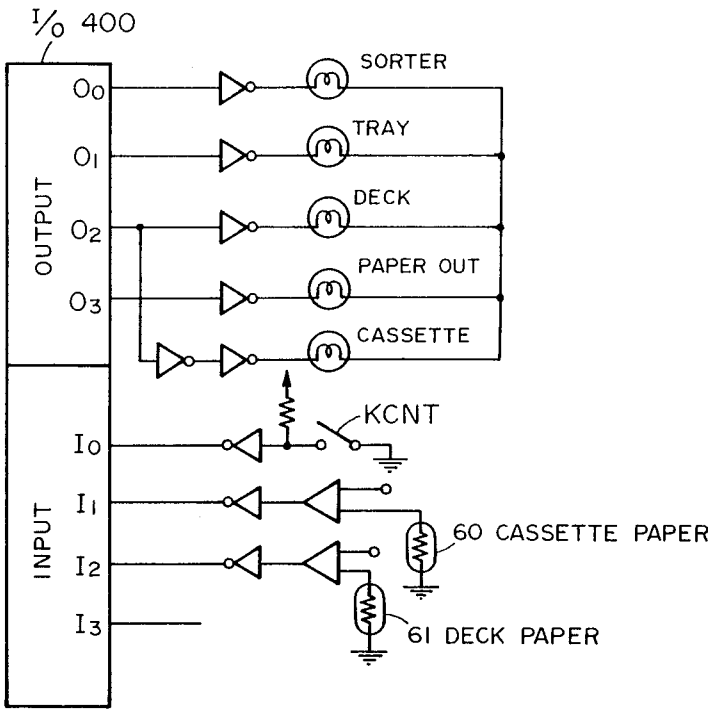
Figures 4, 5, 6, 7:
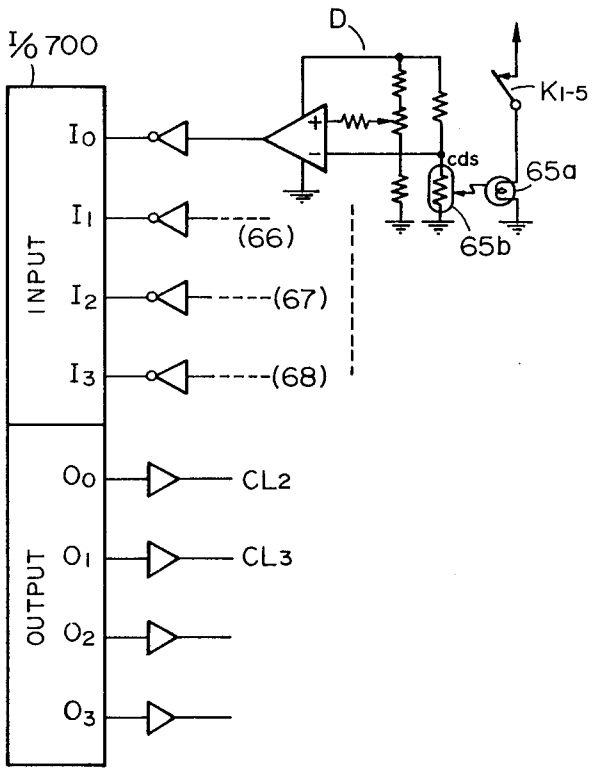
Figures 4, 5, 6:
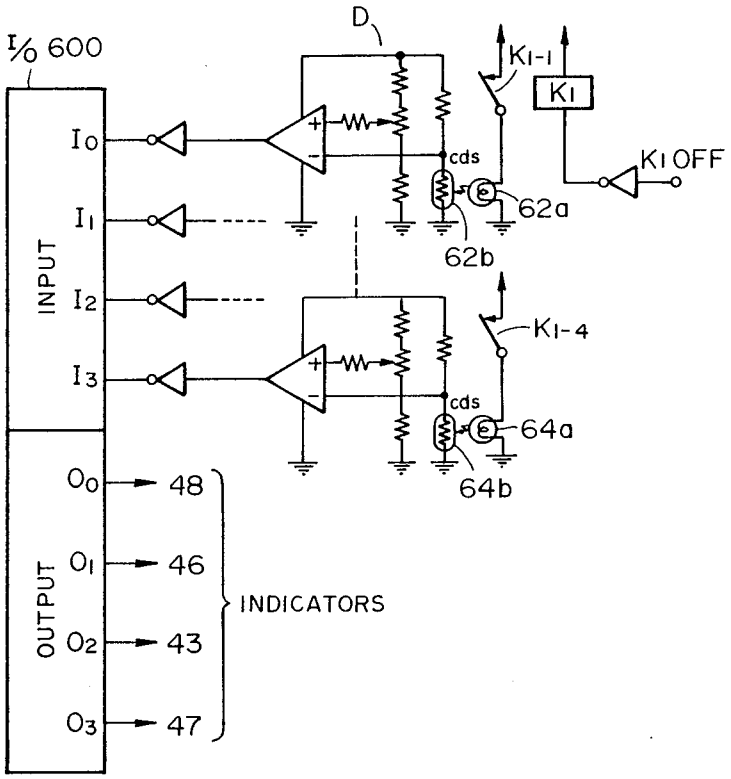

FIGS. 4-1 and 4-2 show I/O and its related circuit. I/O 100–I/O BOO are of the known type including latch and gate circuits, and in this embodiment there is used μPD 752.

In I/O BOO shown in FIG. 4-11, the output port $O_1$ is connected to a circuit for driving the motor $M_1$ which in turn drives the screen drum 1 and dielectric drum 7 into rotation, through DC driver. Port $O_2$ is connected to a high voltage transformer for corona discharge and port $O_3$ is connected to a clutch for driving the paper feeding roller and registering roller. Input port Io is so connected as to receive clock pulse CLK from the disc 83 through a line receiver (input interface). The clock pulse CLK is of importance to determine the timing operation of transformer and clutch. Input port $I_2$ is connected to a switch SW1 interlocked with the main switch SW so as to read which position the main switch SW is in, On or Off. Port $I_3$ is connected to a circuit of thermister TH1 for sensing the temperature of fixing heater so as to read whether wait time is up.

In I/O 200 shown in FIG. 4-2, the output ports $O_o$ and $O_2$ are connected to motor M3 for copy reduction and motor M2 for outlet changing-over respectively thorugh an input circuit similar to that of M1 described above. Output ports $O_1$ and $O_3$ are connected to solenoid $SL_1$ for reduction and $SL_2$ for output respectively through an input similar to that of the above $CL_1$. Input ports $I_1$–$I_3$ are connected to $RD_1$, $RD_6$ and $RD_7$ (unity, 0.6 and 0.7) of the Hall elements HIC provided along the path of lens system in a manner similar to that of the above input port B respectively for setting copy magnification (reduction).

In I/O 300 shown in FIG. 4-3, $I_0$ and $I_1$ are connected to TP (tray) and SP (sorter) of the Hall elements HIC provided at the outlet for reading which the output is, tray or sorter respectively in the above-mentioned manner so as to be useful for setting the outlet. Output ports $O_0$ to $O_3$ are connected to copy density indication lamps $L_1$ to $L_3$ (medium, dark, light) and to reduction indication lamps $L_{0.6}$, $L_{0.7}$ and $L_{1.0}$ (0.6 magnification, 0.7 magnification and unit magnification), respectively.

In I/O 400, output ports $O_0$ to $O_3$ are connected to paper feed port indication and outlet indication lamps $L_s$, $L_T$, $L_D$, $L_p$, $L_c$ (sorter, tray, deck, paper out, cassette) respectively. Input port $I_o$ is connected to a switch KCNT which detects plug-in of the key counter counting the total of copies. Ports $I_1$ and $I_2$ are connected to optical sensor 60 and microswitch 61. The optical sensor is of the type known per se for detecting that no paper is available in the cassette or deck.

KEY & DISPLAY I/O port 100 shown in FIG. 4-1 takes the input signals given by the above-described keys into the computer and drives the segment indicators. In FIG. 4-1, MAT is a known matrix circuit whose intersections current flows through when keyed on. $T_o$–$T_5$ are time divisional scanning signals for digit selection at the indicators 23-1 and 23-2 and for scanning the matrix circuits. $KR_0$–$KR_3$ are ports for input of matrix signals by key-on and numerals 100 to 107 designate driver circuits composed of transistors as shown in the drawing. In MAT, [0], [1] . . . [9] are numeral keys, CL is a clear key, COPY is a copy start key, 1.0, 0.6, 0.7 are reduction keys, Dark, Medium, Light are density keys and DEC, CAS, SP and TP are selection keys for deck, cassette, sorter and tray, respectively. The shown apparatus is of the known type including buffer register for key entry, shift register for storing indication data, digit signal generator for time divisional display of the indication data and the like and in this embodiment there is used μPD 757.

Figures 1, 5:
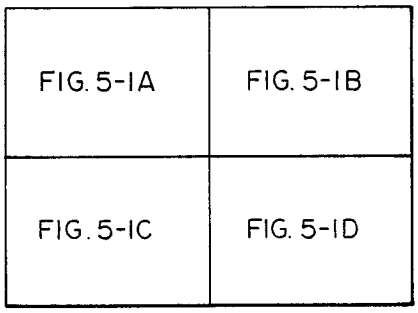
FIGS. 4-11 show in detail the input/output circuits in FIG. 3.

In I/O 500 shown in FIG. 4-5, the input ports receive inputs from motor circuits and wire breaking detection circuits. The output ports issue signals for turning off the relay $K_1$ and for putting on the jam indicators 41 and 42.

In I/O 600, I/O 700 and I/O 800 shown in FIGS. 4-6, 4-7 and 4-8, respectively, their I ports are connected to circuit D for sensing the movement of paper. From O ports of I/O 600 are issued signals for putting on the indicators 43, 46, 47 and 48 and from O ports of I/O 700 are issued signals for actuating the clutches $CL_2$ and $CL_3$ to move the optical system forward and backward. To $I_1$–$I_3$ of I/O 800 are connected sorter door switch 74 and web sensor 73, and to $O_3$ of I/O 800 and O ports of I/O 900 are connected to high voltage driving parts respectively. Each of HVTA to HVTE is a circuit as shown in the part A of FIG. 4-11. They are provided to actuate corona dischargers 2, 3, 6 and 17-2 to 17-11, respectively. $I_3$ of 800 and I ports of 900 are connected to the above high voltage circuits to have inputs of operation state signals. I/O A00 is so connected to hall elements as to receive various signals necessary for sequence control such as DHP (detection signal of screen drum stop position 81), OHP (detection signal of optical system stop position 84), registration signal RG by 83 and reversal signal OBP by 85.

Referring again to FIG. 3, CPU comprises 4-bit registers AC and PC for addressing the above described memories and input-output apparatus, other 4-bit registers A,B,C and D for storing other primary data and addresses, overflow bit checker OVF, read, write and instruction block CFT, control part CT with adding and subtracting logic control for decoding the input data from data signal lines and for processing data, and operational circuit ALU. The operational circuit ALU has functions for decimal data correction, addition and exclusive OR. The contents of register A (accumulator ACC) can be turned right (rightward shift) and left (leftward shift) so that bit checking may be carried out by OVF. CPU comprising the various circuits described above is connected to the external circuits previously described through connection lines. In brief, CPU is connected to the external circuits in the following manner:

The CPU addresses the programmed ROM for data. Contents of the instructed address are read into CPU through data signal line $DB_1$ and CPU decodes the contents. In accordance with the contents decoded, CPU executes various control programs in time series starting from throwing in the power source. Sometimes CPU processes data in itself and sometimes CPU delivers some data from it to RAM to have the data stored in the latter at a certain appointed address. Furthermore, CPU can take in it data from an instructed address of RAM or develop data stored in it to a signal line, for example, to $DB_3$ of I/O AOO. At another time, data on the signal line $DB_3$ may be introduced into CPU. In this manner, CPU carries out various controls.

FIG. 5-1 shows a program sequence relating to initial set, key entry and process sequence diagnostic flow which are coded in this order and stored in the memory ROM shown in FIG. 3.

When a sub power source switch (not shown) provided in the body of apparatus is turned on, a power source is connected to the control part including CPU to read out the program of ROM and start processing (STAT).

At Step 1, all the data of RAM 4 bit, 256 words, addresses X'000' to X'OFF' are cleared. After reading whether the main switch SW is on or off, step 2 is carried out only when the main switch SW is on. Reading of the position of SW is made by reading whether the input port $I_2$ of I/O port BOO (FIG. 4-5) is 1 or not. CPU appoints chip BOO and takes the input data 4 bits into the accumulator ACC. Repeating leftward shift, reading is made as to whether 1 is set at the first bit.

At Step 2, to set the image forming condition to the standard mode, data necessary for it are at first written in the predetermined addresses of RAM. Contents of the data are shown in the following Table II.

TABLE II

| | address | 1.0 | 0.7 | 0.6 |
|---|---|---|---|---|
| reduction indication | X' 043' | 0 | 8 | 4 |
| instructed position of reduction | X' 033' | 0 Dark | 8 Medium | 4 Light |
| copy density | X' 053' | 1 | 0 | 2 |
| | | Tray | Sorter | |
| outlet indication | X' 042' | 2 | 1 | |
| instructed position of outlet | X' 032' | 2 | 1 | |

For the standard mode, the reduction ratio is 1:1 the outlet is a tray and the copy density is medium. Therefore, RAM data are a number other than 0 for (X' 043'), 0 for (X' 033'), 0 for (X' 053'), 2 for (X' 042') and a number other than 2 for (X' 032'). Herein, (X' 043') means the data of address X' 043'.

At Step 3, it is checked whether paper is present or not. As mentioned above, a deck has a capacity to receive four times as large amount of paper (about 2,000 sheets) as a cassette does. Therefore, it is recommendable that paper sheets of the size most frequently used (for example A4 format) be contained in the deck and paper feeding be made from the deck. So, at this step, at first a check is made as to whether paper sheets remain in the deck for the standard mode where the deck is to be selected. To this purpose I/O 400 is sensed to check the paper detector 61. When the presence of paper is confirmed, data of the deck is set in RAM. Namely, (X' 052') is made to 8 (3-1). When the deck contains no paper, cassette is selected and the paper detector 60 is checked to know whether paper sheets remain in the cassette. When the answer is "no", the lamp 33 is put on. To this end, (X' 062'') is made to 8. When "yes", it is made 0 (3-3). Thus, when there are paper in cassette, X'052' is made 0 and the cassette is set (3-2).

At Step 4, to make 1 indicated on the count indicator 23-1 and 0 on the other count indicator 23-2, the hundreds digit (X' 03A') of counter SET at RAM is set to 0, the tens digit (X' 03B') to 0 and the units digit (X' 03C') to 1, whereas the hundreds digit (X' 04A') of counter COPY is set to 0, the tens digit (X' 04B') to 0 and the units (X' 04C')

At Step 5, all the data set in RAM at the previous steps 1 to 4 are produced to I/O ports, 4 bits all at once. Indication data (X' 022') is derived to I/O 400 in the form of (X' 032'')+(X' 052')+(X' 062'). Thereby, the paper-out lamp and deck and cassette selection lamps are turned on. For a standard mode, there is put out 6, that is, 0110 to turn the deck indication lamp and tray indication lamp on. (X' 023') is developed to I/O port of X' 300' as the content obtained by operation of (X' 033')+(X' 053') so that the unit magnification lamp and medium copy density lamp are turned on. Furthermore, RAM contents of X' 02A'-X' 02C' and X' 03A'-X' 03C' are delivered to address of Key & Display I/O 100 so that 001 and 000 are displayed on the set number counter 23-1 and copy number counter 23-2 respectively.

At Step 6, data keyed in $KR_0$ to $KR_3$ of Key & I/O are read in. When no keyed-in data, there is given data XF' to X'01C' and X'018'. When any keyed-in data, the data is provisionally stored in RAM X'01C' and X'018', which is shown in detail in the flow chart in FIG. 6-1. This flow chart is based on the type of μPD 757 and each step corresponds to one step to be stored in ROM.

At Step 7, the data stored at Step 6 are set to load RAM with keyed-in data at the necessary addresses mentioned above in accordance with the contents of the data. For example, when 0.7 reduction key was depressed, then (X' 01C') is 1. Therefore, RAM is loaded with (X' 033'). In other words, bit 1 is set at 8, that is, 0.7. When the numeral key is 9, then, since (X' 018') is 9, (X' 02B') is shifted to (X' 02A'), (X' 02C') to X'02B' and 9 is set at X'02C'. At the same time, like in Step 5, the mode is indicated.

At Step 8, paper feeding section set at Steps 6 and 7 is checked. Sine the set paper feeding section is cassette when (X' 052') is 0 whereas it is deck when 4, the corresponding paper sensor 60 or 61 gives the necessary information. When there is paper in the feeding section, paper reflects the light of 60*a* or 61*a* and the reflected light is sensed by a CdS de 60*b* or 61*b*. If no reflected light is sensed, it is regarded as paper being out in the section. According to the result of the check, the paper-out lamp is put on or off like in Step 3. Hereinafter, a means a lamp and b does a photo element.

Figures 4, 5, 6, 7, 8, 9, 10:
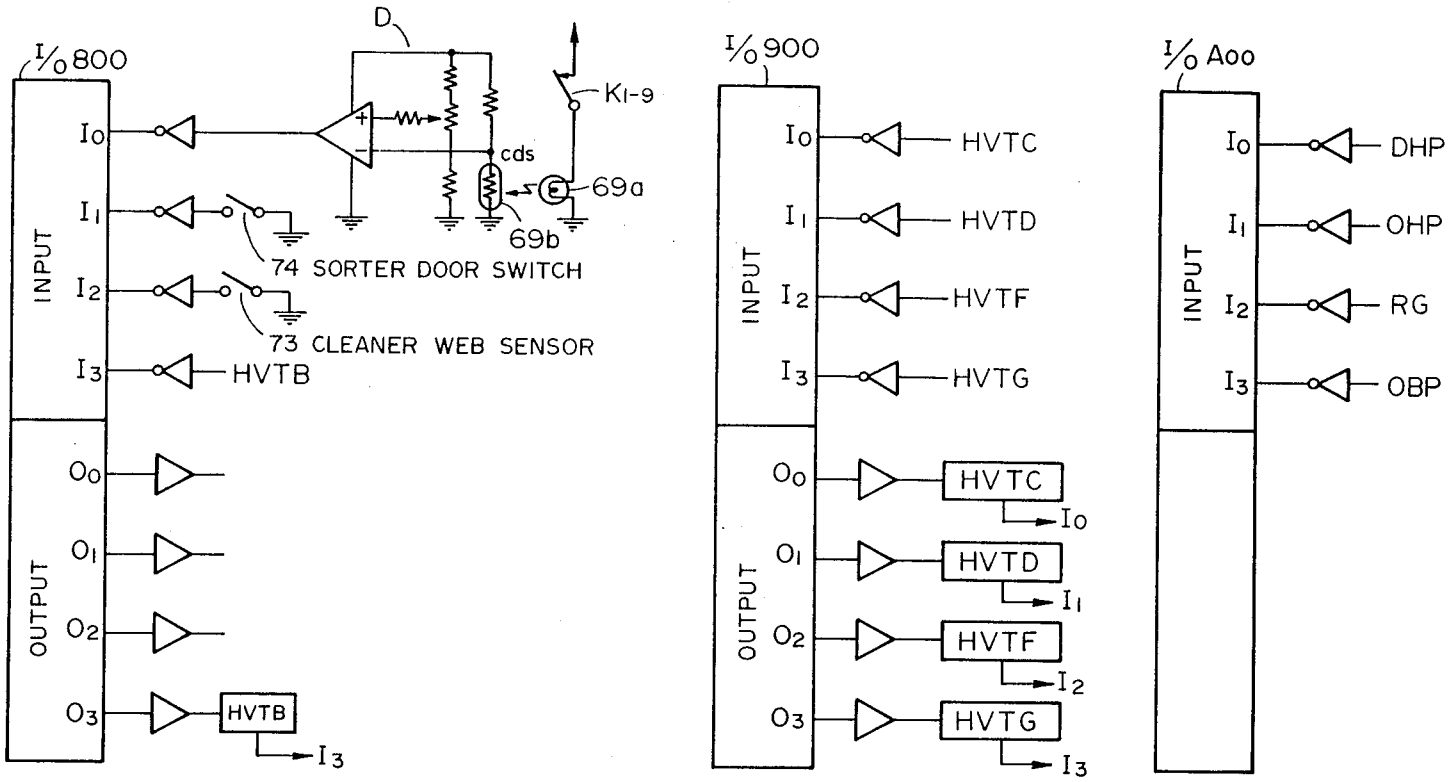

At Step 9, check is made as to whether the lens system and mirror system are in the instructed positions for the selected reduction mode. If not, the positions are adjusted to the proper ones (FIG. 5-2). More particularly, at Step 16 shown in FIG. 5-2, data of RAM given by Step 7 is compared with that of I port of I/O 200. In other words, it is checked whether (X' 033') of RAM is equal to (X' 043'). Assuming that an instruction of reduction is 0.7 and the lens system is positioned at 0.7, then (X' 033') is 1000 and (X' 043') is also 1000. They are equal to each other. However, if the lens is positioned at the position of unit magnification, then (X' 043') will be 0000 because $I_2$ of I/O 200 is 0. In this case, (X' 033') is not equal to (X' 043') and therefore the position of the lens system is shifted to its correct position. To move the optical system, reduction motor $M_3$ is turned on at first and then rotation locking solenoid $SL_3$ is turned on as shown in FIG. 8-1. When the magnet carried on the lens reaches the position of sensor RD7, the port $I_2$ of I/O 200 becomes 1 and therefore $M_3$ and $SL_3$ are turned off. This data is set to X' 043'.

At Step 10, the position of power source switch SW is checked so long as the lens system is in the instructed position. Whether control has to be carried out once more again from start or not is determined by this check which is made by sensing the port $I_2$ of I/O BOO. If SW is off, the flow is returned to start and RAM is cleared.

At Step 11, it is checked whether the paper outlet is in the instructed position. When not, the position of outlet is changed (FIG. 5-2). More particularly, data (X' 032') of RAM given by Step 7 is compared with data (X' 042') from I port of I/O 300 at Step 18. As an example, assuming that the instructed position is tray and the outlet is correctly in tray position, then (X' 032') is 0010 and (X' 042') is also 0010, which are equal to each other. But, if the outlet is at sorter, then (X' 042') is 0001 which is different from 0010 of (X' 032'). In this case, changing of outlet is carried out in the following manner:

At first, the outlet motor $M_2$ and rotation locking solenoid $SL_2$ are turned on to shift the outlet from sorter to tray. When the magnet provided at a fixed shaft of the belt 19 reaches the area of tray sensor 70, the latter is turned on, which makes 1 input at the port $I_o$ of I/O 300 to inform that the outlet has just arrived at tray. Then, $M_2$ and $SL_2$ are turned of and the data is set at X'042' of RAM.

At Step 12, check is made as to whether the key counter is pluged in or whether the apparatus is in the position ready for copying. Whether wait is up or whether the temperature has reached the level at which fixing is possible, is checked by instruction of I/O BOO and sensing the port. When the apparatus is not in the position ready for copying and after the changing of the reduction position and outlet position has been carried out, the flow enters Step 20 at which a 30 sec. stand-by timer is set. Through the step, routine to check key entry and routine to check paper in feeding section, outlet position and reduction position are executed once more again.

At Step 13, check i made as to whether the copy key 21 is available. This check is carried out by checking the corresponding RAM data.

When not, step is advanced to Step 14 at which check is made as to whether any other key has been keyed in by checking whether (X' 018') and (X' 01C') are F. When it is found that there has been no key input, step is advanced to Step 15. The number of steps to this step is about 1000 and each one step requires about 10 $\mu$ sec. Therefore, a period of 30 sec. passes when the routine up to Step 15 has been repeated about 3000 times. Taking this into account, 3000 is stored at WA(O) in RAM (Step 20) and subtraction of 1 from 3000 is made every time when Step 15 is carried out (15-1) and when it becomes 0, an advancement to the initial step STAT is made and setting of standard mode is carried out after clearing RAM (Step 2). If any key entry is made during this period of 30 sec., then Step 20 is carried out again and 30 sec. is stored at WA(O) in RAM. The above subtraction routine is executed. The details of Steps 14 and 15 are shown in FIGS. 6-2A and 6-2B.

If the copy key is keyed on during the time, the routine enters Step 21. Drum motor $M_1$ and high voltage transformer are turned on and copying operation is started. If any jamming occurs during copying operation or if papers in deck or cassette are all out, then motor $M_1$ and high voltage transformer are turned off. But, the step remains at 21. Therefore, RAM data remains held and the indications of the number of copies and the like remain as they were even when the power source switch SW is turned off. When the door is opened, RAM data are kept unerased but various indications on the indicators disappear.

Counter COPY of RAM is incremented at each end of one copy cycle (every paper feed) and the count is indicated on the indicator 23-2 which is compared with counter SET. When the two values get coincident to each other, the main motor $M_1$ and high voltage transformer are turned off. Then, step is advanced to Step 20 and 30 sec. timer is set. The timing to leave Step 21 for Step 20 with turn-off of $M_1$ is just after the last paper has passed over the paper detectors 64 and 65. Also, when the clear key is keyed on at the time of jam or paper being out, the step leaves 21 and enters 20 where 30 sec. timer is set. If key entry of the copy key or other key is not done after this setting of 30 sec. or if the next key entry is not done after the first key entry, then the step is returned to STAT step and mode is returned to the standard mode. When the copy key is keyed on during this time period of 30 sec., copying is carried out from beginning with the previously set number. Check on the stop key is carried out before Step 21-4 and when stopped, the routine goes to the same step as in the case of copy count up. Step 24-4 is carried out immediately after feeding paper.

Figures 1, 6:
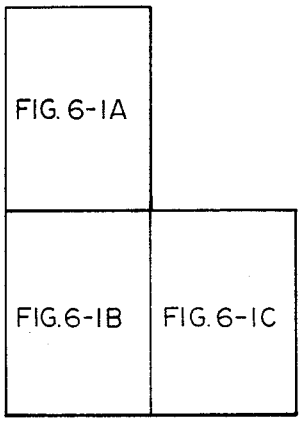
Figures 2, 6:
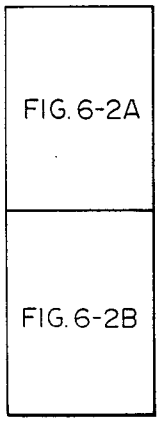
Figures 1A, 6:
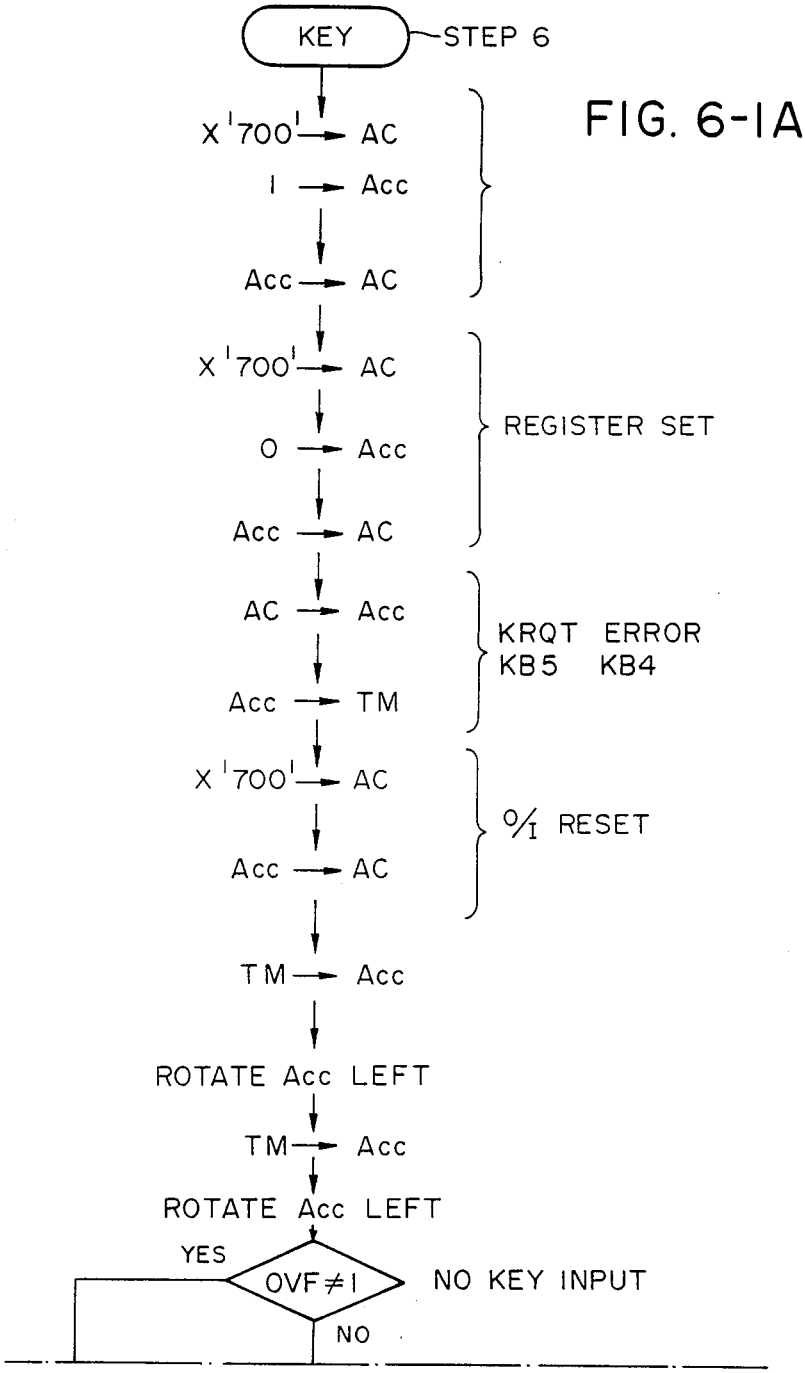
Figures 1B, 6:
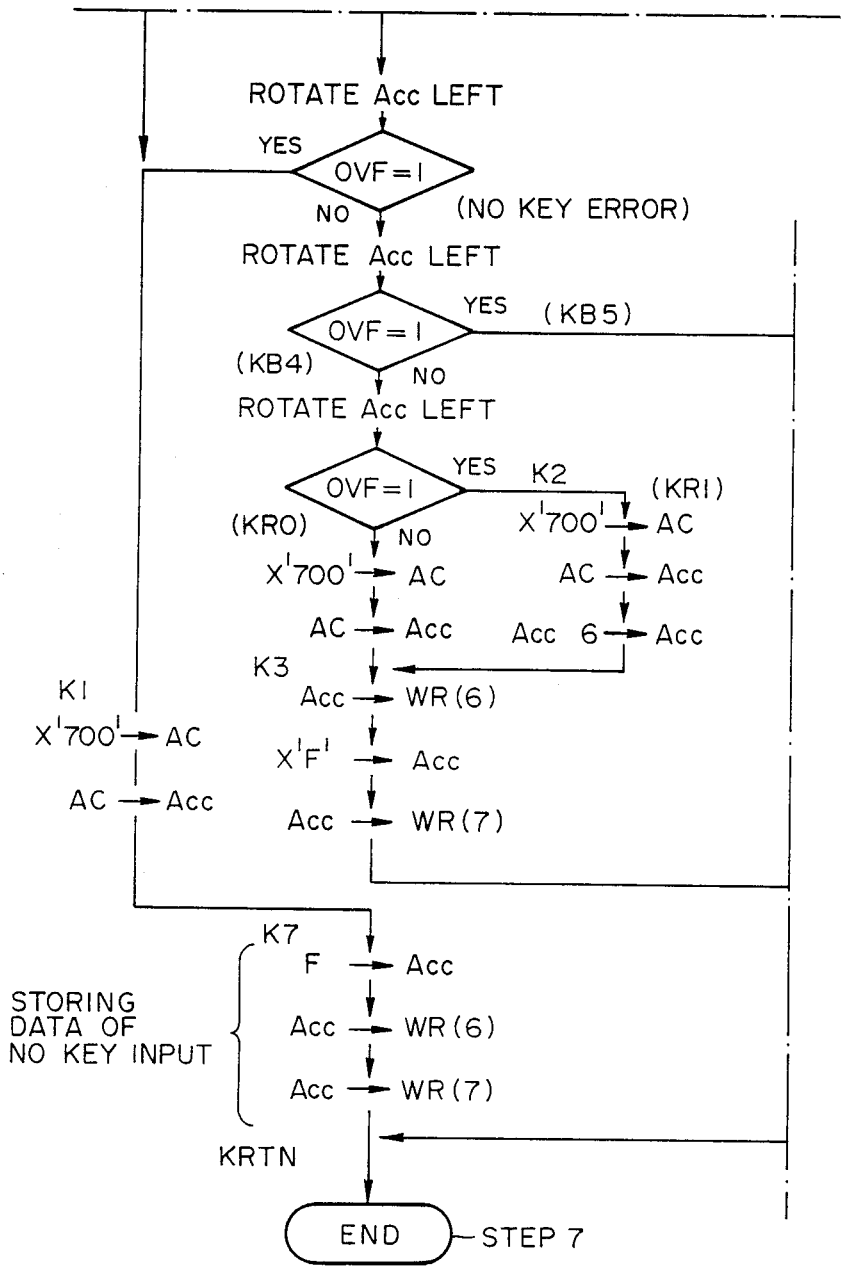
Figures 1C, 6:
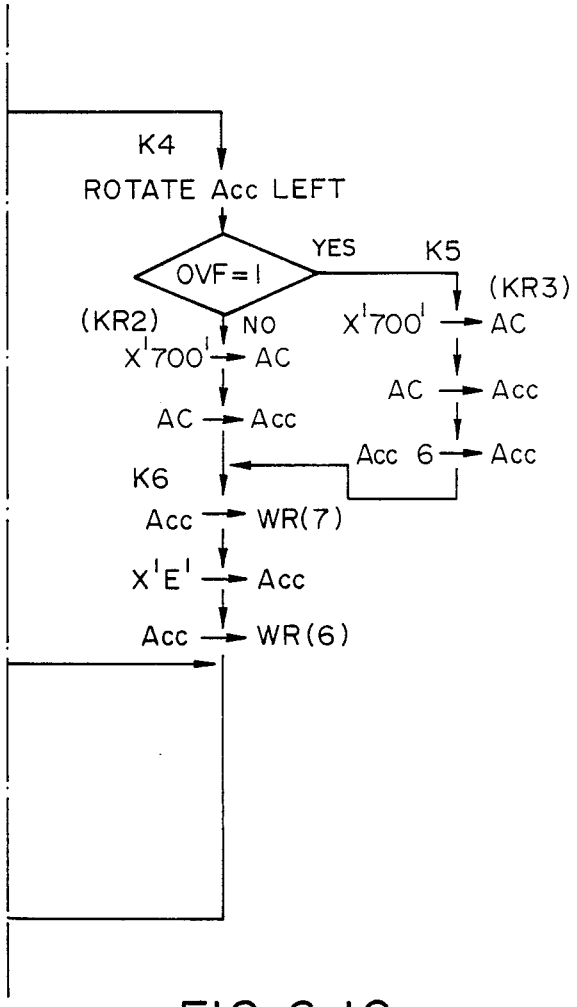
Figures 2A, 6:
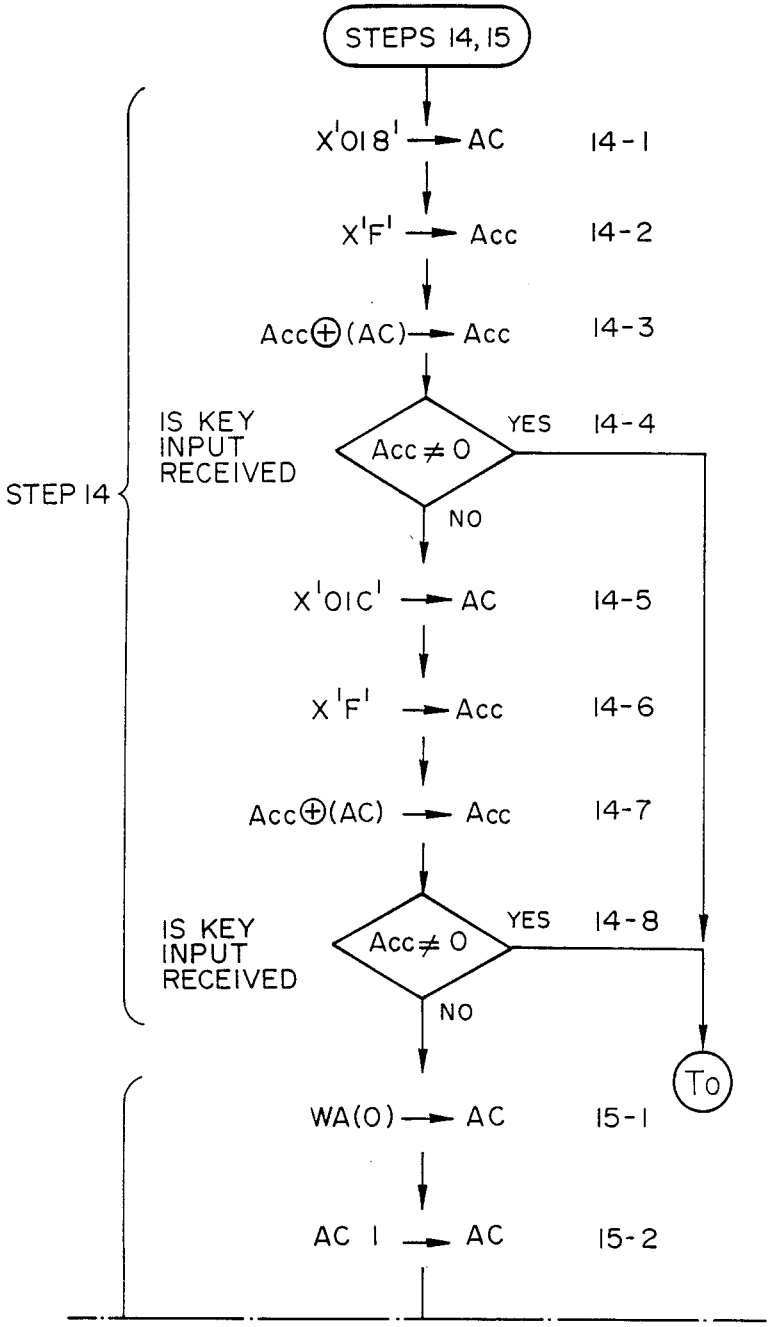
Figures 2B, 6:
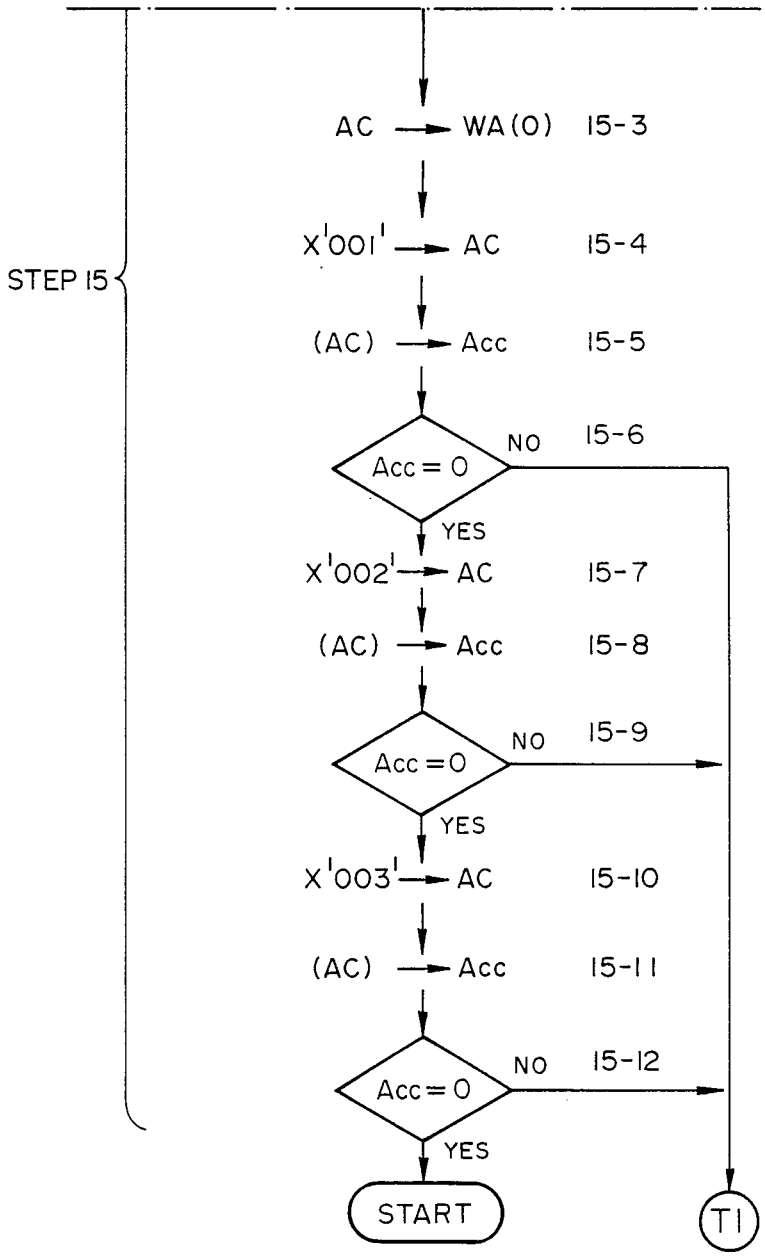
Figures 2, 7:
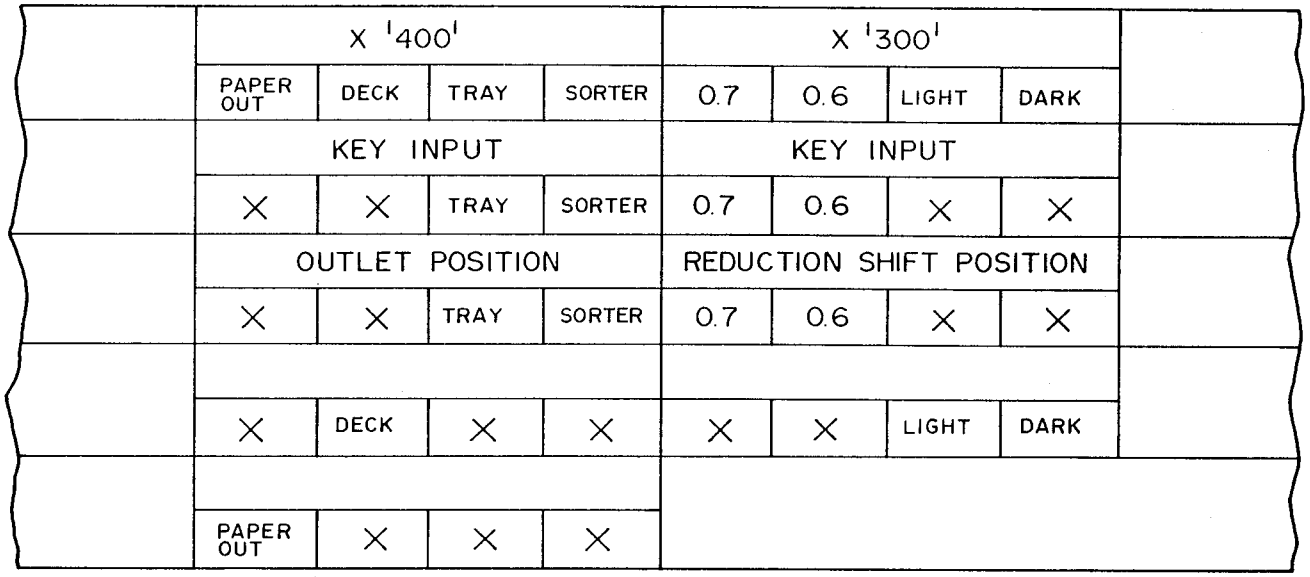
Figures 1, 8:
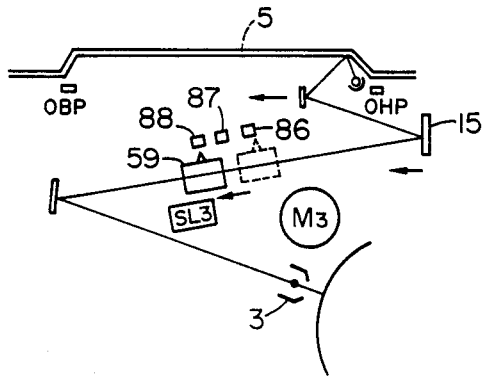
Figures 2, 8:
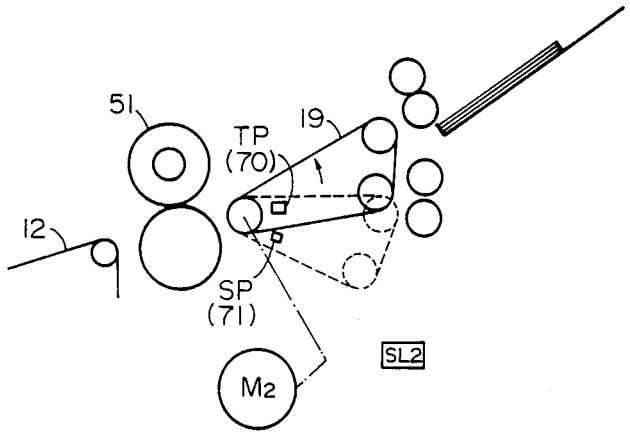
Figures 1, 9:
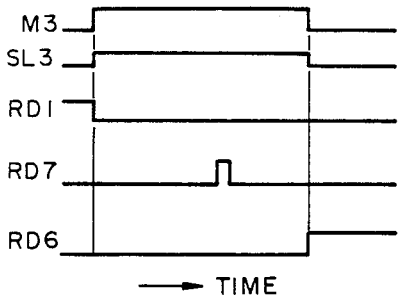
Figures 2, 9:
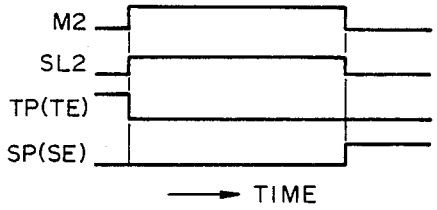

At Microsteps of from 14-1 to 14-4 shown in FIGS. 6-2A and 6-2B, data of X'018', that is, inputs of various keys for reduction of unit, 0.7 and 0.6, copy density, clear, cassette, deck, sorter and tray are checked. At Step 14-3, exclusive OR of data stored in ACC and AC is stored in ACC and when incidence is obtained at F, ACC becomes O. Therefore, after carrying out Steps 14-5 to 14-8, check on the data of X'01C' is made and the numeric keys are examined. At Microsteps of from 15-1 to 15-3, X'001'–X'003' are shown at WA(O) as 3 digit working register. After subtracting 1 from the numerical value, the subtracted value is again stored in WA(O). At Steps 15-4 to 15-6, it is checked whether the hundreds digit of WA(O) is O, at Steps 15-7 to 15-9 whether the tens digit is 0 and at Steps 15-10 to 15-12 whether the units digit is 0. When yes, step is returned to the start step.

FIG. 8-1 shows a mechanism for carrying out reduction shift. Lens system 59 and mirror 15 are moved forward and backward by motor $M_3$. In accordance with the instruction for reduction, the position of the lens 59 and mirror 15 together is shifted to the instructed position determined by RD1, RD7 or RD6 which gives the optical system a given optical length necessary for making the instructed reduction copy. When the above optical system is in the instructed position, $SL_3$ is turned off to lock it in the position.

FIG. 9-1 shows a time chart for the case in which the position of the optical system is shifted from unit to 0.6. When keyed on, (X' 033') of RAM is made 4 and since (X' 043') is 0, 3 is set at 0 of I/O 200 to turn $SL_3$ and $M_3$ on. When it is found by checking that I of I/O 200 has been turned to 8 ($I_3=1$) by Hall elements RD1, RD7 and RD6, $SL_3$ and $M_3$ are turned off. At the same time, 4 is set at X'043'.

FIG. 8-2 shows a mechanism for carrying out the outlet shift. With the rotation of motor $M_2$ the belt 19 is moved upwardly or downwardly. In accordance with the instruction for outlet, the position of the belt 19 is shifted in such a manner that when any one of sensors 70 and 71 is on, the belt is in the position for the instructed outlet. When the outlet is in the instructed position, $SL_2$ is turned off to lock the outlet in the position.

FIG. 9-2 shows a time chart for the case in which the outlet is shifted from tray to sorter. When keyed on, (X'032') of RAM is set which is compared with (X' 042'). Since the latter is different from the former, 0 of I/O 200 is set to turn $SL_2$ and $M_2$ on. In the manner mentioned above, $SL_2$ and $M_2$ are turned off by signals coming from the sensors 70 and 71 when the outlet reaches the instructed position. Thus, the outlet is set at the instructed position.

As seen from the foregoing, according to the invention various copying conditions given by key inputs are shown on the indicators and when the copying process is not started within a predetermined time length after the last key entry, the indications appearing on the indicators are all cleared or returned to those for standard mode. Therefore, mistakes or errors in forming images are minimized and a prompt restart of image forming operation is allowed.

Diagnostic Sequence 1

Figure 10:
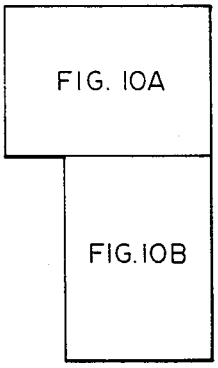
Figure 10A:
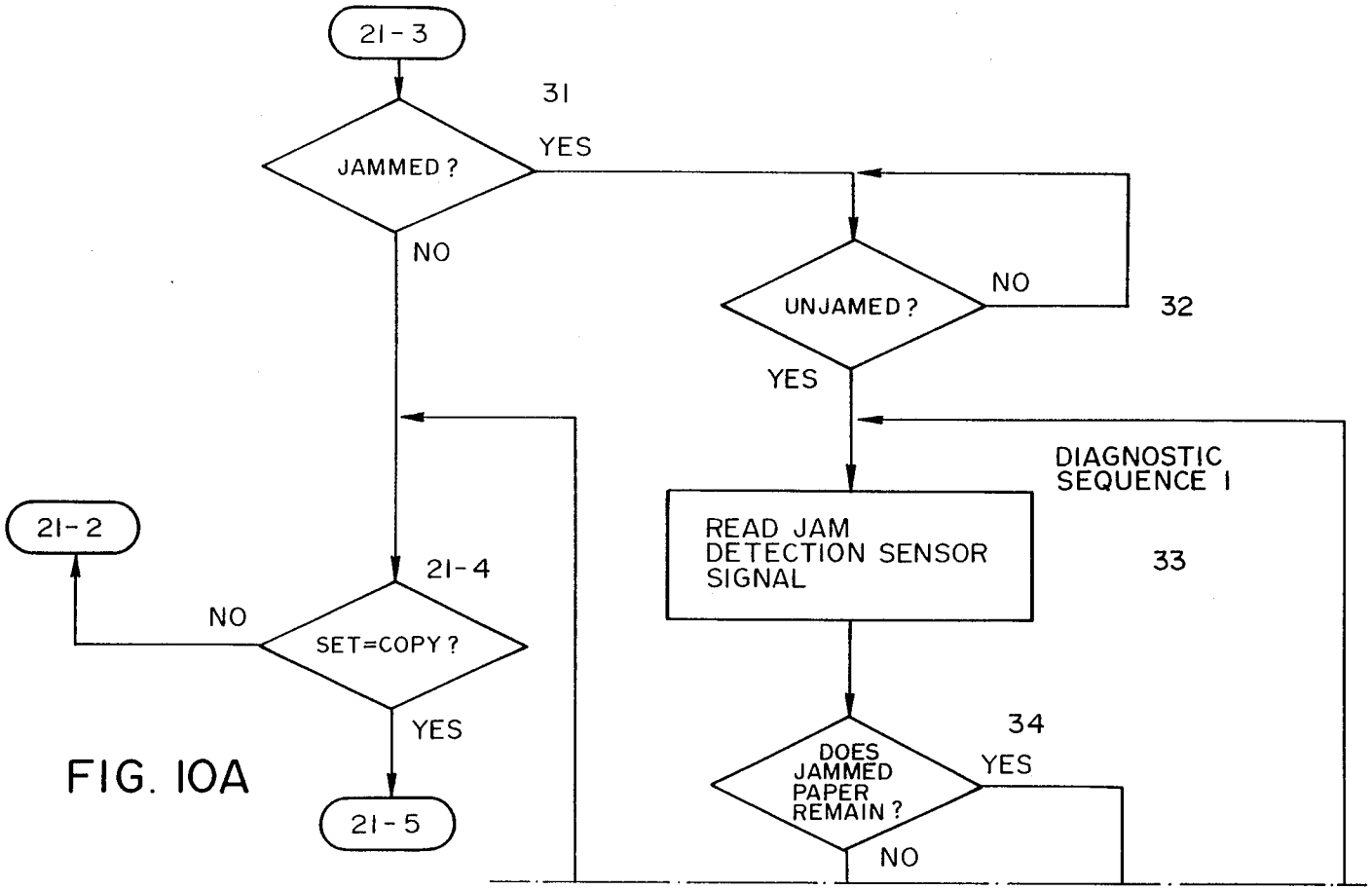
Figure 10B:
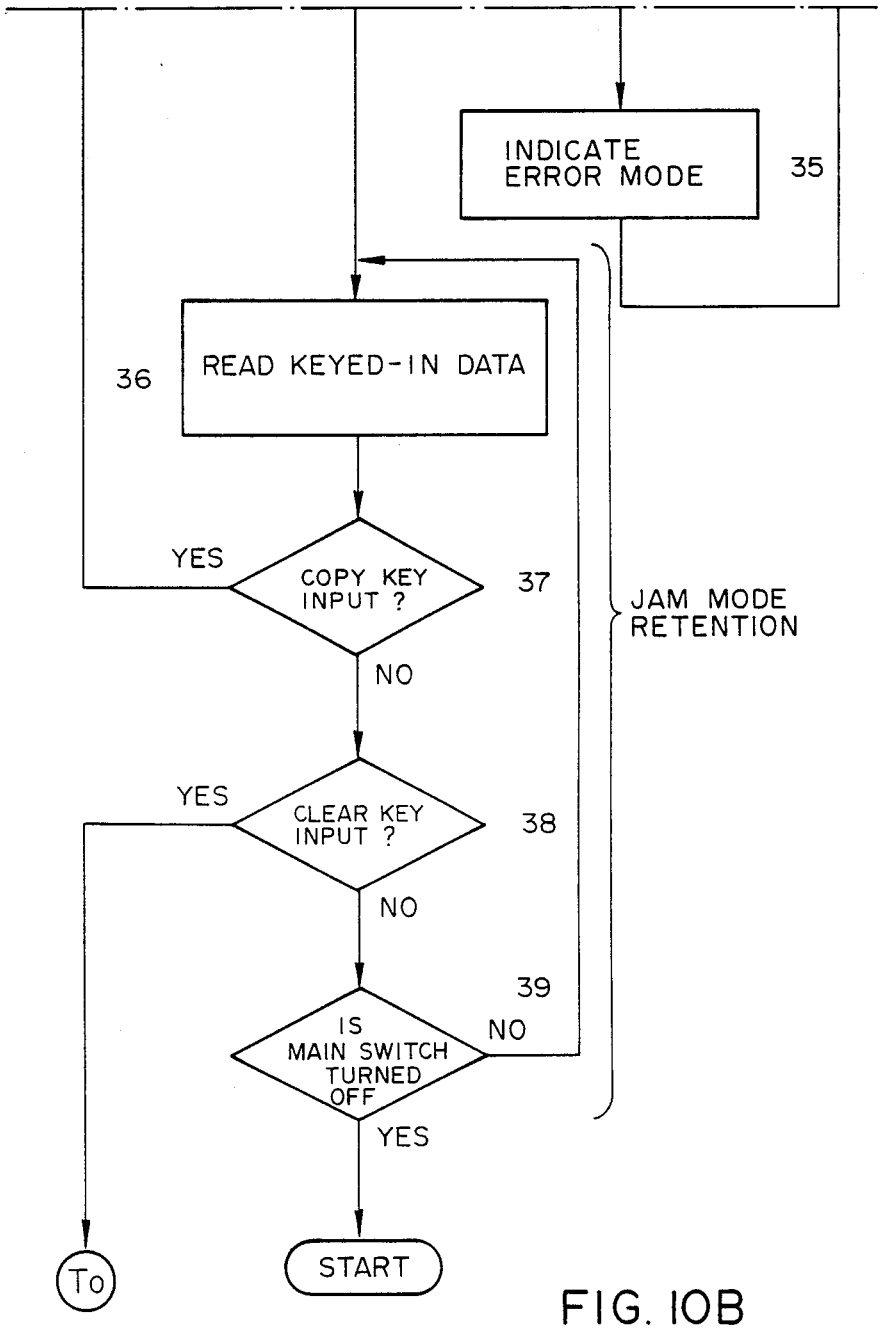
Figures 1, 11:
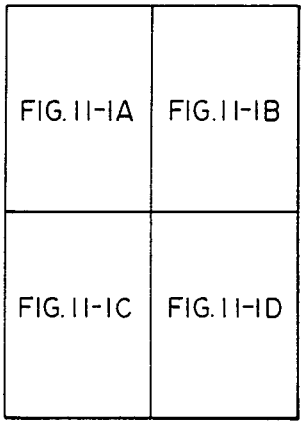
Figures 2, 11:
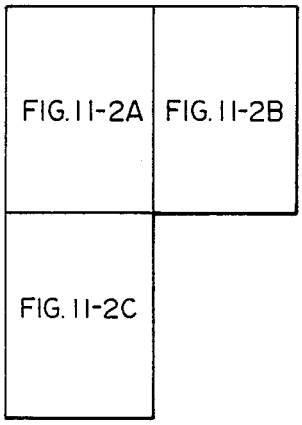

FIGS. 10A and 10B are a flow chart for showing the details of the jam check step 21-3 previously described with reference to FIGS. 5-1A through 5-1D.

At Step 31, a jam, especially paper jammed in the paper moving path is detected.

Detection of jam is carried out by sensing the paper sensors 62–67 provided in the copying machine shown in FIG. 1 as well as the paper sensors 68 and 69 in the sorter in a given timing to check whether paper has reached the area of the corresponding sensor at the proper time. Each the sensor is an optical sensor known per se which outputs a signal 1 when it detects a sheet of paper. Sensors 62 and 63 are provided in paper feeding section, 64 and 65 designate sensor in conveying section and 66 and 67 designates sensors in the paper discharge section. At the position 62, two pairs of lamps and light receiving elements are disposed perpendicularly to the moving direction of paper with one pair being spaced from the other by a predetermined distance. The sensors can check any deviation of paper from the normal moving path so that paper feeding may be stopped whenever such deviation occurs. Hereinafter, the paper detection signals from the sensors 62–65 are designated by $J_1$–$J_5$, signals from the outlet sensors 66 and 67 by $J_t$ and $J_s$ and signal from one of deviation sensors 62' by $J_1'$.

When the above sensors 62',62–69 do not sense any paper, it is regarded as a jam and the step is advanced to 32. At Step 32, check is made as to whether the reset button 100 provided in the machine body for removing jam is on. Since the machine remains held in the jam mode even after the jam has been removed, it is required to release the jam mode by the reset button 100. When the reset button is on, the step further goes to 33 at which the sensors 62–69 are once more scanned to check whether the jammed paper still remains. If the paper remains in the area of any sensor (Step 34), then, an error flag is set at RAM as an error mode and a symbol F-P showing the diagnostic mode during the jam is indicated on the segment indicator 23-1 for setting the number of copies to be made (Step 35). In these steps, Steps 33–35, check and indication relating to the jammed and remaining paper are carried out one by one successively starting from the sensor 62. When paper is detected by sensors 62 and 63, symbols E 1 and E 2 are alternately indicated on the segment indicator 23-2 for counting the number of copies completed.

Figures 4, 5, 6, 7, 8, 9, 10, 11:
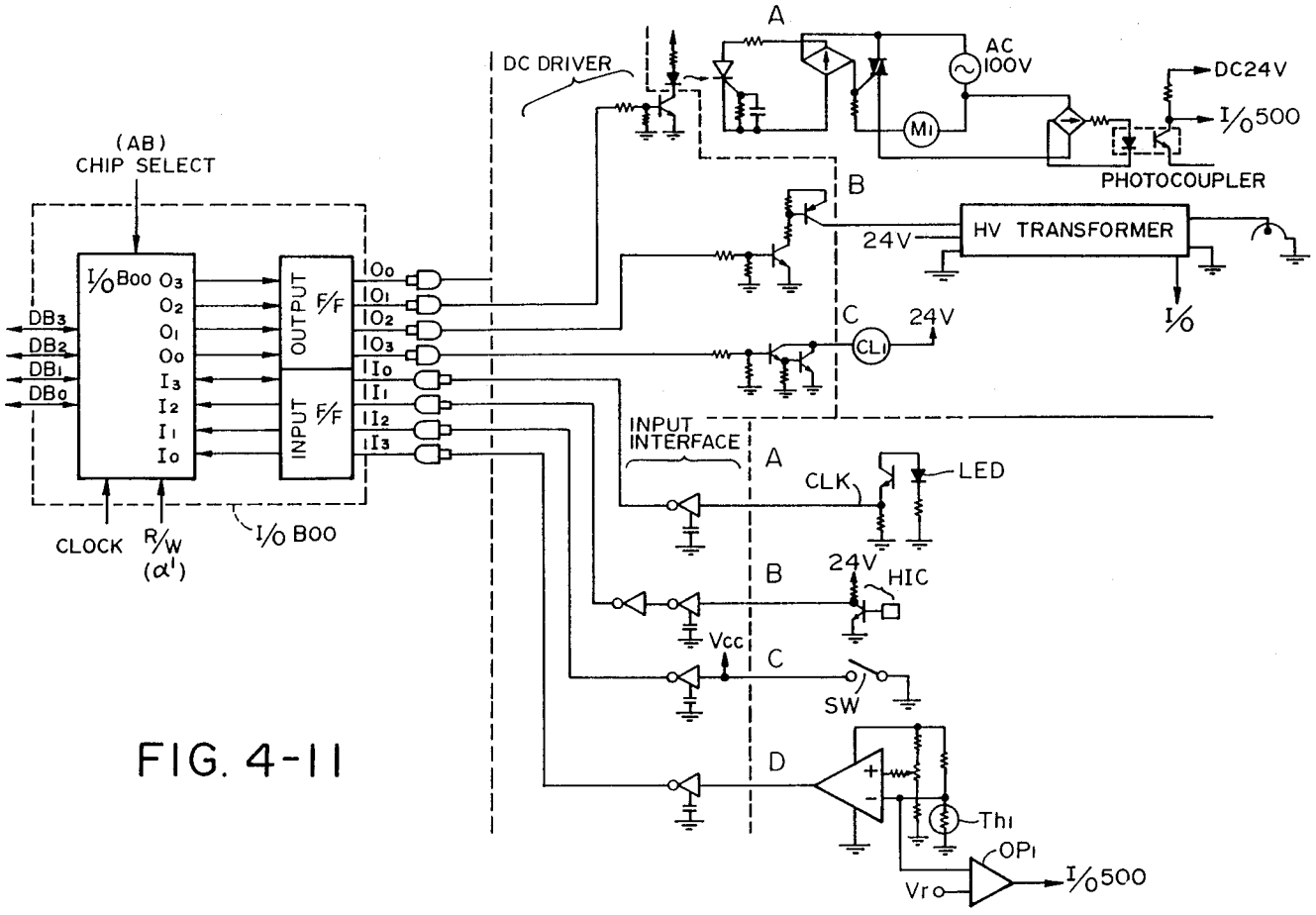
Figures 1A, 5:
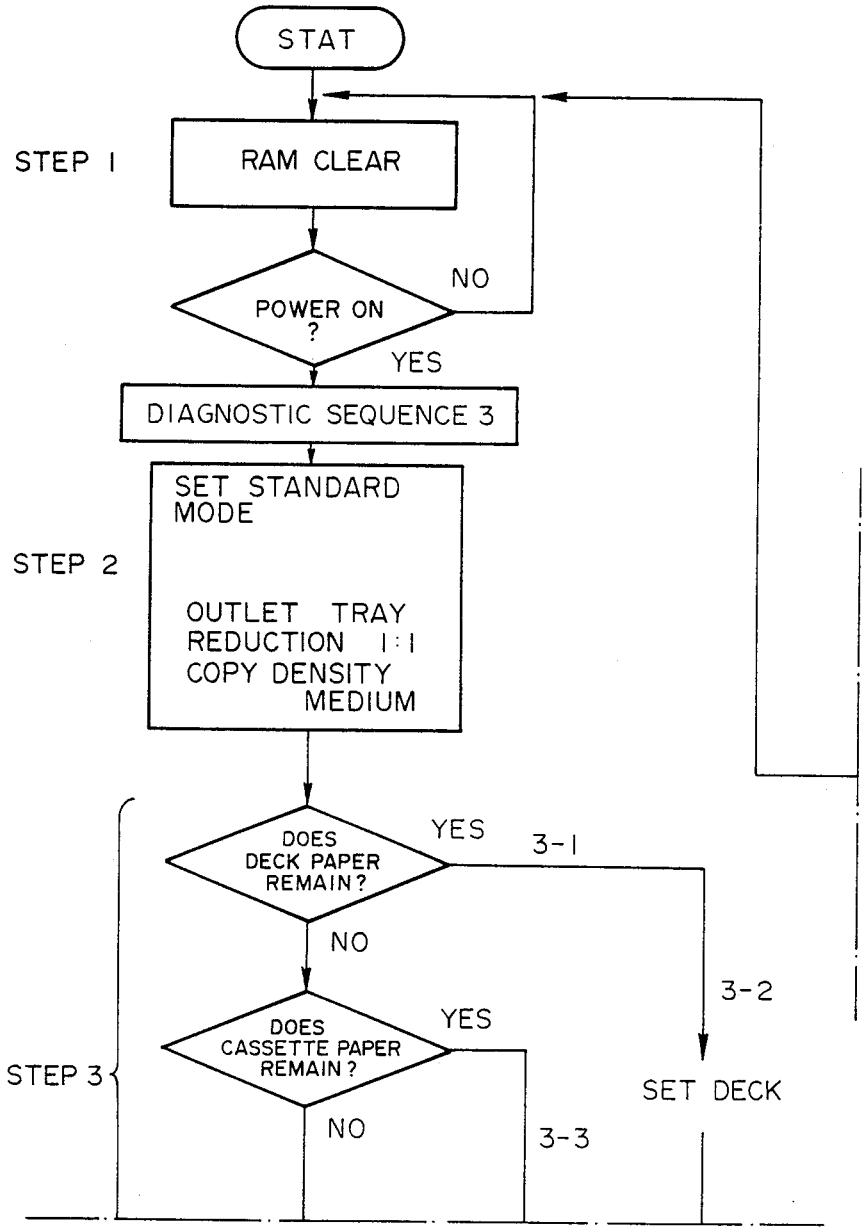
Figures 1B, 5:
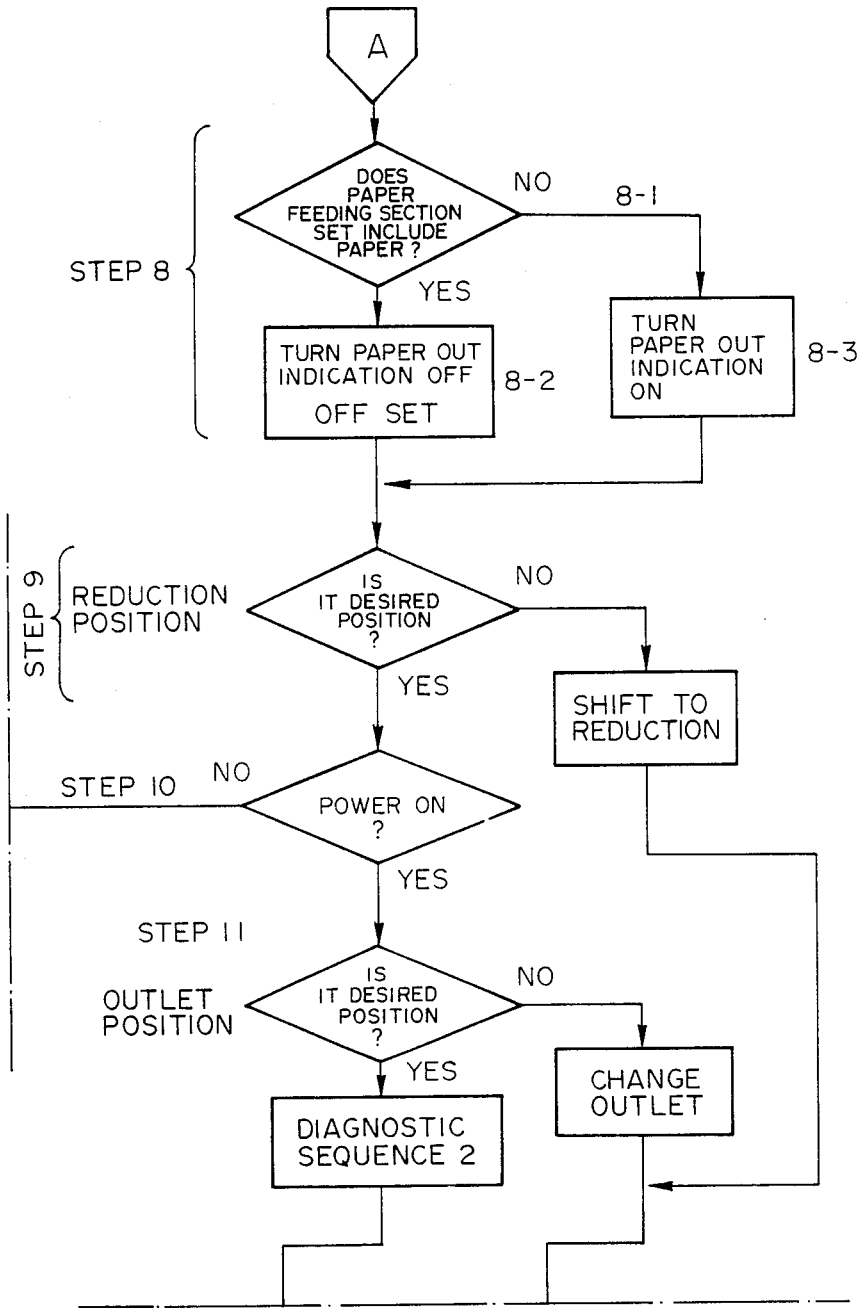
Figures 1C, 5:
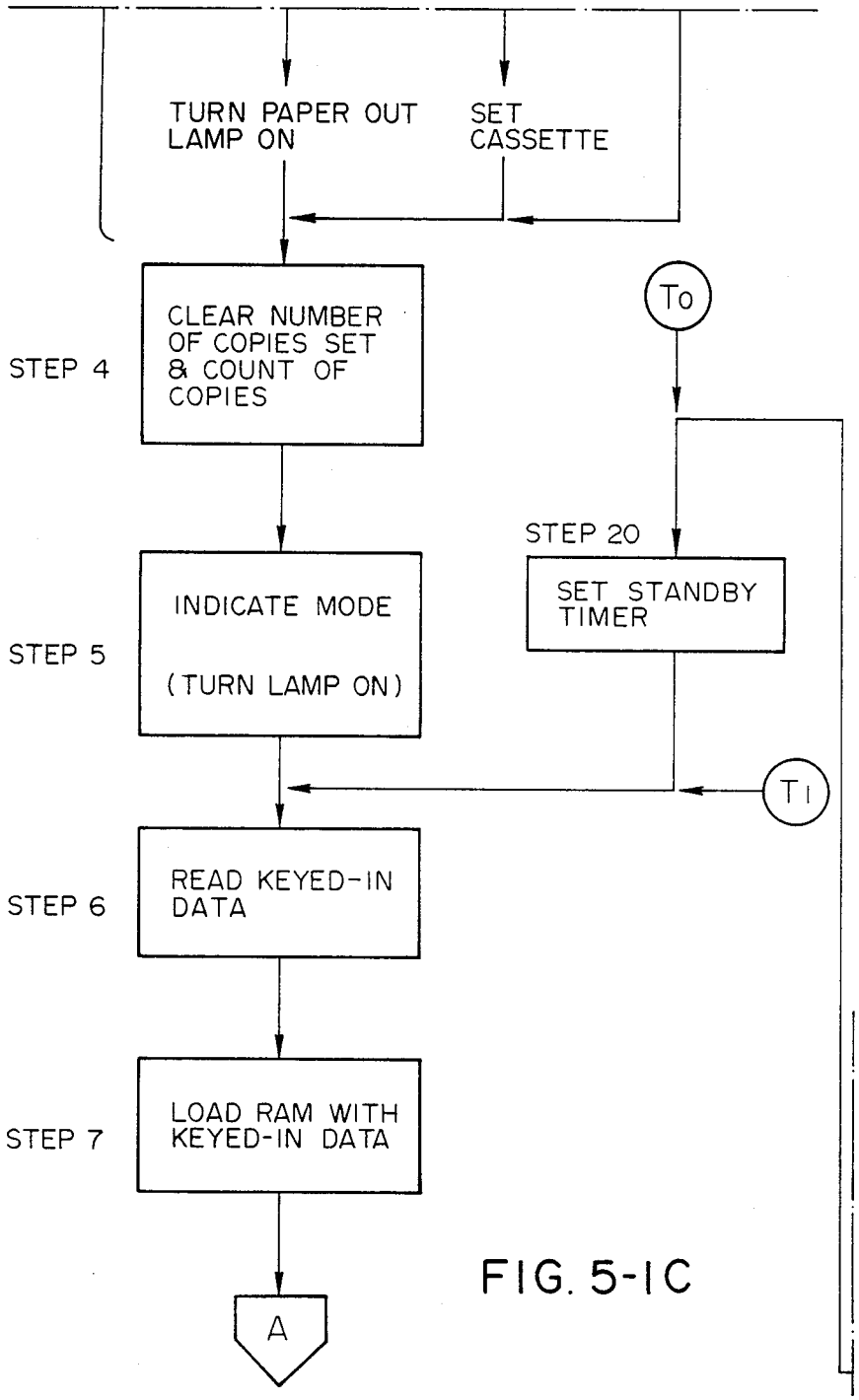
Figure 12:
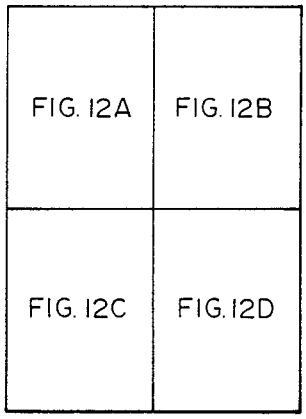
Figure 12A:
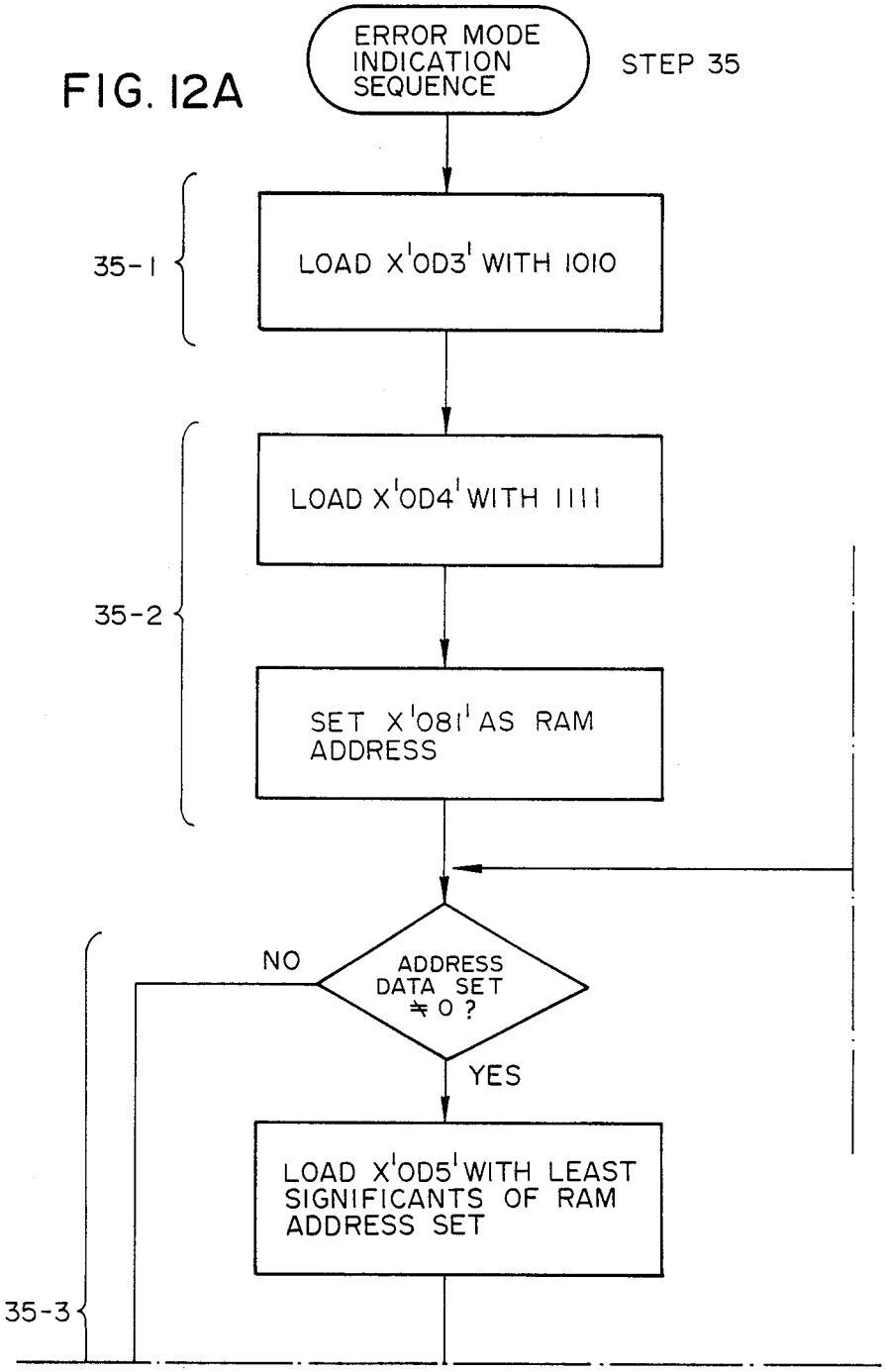
Figure 12B:
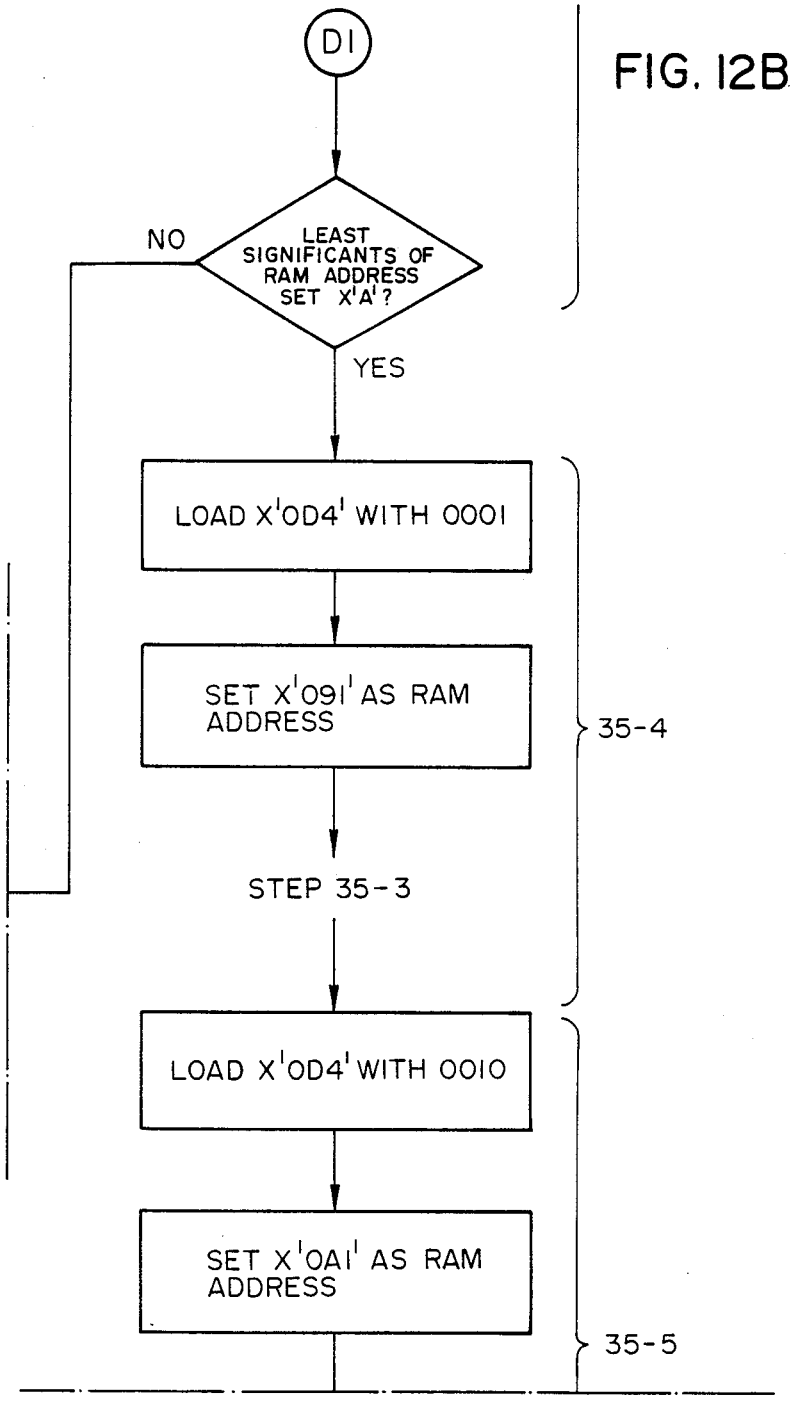
Figure 12C:
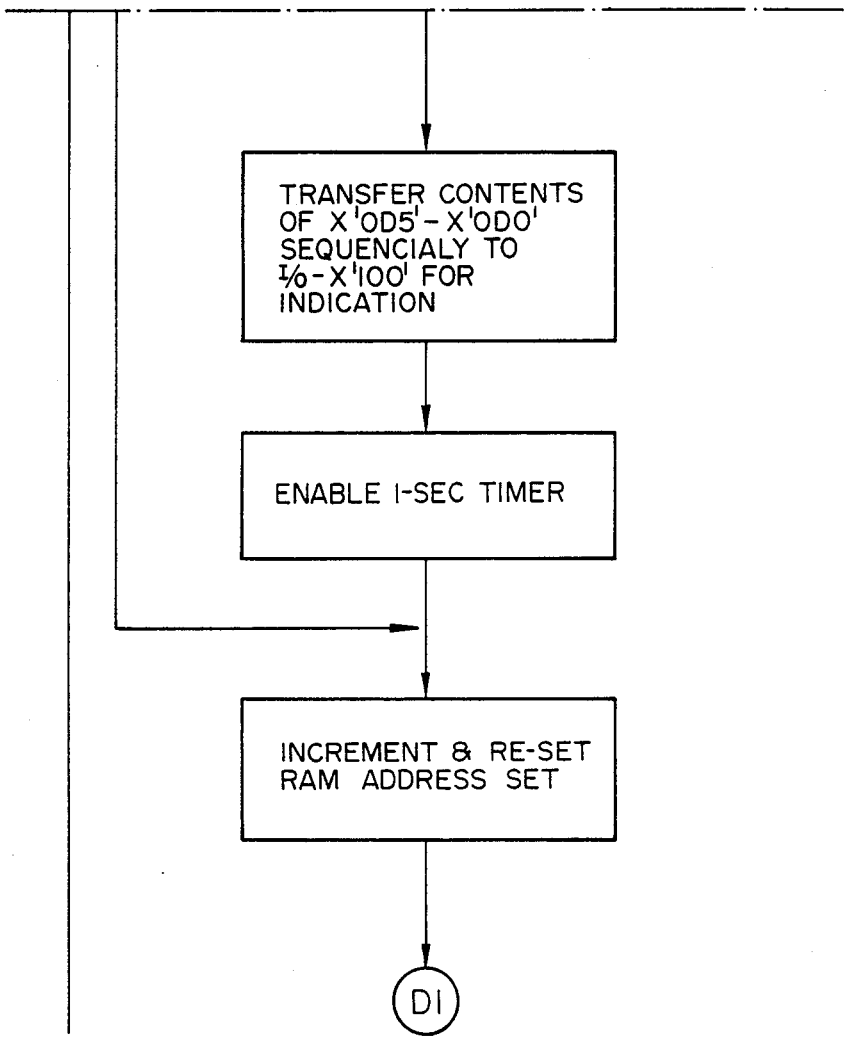
Figure 12D:
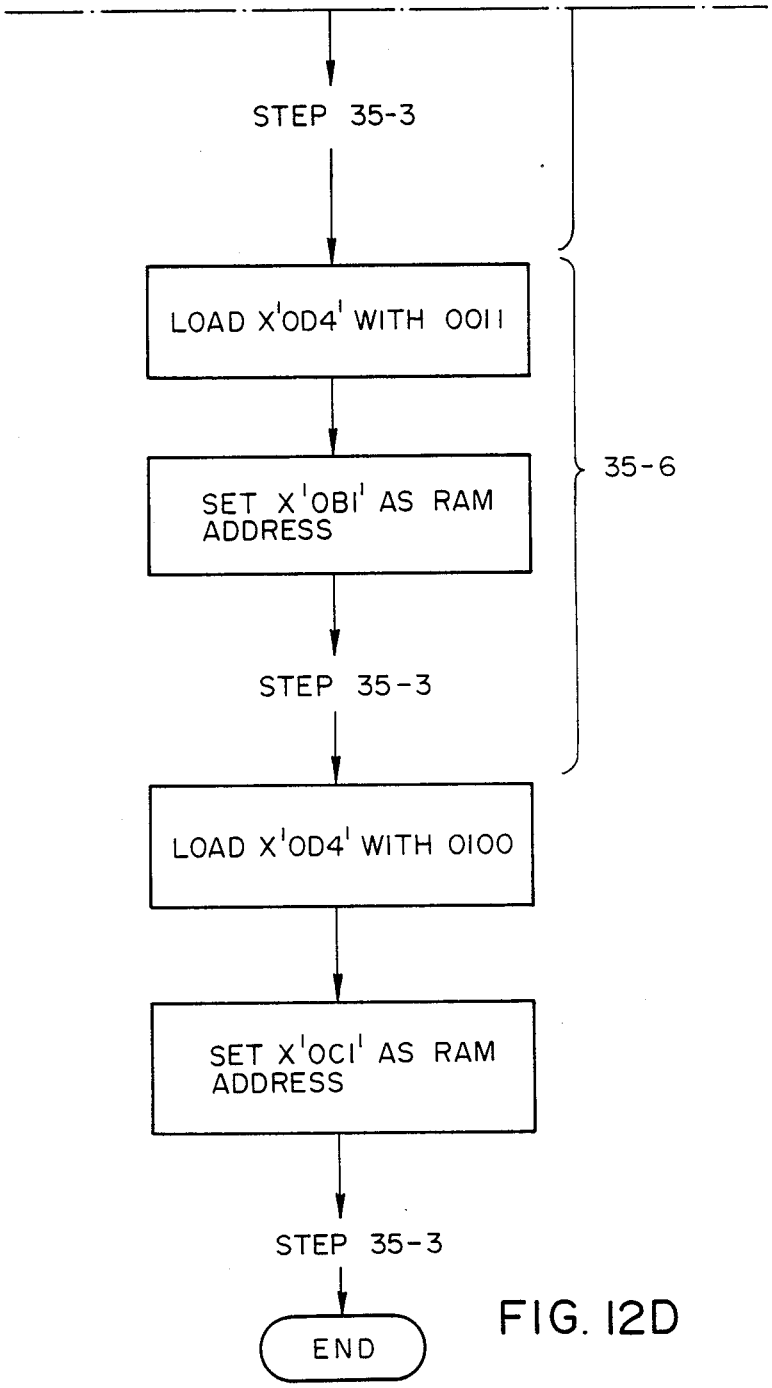
Figure 13A:
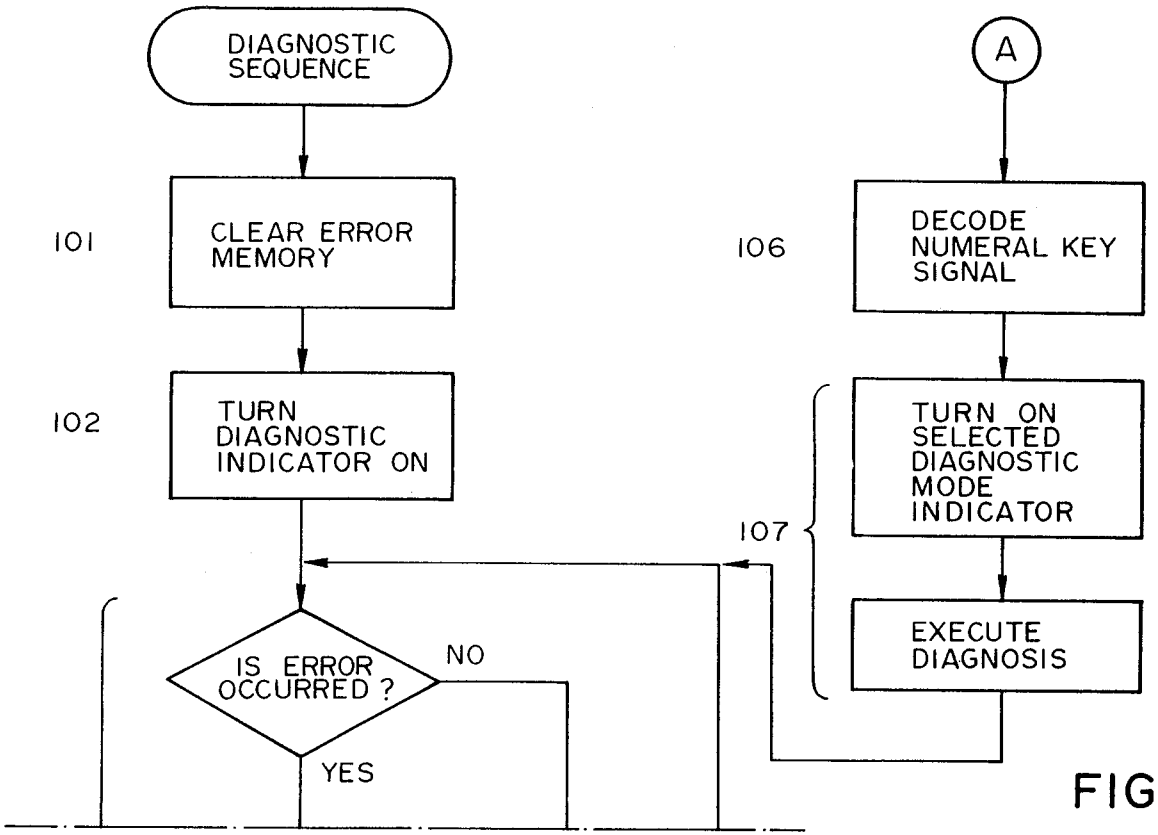
Figure 13B:
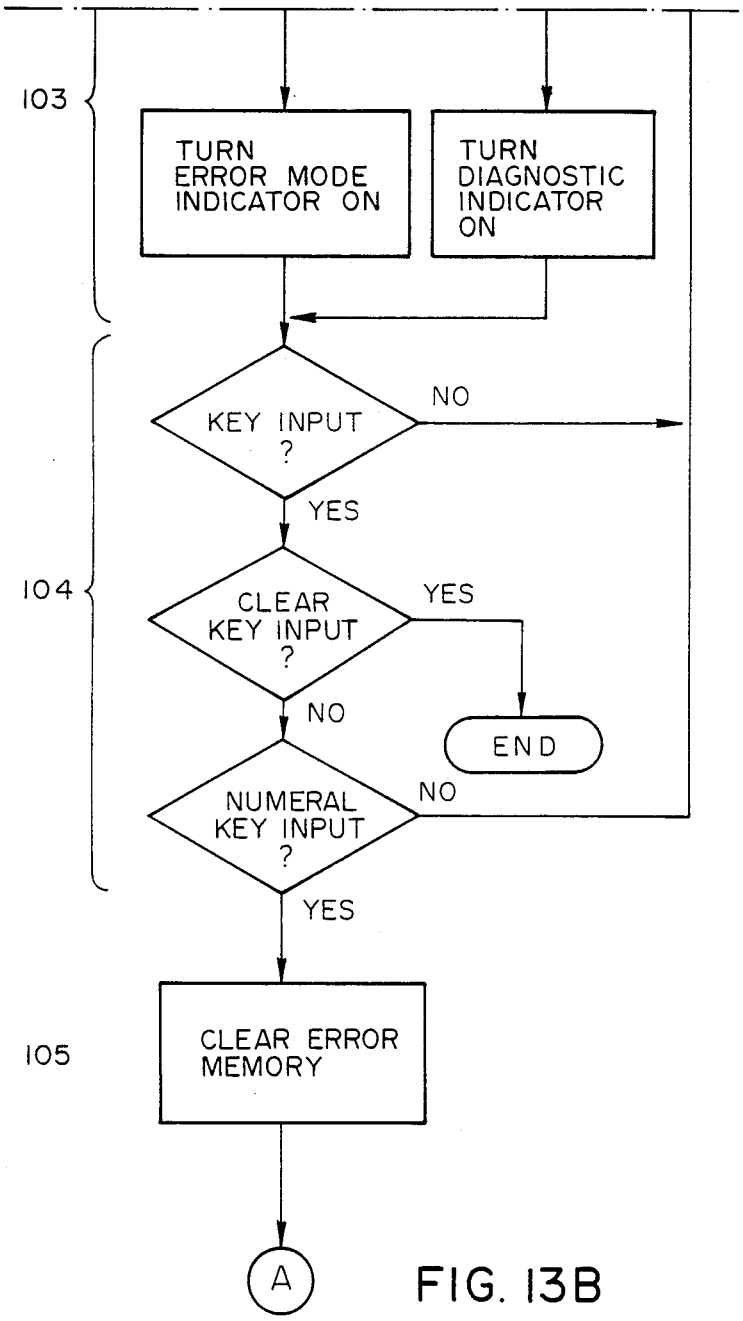

This routine corresponds to those shown in FIGS. 11-1A through 12D with the exception of Steps 11-5 to 11-7. The purpose of this routine is to set data at the area of RAM corresponding to the sensor at which the paper remains, and to scan the area and indicate it during the time the error flag being set.

When the paper is removed, it is allowed to key in as in Step 6 shown in FIG. 5-1 (Step 36). By keying on the copy key, the number of completed copies is compared with the set number at Step 21-4 and copying operation is restarted to complete the remaining number of copies. When the clear key is keyed on without keying on the copy key, the step is advanced to Step 20 where standby is set and keyed-in data can be stored in RAM. Thus, it is allowed to cancel the previously stored data such as data of reduction and numeric data and instead to set new data. However, change of data and automatic reset of data of process mode are impossible until the clear key is keyed on in the state of SW being on. When SW is turned off, the step is returned to Step STAT and RAM is cleared for waiting. In this manner, jam resetting after occurrence of a jam does not make many previously selected special image forming modes cleared. Rather, all of such modes are held as they were. Therefore, it is no longer necessary to reset the various conditions in a time consuming manner.

Diagnostic Sequence 2

Figures 1D, 5:
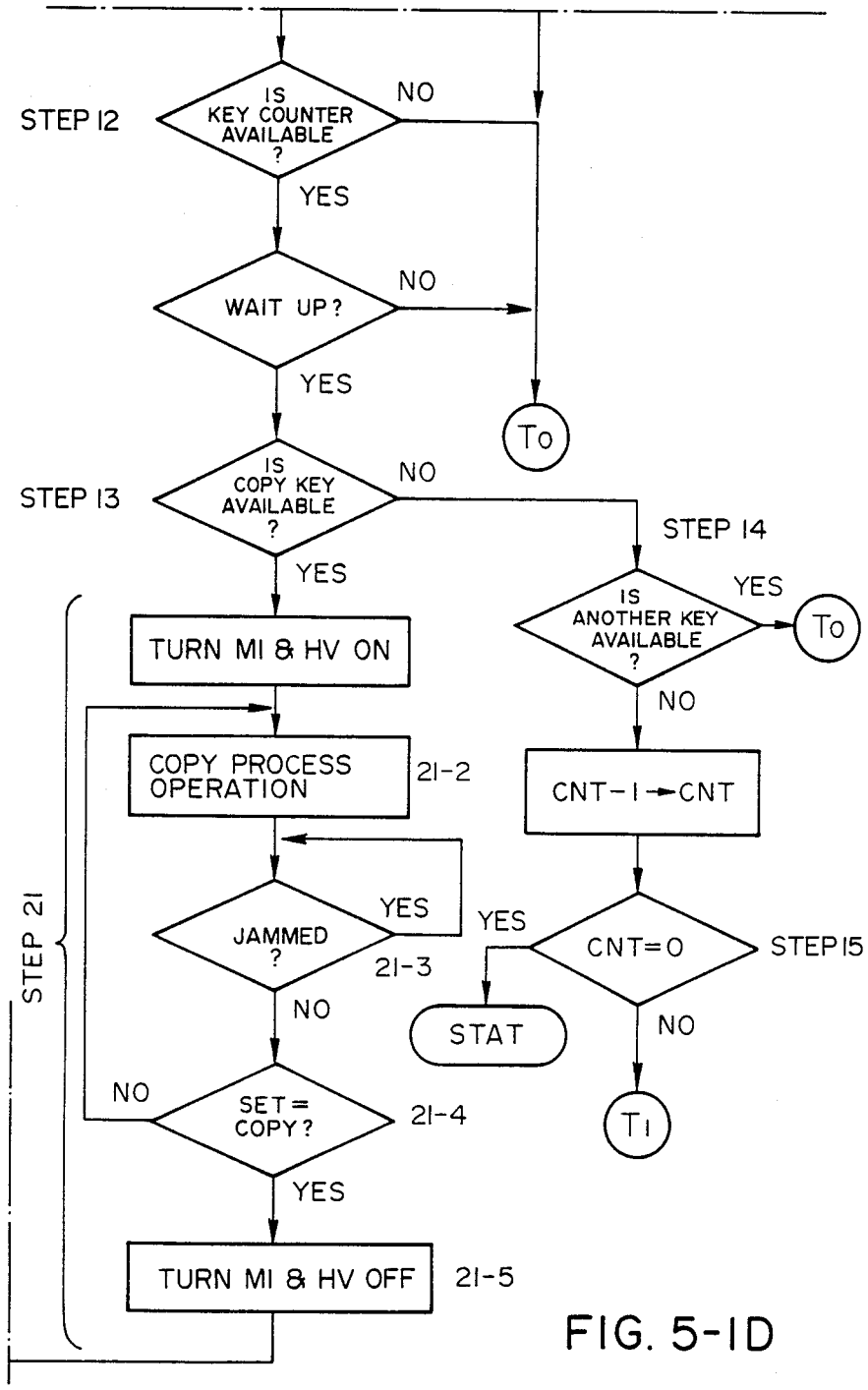
Figures 2, 5:
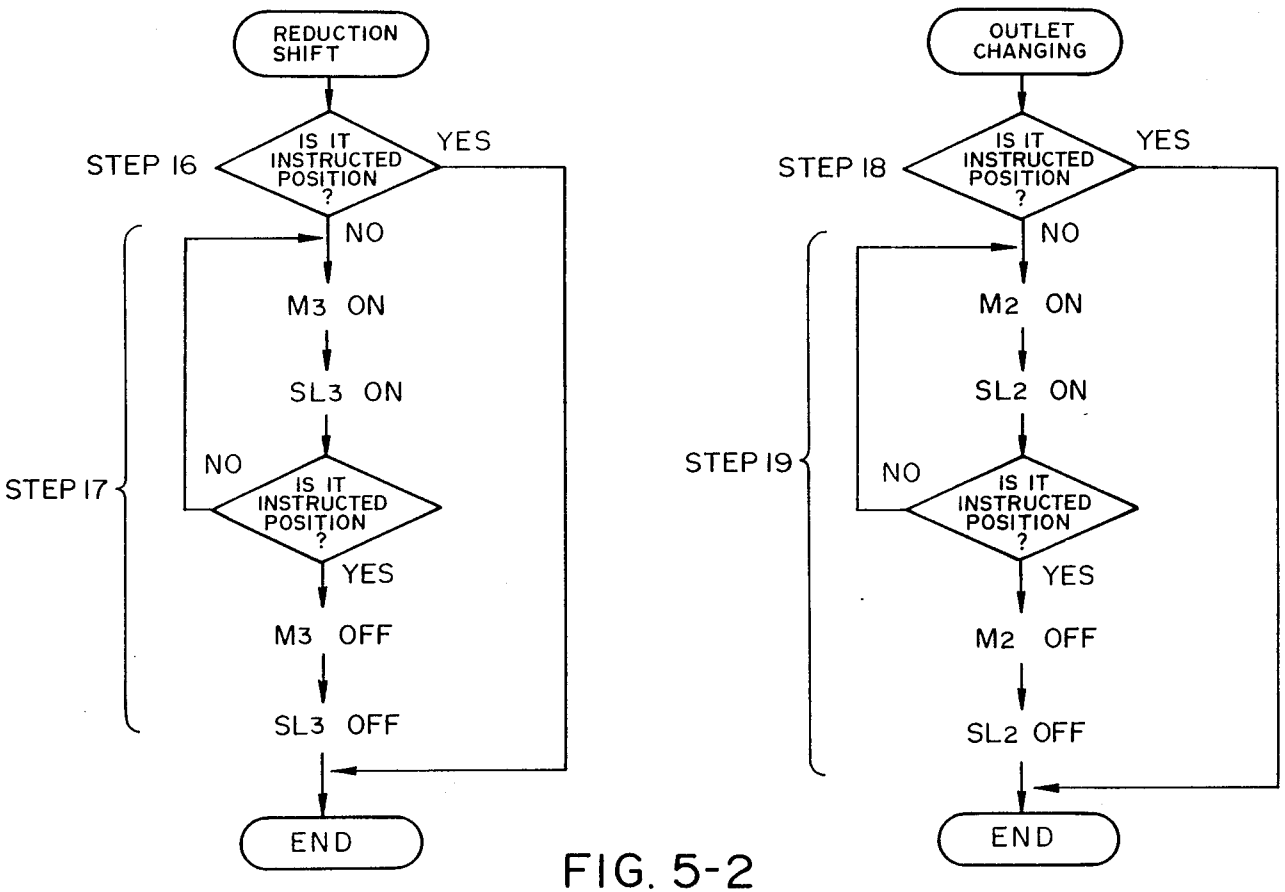
Figures 1A, 11:
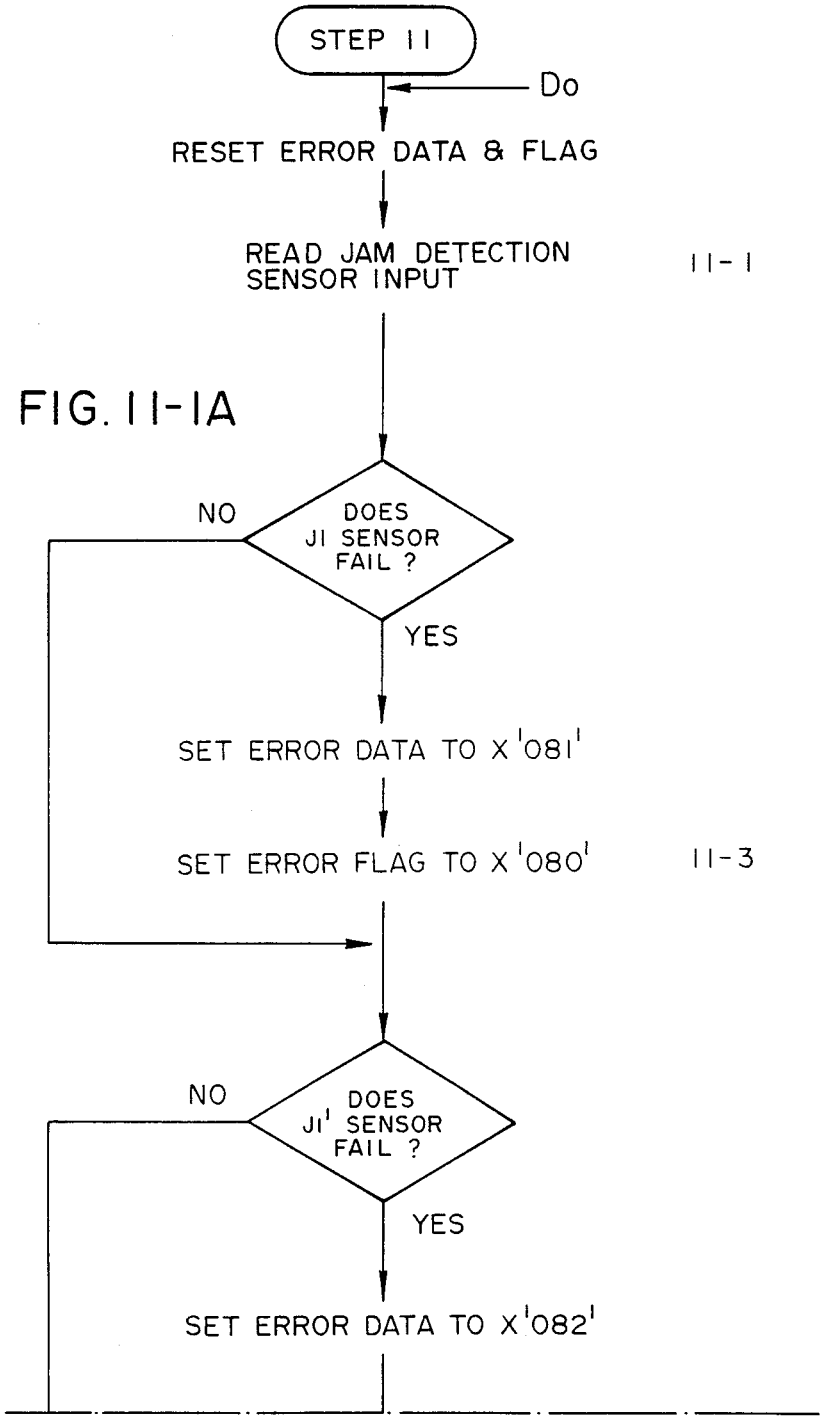
Figures 1B, 11:
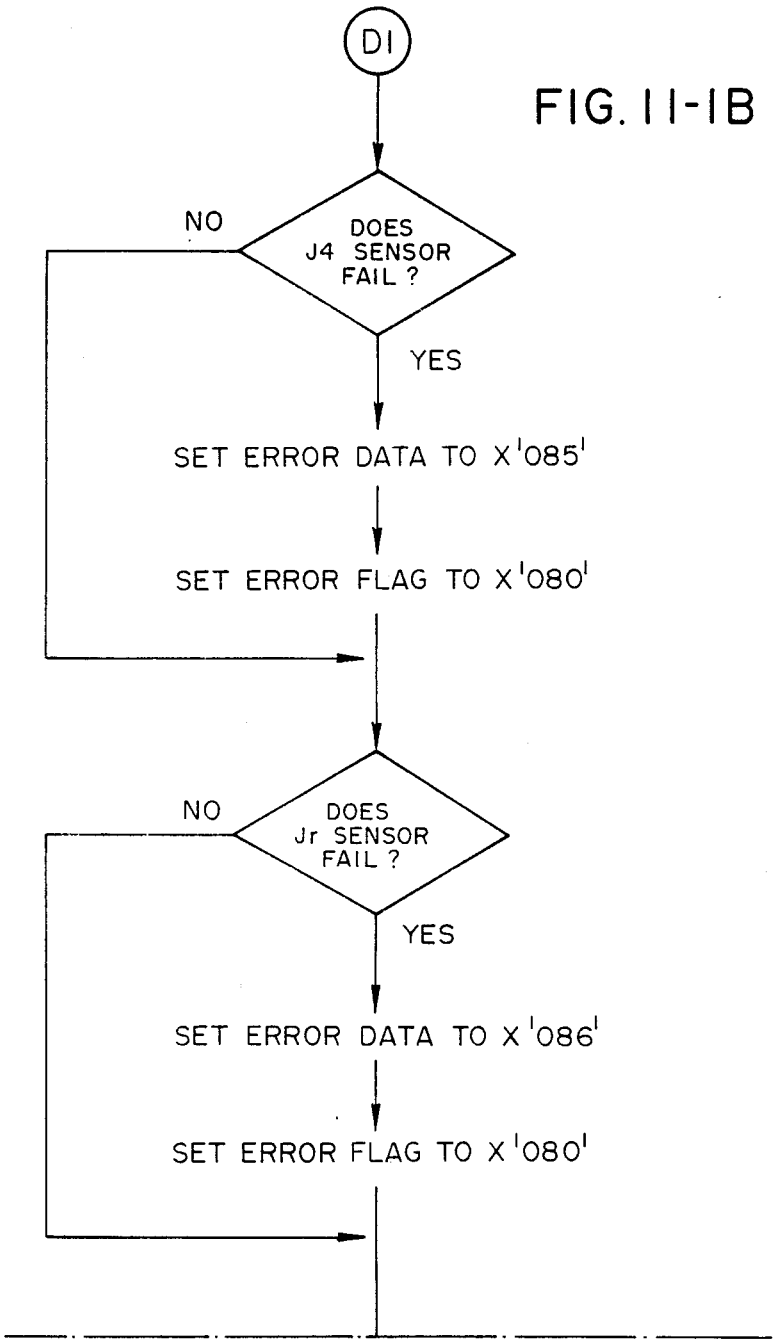
Figures 1C, 11:
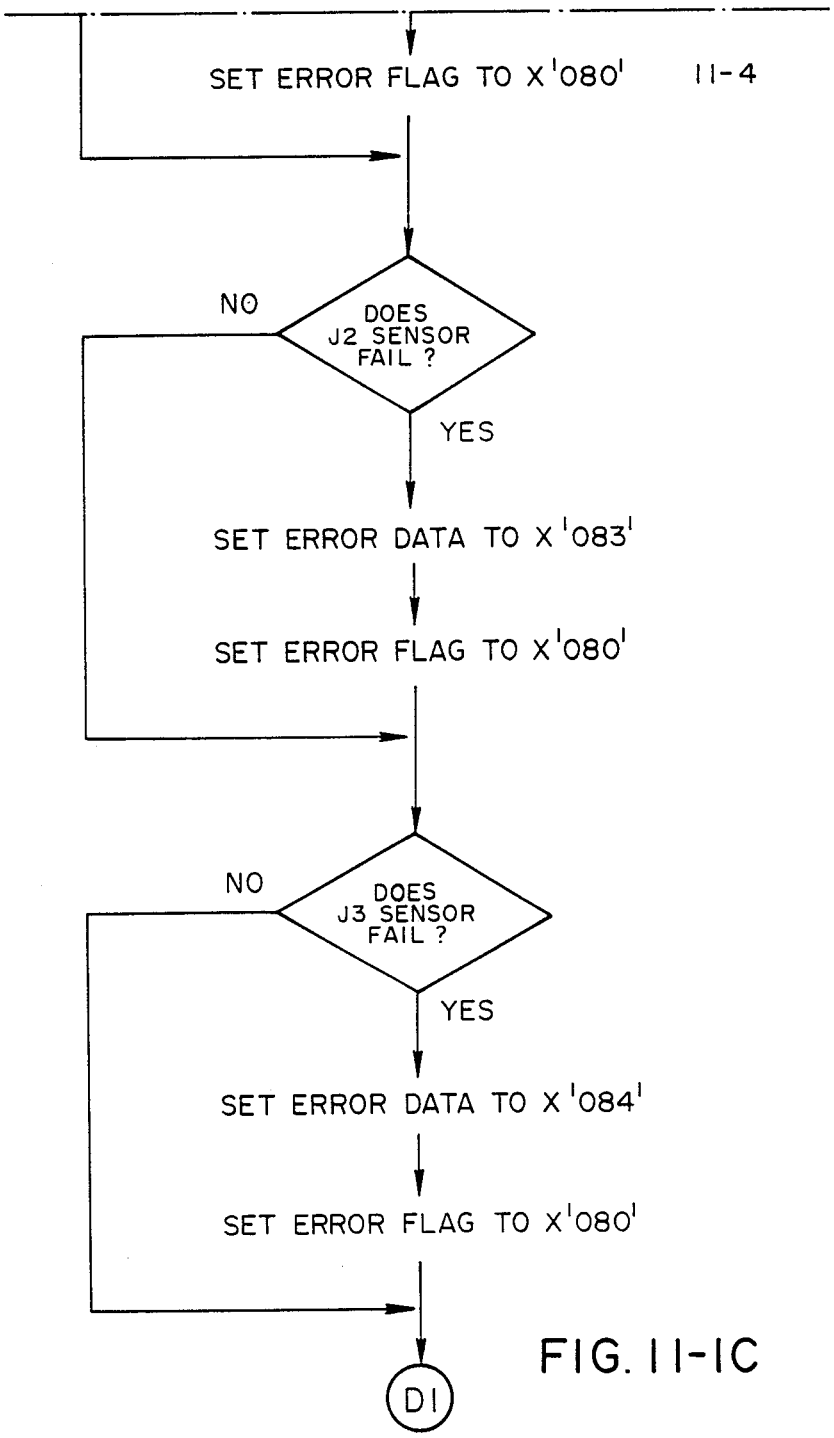
Figures 1D, 11:
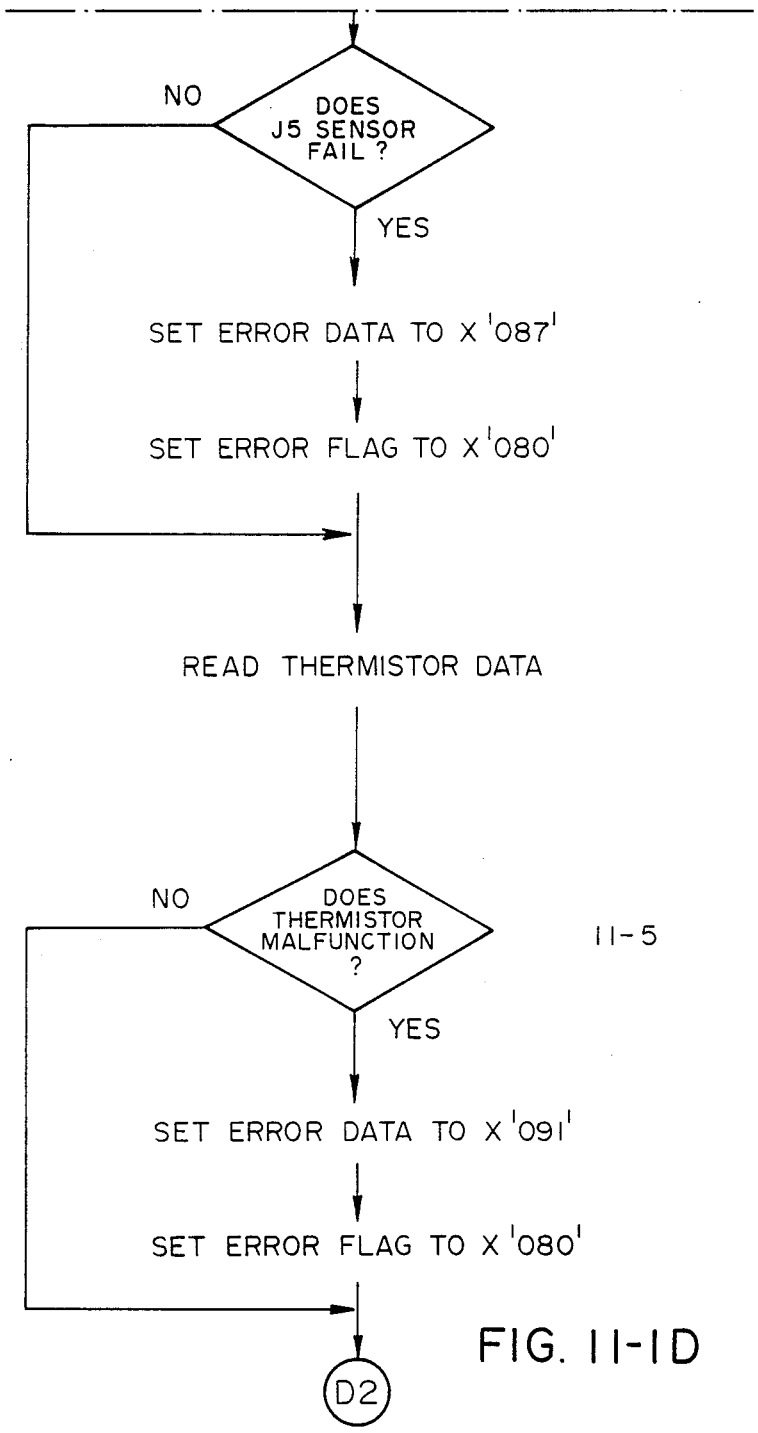
Figures 2A, 11:
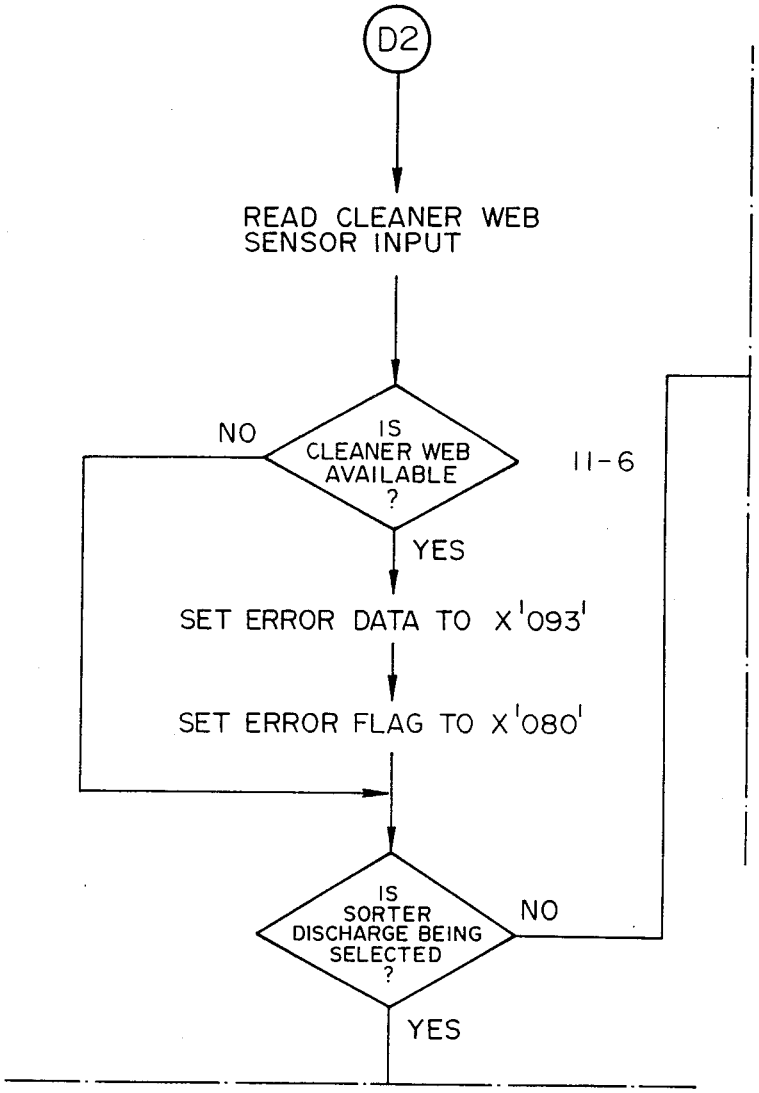
Figures 2B, 11:
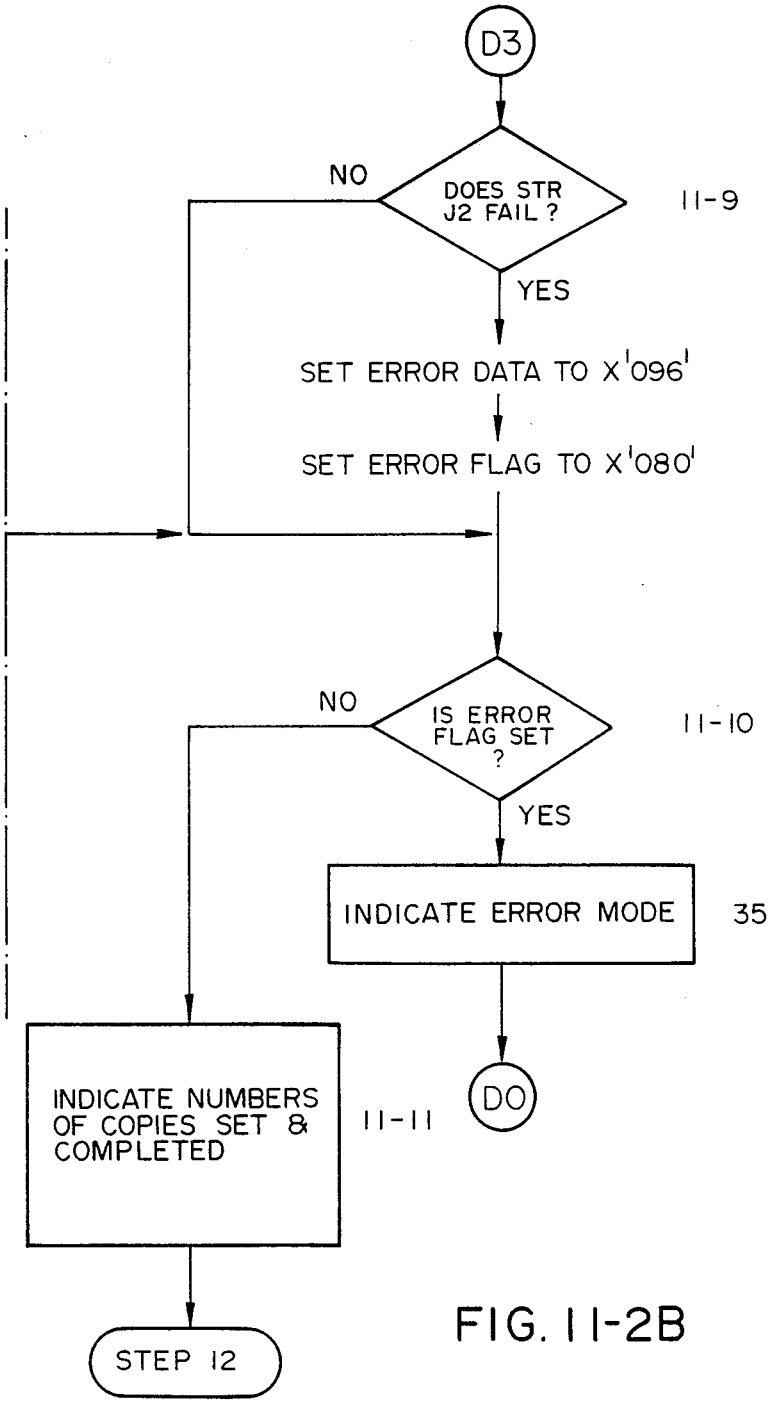
Figures 2C, 11:
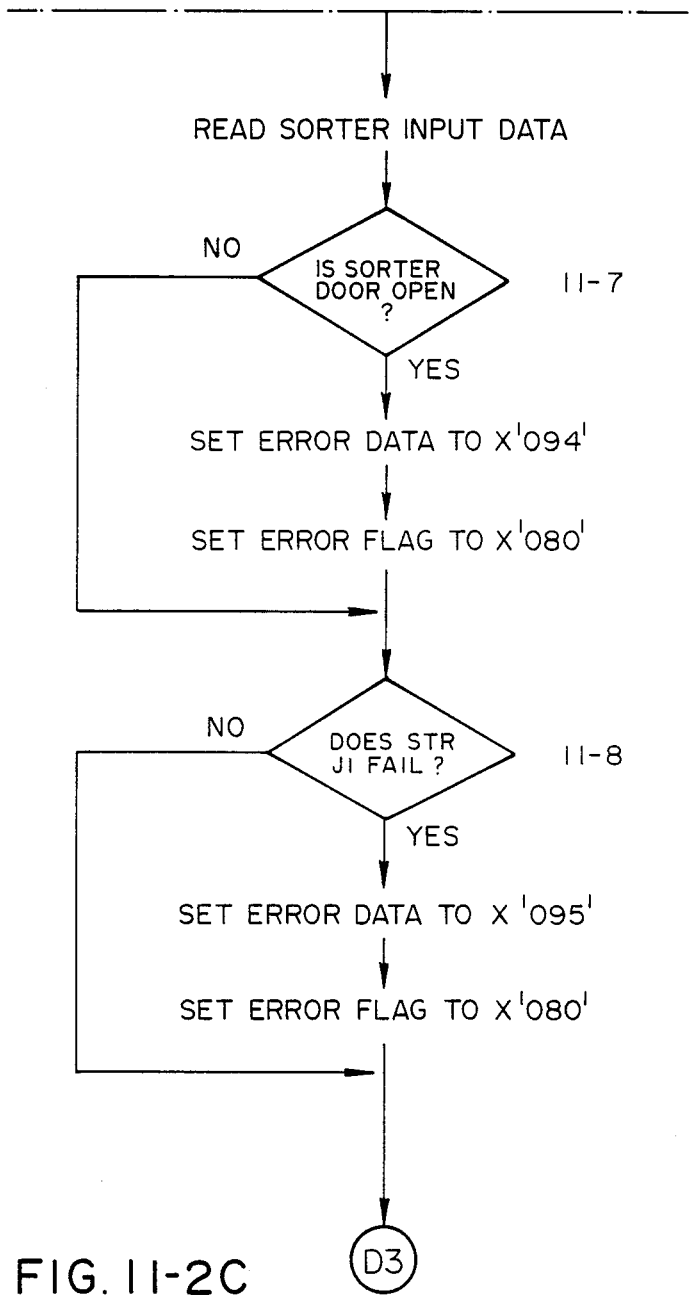

FIGS. 11-1A through 11-2C show a diagnostic sequence to be interposed between Steps 11 and 12 shown in FIGS. 5-1A through 5-1D. The diagnostic sequence is provided to check and indicate the result of the check in the following respects:

Whether any paper remains in the area of any of the above mentioned sensors along the paper path after throwing in the power source switch SW; whether there is any wire breaking in the thermistor for controlling the temperature of fixing device; whether the side plate of the sorter is closed and the like.

This makes it possible to start a copying operation only after those locations have been checked which are normally not checked particularly. By carrying out checking on these locations, troubles which otherwise may occur can be prevented to a great extent. Since the above mentioned check points include such location or part which is never used for ordinary copying operation, even when any error is found in such location, copying operation can be carried out without removing a cause for the error.

Referring to FIGS. 11-1A through 11-2D, the above-mentioned paper sensors 62–67 are scanned and sensed to store the data of each sensor in a register at Step 11-1. At first, it is checked whether there is paper at the sensor 62. When yes, the data is set at X 081 of RAM and an error flag is set at X 080 (11-3). Then, a similar checking is carried out at the sensor 62' (11-4). Similarly, checks are made also as to the sensors 63 to 65. Further, at the tray's side discharge detection sensor 66 and the sorter's side discharge detection sensor 67 the same check is made and, when yes, error data and error flag are set. Then, an operational amplifier $OP_1$ (FIG. 4-11) is checked. When any wire breaking is found in its thermistor, an output of 1 is issued (11-5). If 1 is issued, then the data is set at X091 of RAM and the error flag is set to X 080. Similarly, check is carried out on the sensor **73*b* for detecting the cleaner web at the cleaning section. When it is detected that no cleaner web is available, the data is stored in RAM and error flag is set (11-6). Also, in case that the sorter is selected as outlet, it is checked whether the sorter's side door plate is opened by in response to the disabling of the door switch 74 (11-7). Thereafter, the jam detection sensor 68 provided at the sorter inlet and the sensor 69 provided at the sorter dish are sensed to check whether there are papers and the result is stored in RAM (11-9**).

At Step 11-10, check is made as to whether the error flag is set in RAM. When yes, the error mode is indicated on the segment indicators 23-1 and 23-2 in the manner previously described. This step is essentially the same as Step 35 shown in FIGS. 10A and 10B and will be described in detail later. Thereafter, the above routine is repeated. When no error flag is set or when the error flag is removed by removing the paper on the sensor, the segment indicators 23-1 and 23-2 indicate the numbers of copies set and completed respectively which have been stored in SET and COPY areas of RAM. Then, step goes to Step 12.

The above-mentioned cleaner web is indicated by 72 in FIG. 1. The web 72 is used to effect pre-cleaning of the dielectric drum 7 and is wound up in the direction of arrow. Web end is sensed by the sensor 73 which is a known optical sensor. The output of the sensor is introduced into $I_2$ of I/O 800. Numeral 74 denotes a microswitch which is turned on when the sorter's side door is completely closed. The side door is opened and closed when the papers received in the sorter are taken out from it. The output of the microswitch 74 is introduced into $I_3$ of I/O 800. The sensors 68 and 69 are also of the known type and detect papers jammed at the vicinity of sorter inlet and at every bins of the sorter inlet and at every bins of the sorter respectively. The output of the optical sensor 68 is introduced into $I_3$ of I/O 700 and that of 69 to $I_0$ of I/O 800. The paper detection sensors 62–67 for detecting jam along the path within the copying machine give their detection signals to $I_0$–$I_3$ of I/O 700, I/O 600 and the thermistor wire breaking detection signal is input to $I_3$ of I/O 500. As previously mentioned, the above sensor signals constitute conditions for error indication control.

Error Indication

The manner of operation for error mode indication is described with reference to FIGS. 12A through 12D.

The keys and display chips μPD 757 used in I/O 100 have a segment display relation to 4-bit hexadecimal code inputs as shown in the following table, Table III.

TABLE III

| | | | | | | | | | | |
|---|---|---|---|---|---|---|---|---|---|---|
| Code | 0 | 1 | 2 | 3 | 4 | 5 | 6 | 7 | 8 | 9 |
| 7 segment display | 0 | 1 | 2 | 3 | 4 | 5 | 6 | 7 | 8 | 9 |
| Code | X'A' | X'B' | X'C' | X'D' | X'E' | X'F' | | | | |
| 7 segment display | E | F | L | P | — | blank | | | | |

The relation between error contents and segment indications is that when paper remains at the sensors 62 and 62' at a jam time there are displayed F-P and E 1 on the indicators 23-1 and 23-2, respectively. F on the indicator 23-1 means that diagnostic program is now in execution and P means a diagnostic mode, that is, in this case a jam time. When the diagnostic mode is in stand-by, is displayed. E at the left side on the indicator 23-2 means a detection of malfunction and is an error symbol. Digit 1 at the right side of the indicator indicates the location of the malfunction. The indicators 23-1 and 23-2 show the above symbols at the same time. For troubles detected by the paper detection sensors 62–69, symbols E-1 to E-8 are displayed respectively. Similarly, E-9, E-10 and E-11 correspond to the web check sensor 73, sorter switch 74 and thermistor wire breaking check sensor respectively.

In a case wherein malfunctions take place at two or more different locations at the time of jam or stand-by, error indication is made in the following manner:

For example, it is assumed that the sensor 63 detects paper and also the sensor 73 detects the absence of cleaner web at the time of stand-by. In this case, the indicator 23-1 shows F-0 and the indicator 23-2 shows alternately E-2 and E-9.

The above operation is described in detail in respect of RAM with reference to FIGS. 7 and 12. For error indication CPU carries out the following processing steps:

At Step 35-1, hexadecimal code XA (BCD 1010) is set to address $X_0D_3$ of RAM. This becomes E as 7 segment display when decoded by I/O-X 100. This output (indication), when issued, means that an error is found in diagnosis.

At Step 35-2, hexadecimal code XF (BCD 1111) is set to $X_0D_4$. This code is decoded by Key & Display I/O-X 100 and becomes a blank. Then, X 081 is set as RAM address and step is advanced to 35-3.

At Step 35-3, when the content of RAM address set at the previous step is 0, an increment of 1 is given to the instructed RAM address after jumping to Do. For example, 1 is added to X 081 to make X 082. Step 35-3 is repeated until to least 4-bit significants become hexadecimal XA(BCD1010).

If the instructed Ram address has a set significant other than 0, the address' least significant, that is, for example, 2 in the case of the address being X 082, is set to $X_0D_5$. And the contents of $X_0D_5$-$X_0D_0$ are transferred sequentially to I/O-X 100 for indication. After holding the indication for about a second, the flow enters Do and thereafter the above procedure is repeated until the least significants of the RAM address set become XA(BC1010). In other words, as indications in Steps 35-2 and 35-3, error modes set to the addresses from X 081 to X 089 are sequentially indicated at intervals of a second. For example, when paper is at the sensor 62 in the stand-by diagnostic mode, the indication data are to be F, —, 0, E, blank, 1 in accordance with the figure switching-over timing signals $T_0$, $T_2$, $T_3$, $T_4$, $T_5$ of I/O 100.

At Steps 35-4 to 35-6, like at Step 35-2, error mode data set from RAM address X 090 to X 099, from $X_{0A0}$ to $X_{0A9}$, from $X_{0B0}$ to $X_{0B9}$ and from $X_{0C0}$ to $X_{0C9}$ are sequentially indicated at intervals of a second.

At $X_{0A1}$ to $X_{0C9}$ there are stored the diagnostic data in the later described key diagnostic mode. Scanning and indication of the data are carried out at the time of the next key diagnostic mode.

In this manner, indications of diagnostic operations and indications of errors detected by the diagnosis can be made making use of indicators such as segment indicators which are normally used for another purposes of indication. This makes it possible to indicate the stage of the operation to which the diagnosis now being in operation belongs and the result of the diagnosis with the minimum number of indicators. Therefore, the apparatus operation part is very simple in structure.

Diagnostic Sequence 3

Under the condition of a normal stand-by, the numeral keys 22 are used to set the number of copies to be made and the clear key C is used to clear the set number or the like. Similarly, the indicators 23-1 and 23-2 are used to indicate the number of copies set and that of copies completed respectively. However, according to the present invention, there is provided a diagnostic step 100 between Steps 1 and 2 shown in FIGS. 5-1A through 5-1D. To this end, during the execution of diagnostic program the above mentioned keys and indicators serve as instruction switches and indicators having another functions.

When the power source switch SW is turned on, Step 1 is carried out in accordance with the stand-by program shown in FIGS. 5-1A through 5-1D. Following the Step 1 the diagnostic program 100 is executed. This diagnostic program can be carried out selectively by using diagnostic keys (not shown) if desired to do so.

Figure 13:
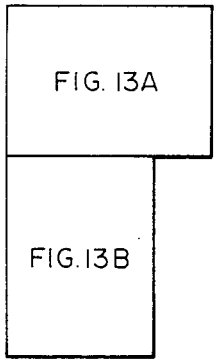
FIGS. 13A and 13B, when combined as shown in FIG. 13, and FIGS. 14-1, 14-2, 14-3 and 14-4A through 14-4F, when combined as shown in FIG. 14-4 are control flow charts for diagnostic operations.

As shown in FIG. 13, the diagnostic sequence begins with Step 101 at which error memory is cleared. This makes the RAM addresses (FIG. 7-1, B) X'080'-X'089', X'090'-X'099', X'0A0'-X'0A9', X'0B0'-X'0B9', X'0C0'-X'0C9' loaded with 0000 (hereinafter referred to as 0 for the sake of simplicity). Further, diagnostic mode storing and indicating memory addresses X'0D0'-X'0D5' are cleared and loaded with 0.

At Step 102, the start of diagnostic sequence is indicated. This makes at first X'0D0', X'0D1' and X'0D2' loaded with hexadecimal X'B' (which is 1011 in terms of binary decimal code BCD), X'E' (1110) and X'F' (1111) respectively. Then, 8 (1000) is set to X'0D3', X'0D4' amd X'0D5'. Thereafter, X'0D5'-X'0D0' are transferred to Key and Display I/O-X' 100' from CPU sequentially in this order. Port I/O-X'100' decodes each 4 bits of the input data and makes the indicators 23-1 and 23-2 indicate the following in accordance with the above codes:

On the indicator 23-1, F, —, blank and on the indicator 23-2, ⊟, ⊟,⊟ with the timing $T_0$, $T_1$, $T_2$, $T_3$, $T_4$, $T_5$.

F at timing To means the start of execution of the diagnostic program. Since selection of diagnostic mode has not been made yet at Step 102, indication at timing $T_2$ is blank, that is, no indication. For timings $T_3$–$T_5$ indication must properly be made as to the results of diagnosis. But, at the stage of Step 102 provisionally ⊟, ⊟, ⊟ that is, no error are indicated with timing of $T_3$, $T_4$and $T_5$.

At Step 103, it is checked whether any error is occurred by reading whether error flag is set. When yes, error mode is indicated because a numerical figure other than 0 (no error when 0) is set at RAM address X'080' as described later However, at the first execution of this routine, since X'080' is 0, no such indication is made and instead X'0D5' to X'0D0' are indicated like in Step 102, and step jumps to 104.

At Step 104, if there is no input data to Key & Display I/O-X' 100', namely no key input by key 22, CPU returns to Step 103 and repeats Step 104. When key input is received, CPU decodes the content of the key data and when the key is clear key C, it terminates the diagnostic sequence. Step jumps to END and returns to the step of POWER ON of the above mentioned stand-by sequence (FIGS. 5-1A through 5-1D).

When the key is any one of 0 to 9 of the numeral keys 22, step is advanced to the next step, Step 105 to select the desired diagnostic mode. when the key is not numeral key 22 but another selection key such as cassette selection key, step is returned back to 103 and Step 104 is carried out again. Thus, above indication is continued until input from numeral key of clear key comes in.

When an input is keyed in by numeral key 22, like in Step 101, the memory addresses in RAM are cleared at Step 105.

At Step 106, the signal of the input numerical key is decoded and the decoded signal is set to X'0D2' of RAM. For example, when key of 1 is keyed on, the signal is set to X'0D2' and 0 is to X'0D3'-X'0D5'.

At Step 107, X'0D5' to X'0D0' are transferred to Key and Display I/O-X'100' sequentially in this order to make the indicators 23-1 and 23-2 display the following indication symbols:

At the timings of $T_0$, $T_1$, $T_2$, $T_3$, $T_4$, $T_5$, symbols F, —, 1 on the indicator 23-1 and □, □, □ on the indicator 23-2.

At $T_2$ there is an indication showing the diagnostic mode selected by the operator (in the shown case, diagnosis on motor) and □ at $T_3$, $T_4$and $T_5$ indicates that the selected diagnosis is now in execution.

A detailed description of various diagnostic modes and the manner of control thereof will be made hereinafter.

Mode Indication F-L

This is a diagnostic mode for carrying out checking all indicators by the operator's eyes. This diagnostic mode is carried out by checking whether 0 is set to RAM X'0D2'.

All indications of display part (FIG. 2) are lighted on and the operator visually checks every indicator to examine whether there is any breaking or deterioration. To this end, all the indicator outputs of I/O shown in FIGS. 4-1 to 4-12 are turned on.

Mode Indication F-1

This mode is carried out by checking whether 1 is set to X'0D2'. It is automatically checked in this diagnostic mode whether there is any trouble in any motor in the machine. As an example, FIG. 14-1 shows the flow chart of diagnostic sequence on the main motor $M_1$.

At first $M_1$ is turned off by putting 0000 in X'B00. After a certain timer delay, 4 bits of X'500' are put in. Checking whether $I_0$ of X'500' is 1 or 0, X'0B1' and X'080' are loaded with 1 when $I_0$ is 1. And address data error flag of $M_1$ is set. To X'B00' is put out 0001 to turn $M_1$ on. After a certain timer delay, 4 bits of X'500' are put in. When $I_0$ of X'500' is 0, it loads X'0B1' and X'080' with 1 to turn $M_1$ off. Following the diagnosis on the main motor, diagnosis on optical system motor $M_3$ and outlet motor $M_2$ is excuted in the same manner. If there is found any failure, the data is set and then error flag is set.

Figures 4, 14:
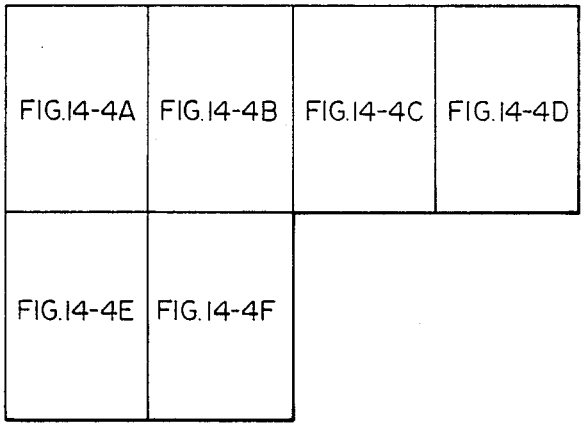

Diagnosis on every motor according to the flow chart shown in FIG. 14-1 is performed using circuit A of the output part of I/O shown in FIG. 4-11.

When the main motor M1 is off, triac TA for a motor switch remains off and the output of photocoupler phc connected to both terminals of TA is 0 of logic level. However, if TA and its trigger circuit remain always on due to any trouble, then the output signal of phc is 1. By reading this signal in a program step as describes above, the malfunction can be found out. In case that TA does not become on when $M_1$ is on, the output signal of photocoupler which must be correctly 1 becomes 0. Therefore, in this case also the malfunction can be detected similarly. In this manner, diagnosis is carried out for each of the motors $M_1$, $M_2$, $M_3$ and $M_4$ and for each of machine cooling fan motors $FM_1$, $FM_2$ and $FM_3$ using similar detection circuits provided therefor. In trouble, a value other than 0 is set to RAM address X'0B1'-X'0B9' corresponding to the motor in question and at the same time error flag (X'080') is set.

Mode Indication F- 2

This is a diagnostic mode for checking various high voltage transformers and is executed by using RAM data by turning on the numeral key of 2. The flow chart for this diagnostic mode is essentially the same as that for diagnosis on motor described above and can be obtained by substituting HVTA, —B, —C, —D, —F, —G . . . for $M_1$. On these high voltage transformers, diagnosis is executed one by one in a manner similar to above. As shown in the output part B of FIG. 4-11 circuit, the detection circuit issues a logic level 1 when high voltage output comes out from the high voltage output detection terminal of HV transformer. By reading the logic level error indication is made.

Mode Indication F- 3

This is a diagnostic mode for examining trouble in various jam detection sensors 62 to 69 and is carried out by reading 3 of X'0D2' set by the numeral key of 3. As an example, diagnosis on sensor 62 is described with reference to FIG. 14-2.

At first 4 bits of I/O port X' 600' is put in and check is made as to whether $I_0$ of X'600' is 1 or 0. When 1, X'081' and X'080' are loaded with 1 (0001). When the $I_0$ is 0 relay $K_1$ is turned on by putting out 1000 to X'500' to put lamp 62*a* on. After putting 4 bits of X'600' in, it is checked whether $I_0$ of X'600' is 1 or 0. When 0, X'081' and X'080' are loaded with 1. .As for other jam detection sensors the same diagnosis is executed and memory operates similarly.

Diagnosis on the jam detection sensor according to the flow chart shown in FIG. 14 -2 is performed using the circuit D of the input part shown in FIGS. 4-6 to 4-8. Normally, the lamp for illuminating CdS device is on and input to I/O is 0. If wire breaking is occurred in the lamp or jammed paper remains unremoved, then the input to I/O becomes 1 by which the trouble can be detected.

Breaking of CdS or trouble on the input interface part opposite to the above can be detected by carrying out checking in the opposite direction to the above. The CdS illuminating lamp is turned off and the relay $K_1$ on to terminate the irradiation of light to CdS. Then, reading of the input signal is effected in the opposite direction to the above. In any case, when the result of diagnosis reveals some trouble, 1 is set to address X'081'-X'089' of RAM and an error flag (X'080') is set at the same time.

Mode Indication F-4

This is a diagnostic mode on seven position sensors 44 to 50 (for positions of optical system, outlet etc.) by keying on of numeral key of 4. If any trouble is detected in any position detection sensor, then the corresponding RAM address of X'0A3' to X'0A9' is loaded with 1 and an error flag (X'080') is set.

Figures 1, 14:
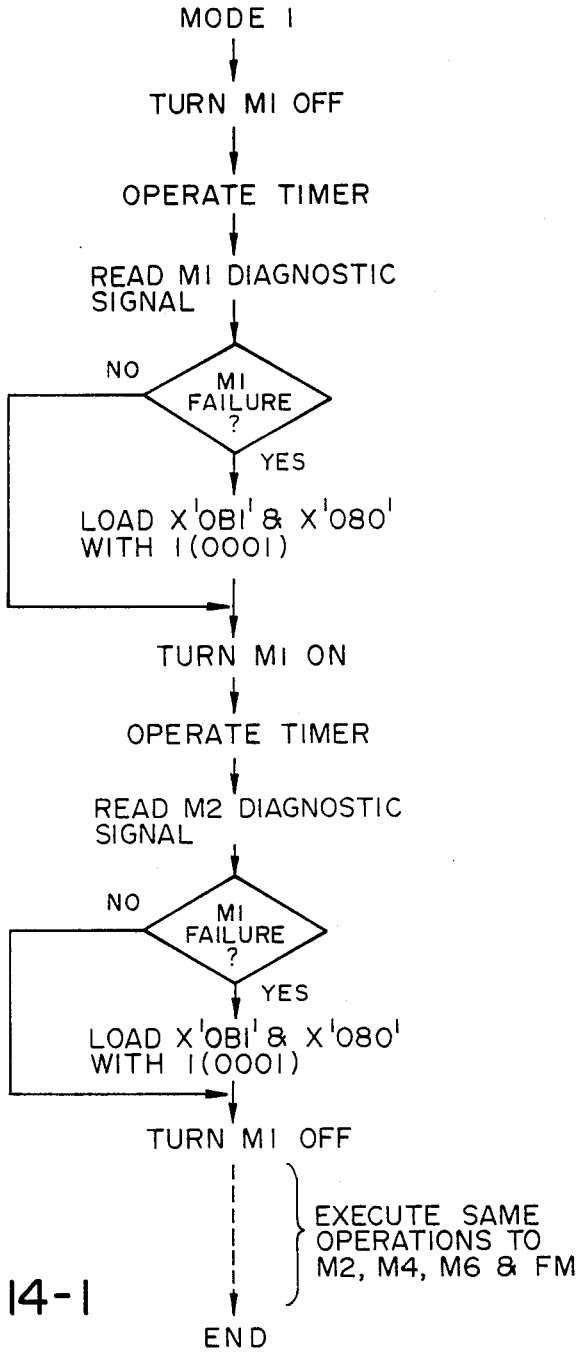
Figures 2, 14:
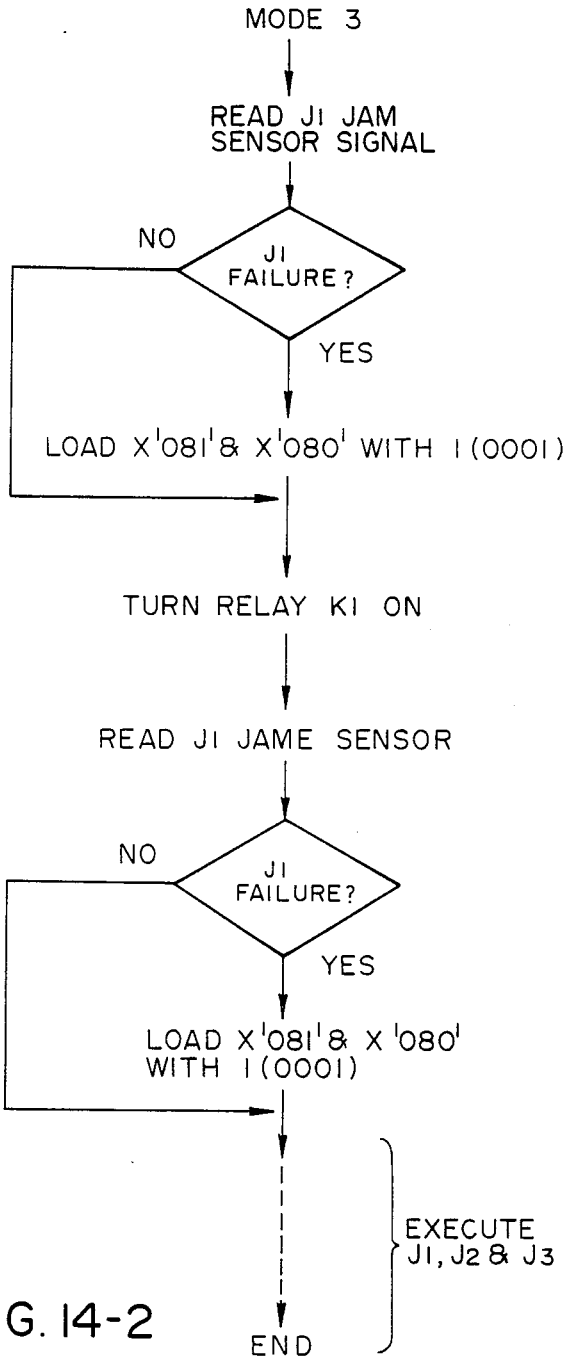
Figures 3, 14:
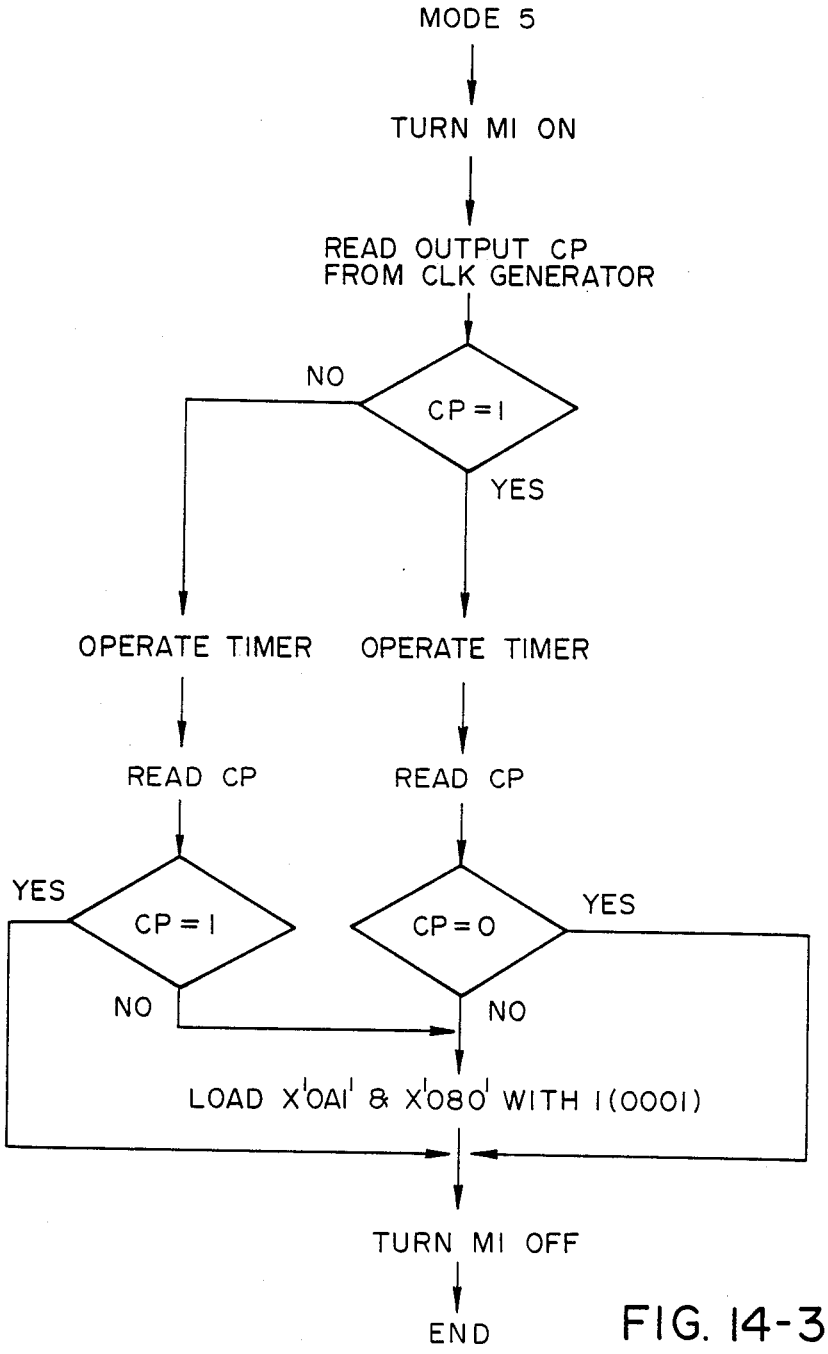
Figures 4A, 14:
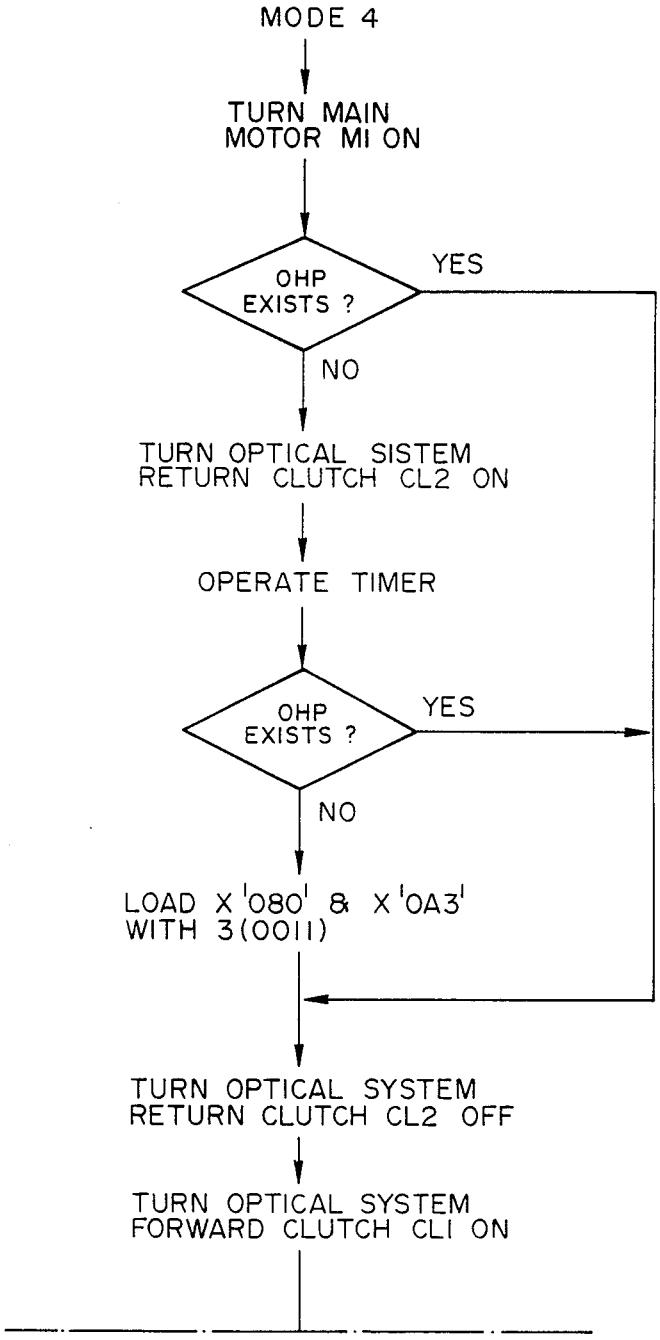
Figures 4B, 14:
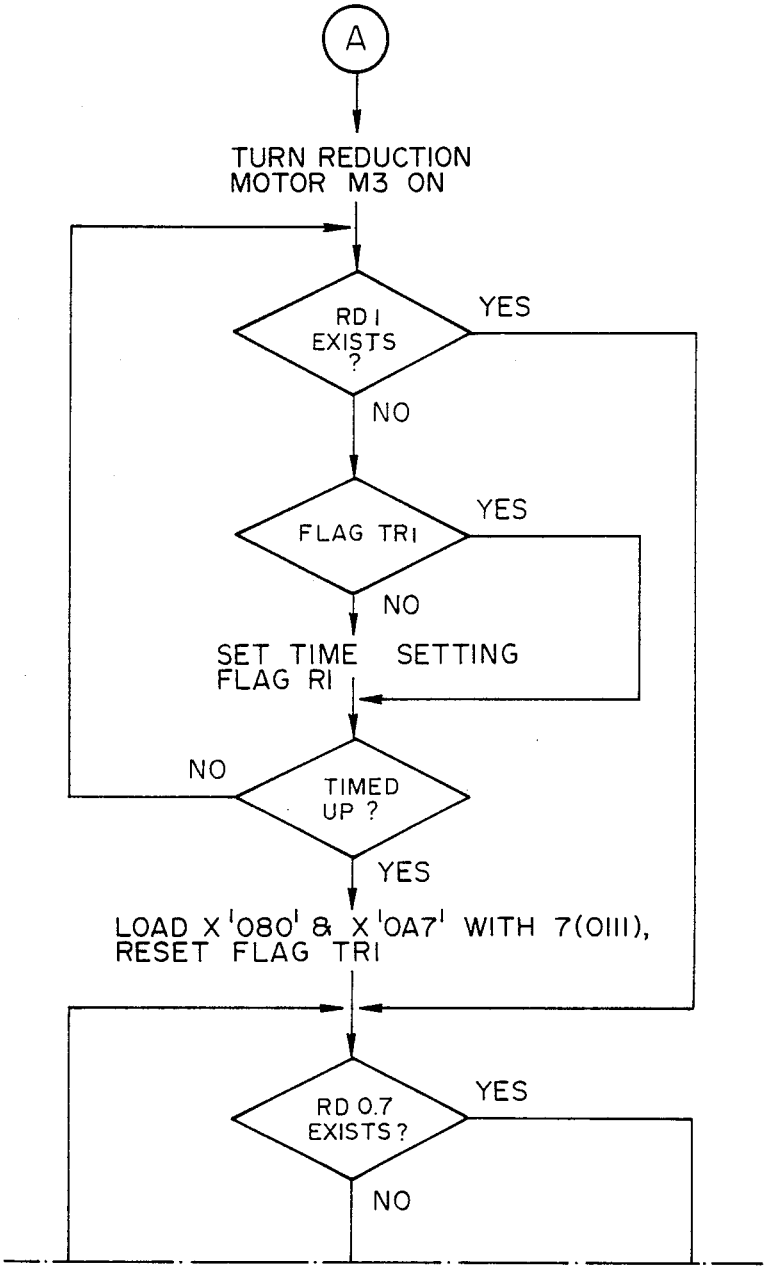
Figures 4C, 14:
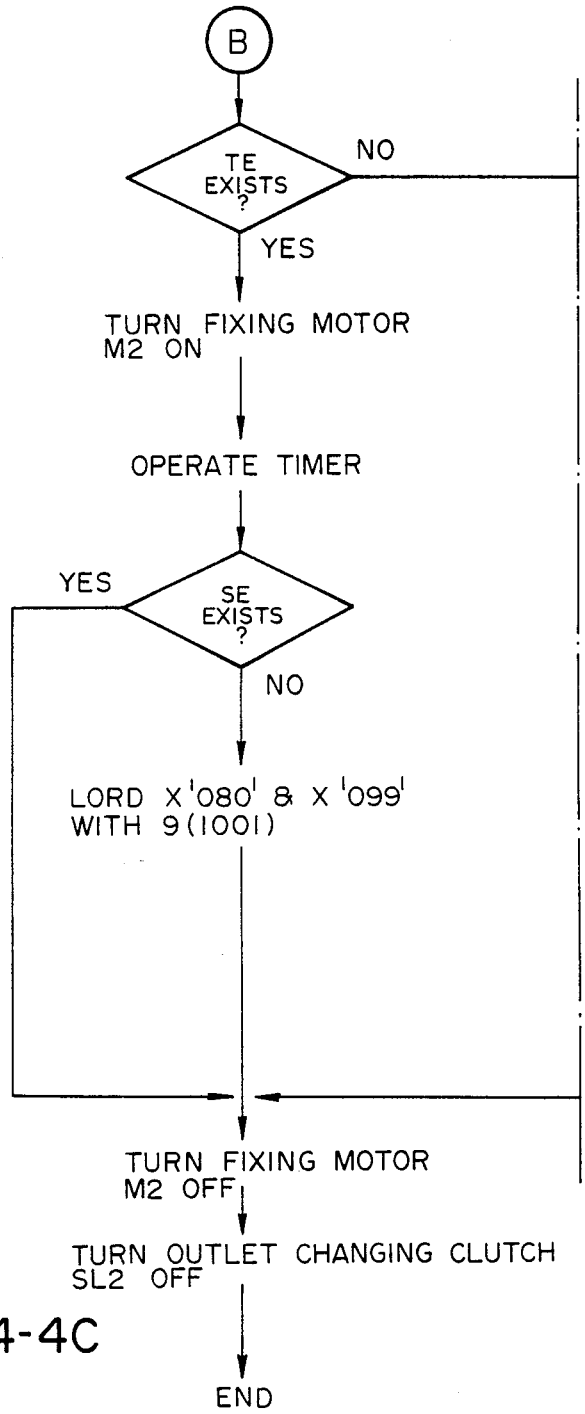
Figures 4D, 14:
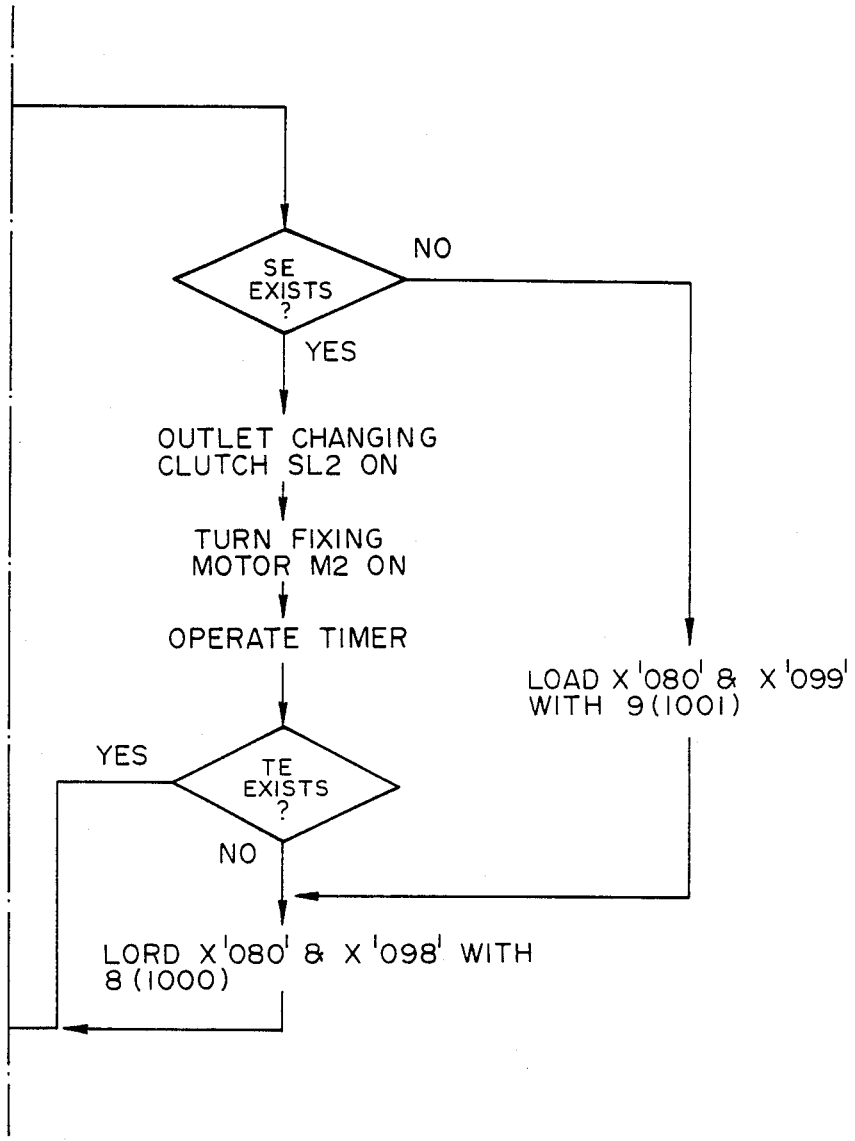
Figures 4E, 14:
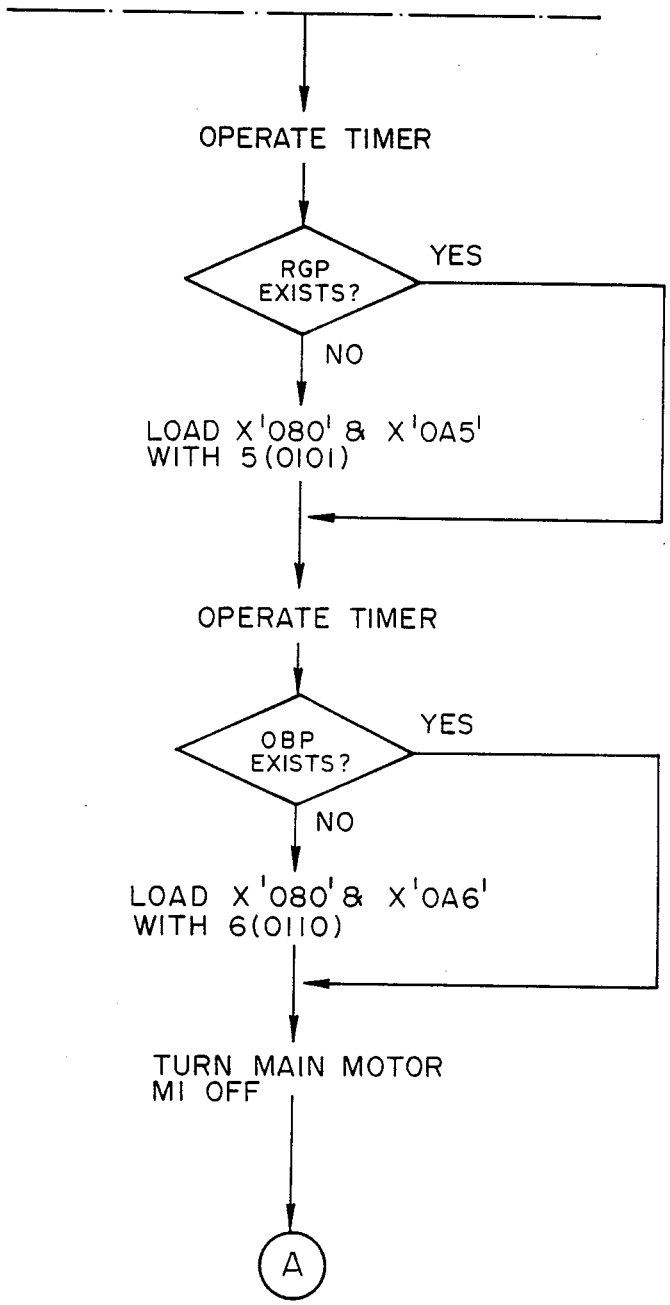
Figures 4F, 14:
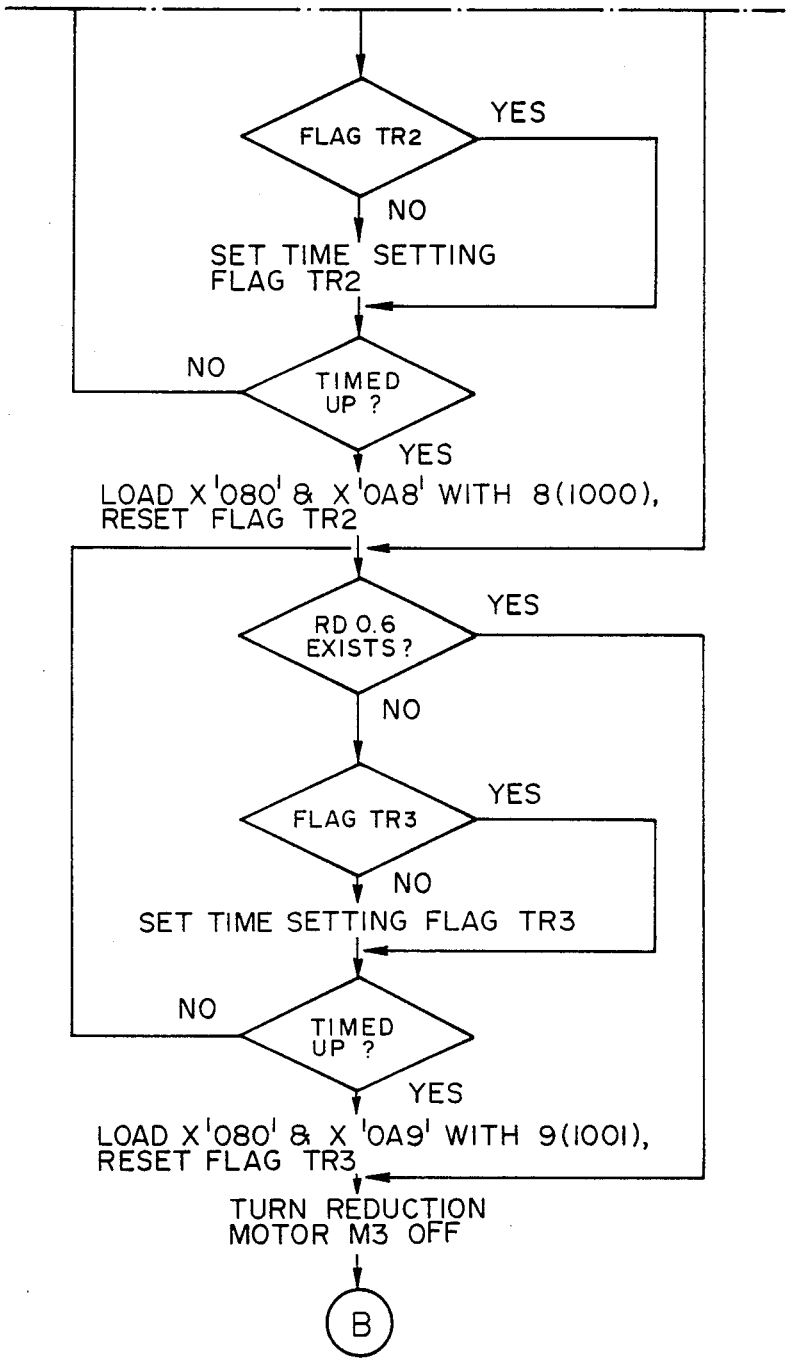
Figures 1A, 15:
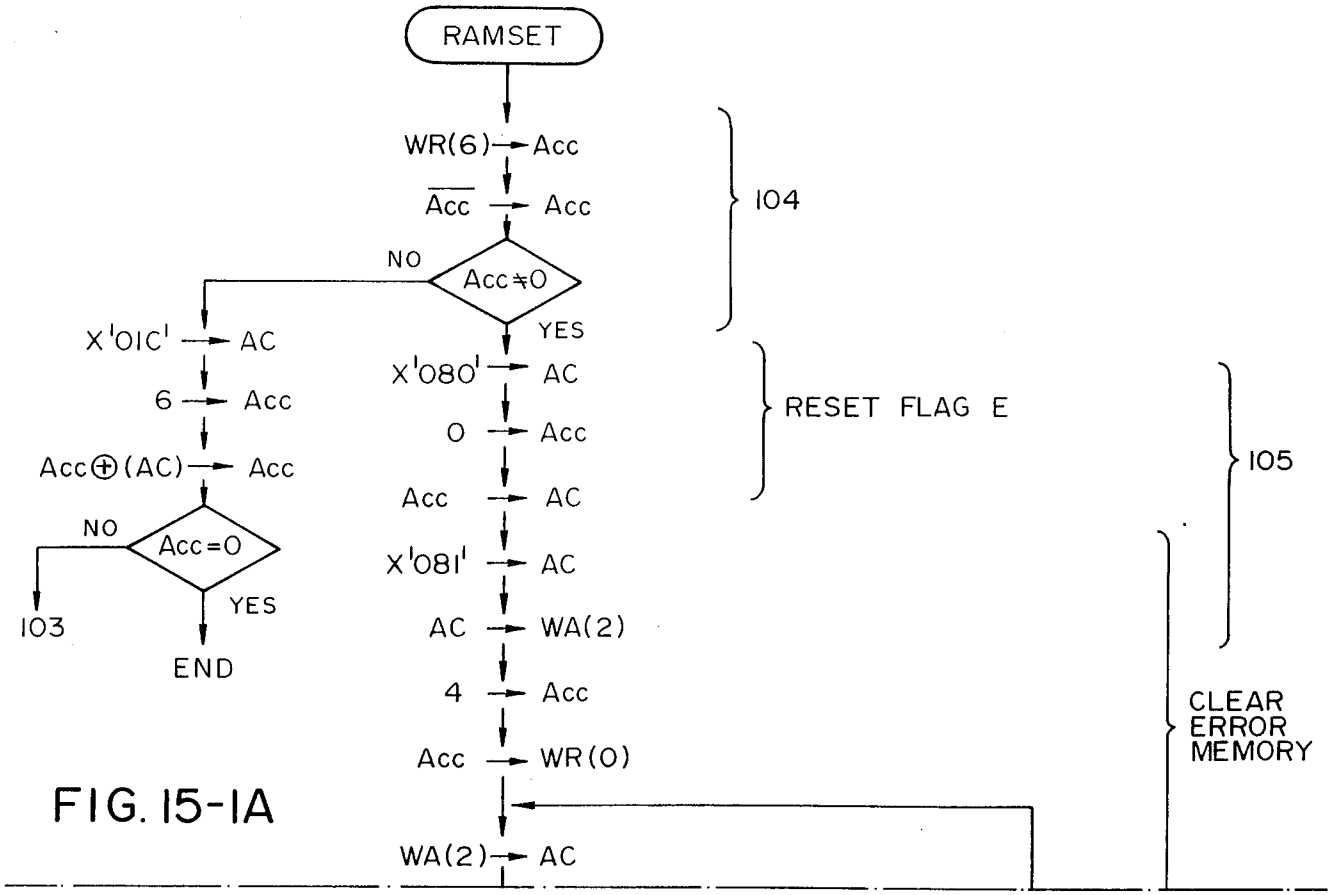
Figures 1B, 15:
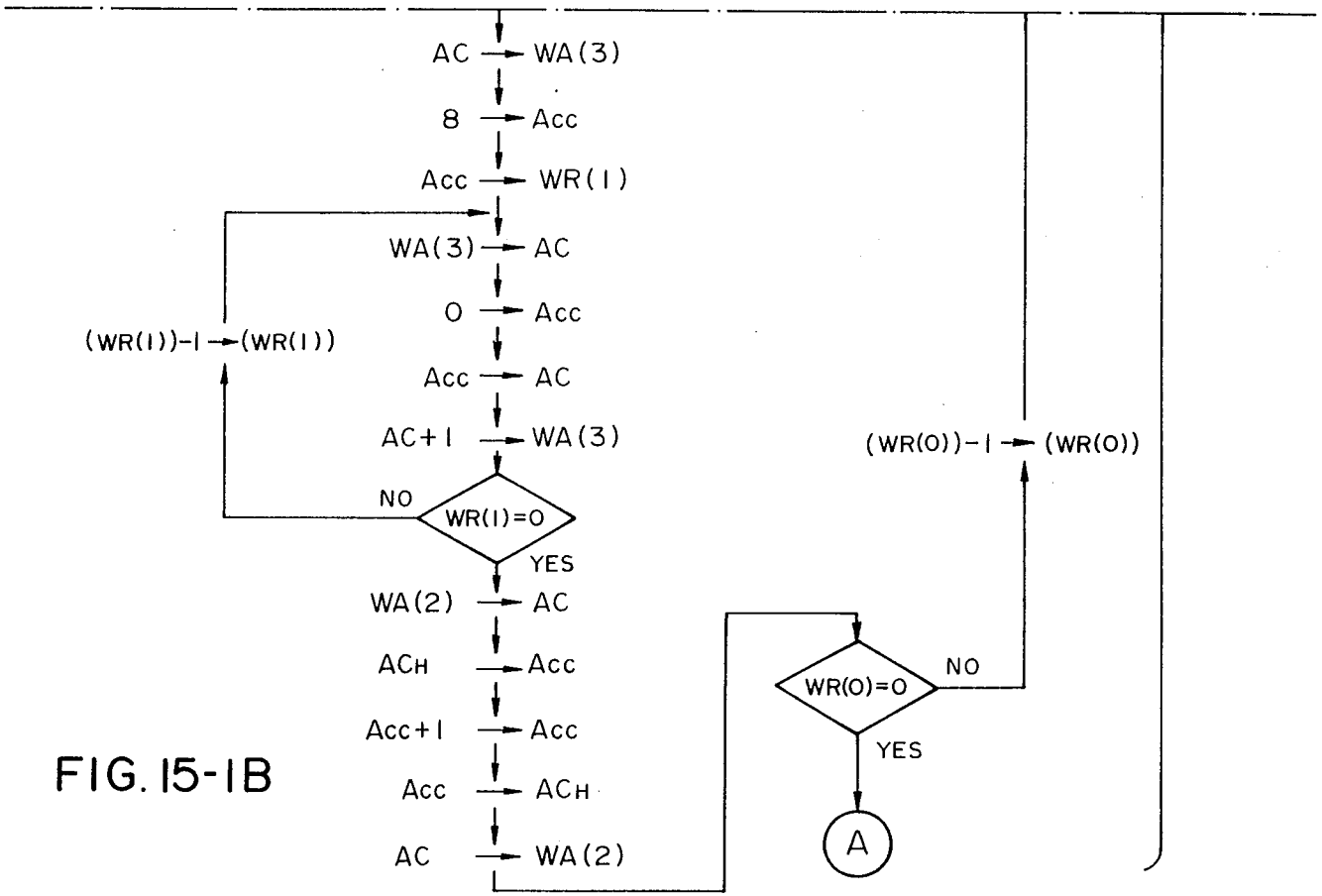

FIGS. 14-4A through 14-4F shows the flow chart for carrying out the diagnosis. At first, the main motor $M_1$ is turned on to prepare itself for moving the optical system forward and backward. Then, it is checked whether the optical system is correctly in its stop position at the sensor 84. When not, the optical system return clutch $CL_2$ is actuated to return the optical system to the proper stop position. After a predetermined timer time (maximum estimated time), the above check is repeated again. When 1 is not detected at the sensor 84 even this time, error flag and sensor error data 3 are set to RAM. After that or when the sensor 84 is not wrong, the return clutch $CL_2$ is turned off and the optical system forward clutch $CL_1$ is turned on. After a certain timer time, it is checked whether the sensor 83 is on (whether signal RG is 1) in the same manner as above. If the sensor is wrong, then error flag and error data 5 are stored in RAM. Similarly, check is made on sensor 85 and its data is stored in RAM.

Upon the end of above check, the main motor $M_1$ is turned off and instead the reduction motor $M_3$ is turned on. Then, it is checked whether the sensor 86 ($RD_1$) is 1. This check is continued for a predetermined time length which corresponding to the time normally required for the sensor to detect the optical system. When the sensor fails to detect the optical system within the time, error flag and error data are set. The limit of time mentioned above was determined by repeating the time up decision routine a given number of times. This is the same as that in Step 15 shown in FIG. 5-1A through 5-1D. After checking sensors 87 and 88 in the same manner, the reduction motor $M_3$ is turned off.

After that or when all the reduction sensors are not wrong, outlet sensors 70 and 71 are checked in the following manner:

At first, it is checked by tray sensor 70 whether the tray exists. When yes, the outlet motor $M_2$ is turned on and check is made as to whether sorter sensor 71 is on. If it is not on, the sorter sensor is regarded as wrong and RAM is processed by the data. When the tray sensor is off, the sorter sensor 71 is checked. When the signal of the sensor 71 is 1, clutch $SL_2$ is turned on to reverse the rotational direction of the outlet motor $M_2$ which is then turned on to move the belt upward. If the tray sensor 70 does not become on, it is regarded as failure of the sensor 70 and RAM is processed in the same manner as above. If neither sensor 70 nor 71 are on, it is regarded as both the sensors being wrong and RAM is processed. After turning $M_2$ and $SL_2$ off, step is returned to the flow of main diagnosis shown in FIG. 13. Then, it is advanced to the indication step 103 in FIG. 13. In the flow chart shown in FIG. 14-14, timer is operated. The operation of timer can be done within CPU and is well known. Therefore, it need not be further described.

More Indication F-5

This is a diagnostic mode for carrying out diagnosis on the clock pulse generator 82 in synchronism with the drum rotation. Diagnosis in this mode is carried out on the basis of keying on of numeral key of 5. The diagnostic sequence is shown in FIG. 14-3.

At first the main motor $M_1$ is turned on by putting out 0001 to X'Boo' and 4 bits of port X'Boo' is put in after reading the output KCP from clock pulse generator. Then, Io of X'Boo' is checked (input circuit A in FIG. 4-11). Timer is operated irrespective of whether KCP is 0 or 1. Thereafter, KCP is checked once more. The timer time is so determined as to be longer than one cycle of clock pulse. When KCP was 0 at the first check, it is checked at the second check time whether KCP is 1. On the contrary, when it was 1 at the first time, the second check is made as to whether KCP is 0. The clock pulse generator is regarded as right when KCP at the second time is 1 in the former case and 0 in the latter. So, motor M1 is turned off. But, if KCP remains unchanged it means failure of the generator. In this case, an error information is given to X'0A1' and X'080'.

Mode Indication F-6

This mode is carried out by keying on the numeral key of 6 for diagnosis on the screen drum stop position detection sensor 51. The procedure of this diagnosis is essentially the same as the above described mode 5. If failure is detected RAM X'0A2' is loaded with a numeral data other than 0, for example, 1 and error flag X'080' is set.

Diagnostic modes L and 1 to 6 by numerals keys of 0 to 6 have been described in detail. Similarly, other various diagnostic modes may be executed making use of numeral keys of 7 to 9, cassette selection key and the like. For example, check can be made as to various troubles in paper feed registration clutch $CL_1$, forward- and backward clutches $CL_2$ and $CL_3$, heater in fixing roller 13 and exposure lamp 4 (wire breaking) to have the error flag and error data set to the memory.

After setting flag and data in the manner described above, step is advanced to Step 103 for reading the data and indicating the error mode. Since error flag (X'080') has already been set when failure was found by diagnosis at Step 107, the error is indicated on the indicators at Step 103 for the second and more times. The indication system of error modes has been described with reference to FIG. 12. When there are two or more errors detected, these errors are sequentially indicated.

If no error is detected by the diagnosis, indication of error mode is not made. Instead, data 8 (BCD 1000) is set to X'0D3'-X'0D5' and there are indicated X'050'-X'0D0' through Key & Display I/O-X100'. For example, in diagnosis on motor there are displayed F, –, 1 on the indicator 23-1 and ⊟, ⊟, ⊟ on the indicator 23-2 in accordance with the timings of $T_0$, $T_1$, $T_2$, $T_3$, $T_4$ and $T_5$.

Execution of diagnostic programs described above has the following advantages:

Numeral keys 0 to 9 which are used to set the number of copies to be made in the normal stand-by routine as well as the clear key which is normally used to clear the set number can be used also to select the diagnostic mode and instruct a termination of the diagnostic routine. This contributes to reduction of cost and simplicity in structure of the operation part of the image forming apparatus.

Indicators 23-1 and 23-2 which are used, in the normal stand-by routine and copy routine, to indicate the number of copies set and the number of copies completed, can be used also to indicate the diagnostic mode and results of the diagnosis. this contributes to reduction of cost and simplicity in structure of the display part.

Diagnosis on two or more loads can be executed by only one key input. This saves the operator from troublesome operation work.

Diagnostic result is repeatedly indicated one and same indicator. this enhances warning effect.

In the case of errors in those sensors and loads which are provided for such device and member which are not used in the normal copying procedure, for example, sorter and ADF (automatic original feeding and discharging device), copying can be carried out without removing such an error. Therefore, objects of the errors can be classified by ranking which makes the operation easy.

Figures 1, 15:
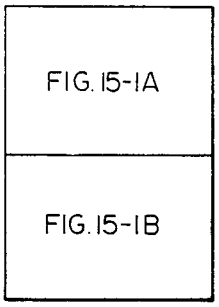

FIGS. 15-1 and 15-2 show a microflow relating to FIG. 13 in which above-mentioned μ COM4 is used.

FIG. 15-1 corresponds to key input processing step 104 and error memory clear step 105 in FIG. 13. FIG. 15-2 corresponds to numeral key signal decoding step 106 and diagnostic mode selection step 107. WR(6) means data of RAM X'018' and WA(2) is data of the second working register of RAM. The micro flow sequence can be understood very easily from the drawing and the system of μ COM4 and need not be further described.

Example of Processing Control according to Rank of Error

Figure 16:
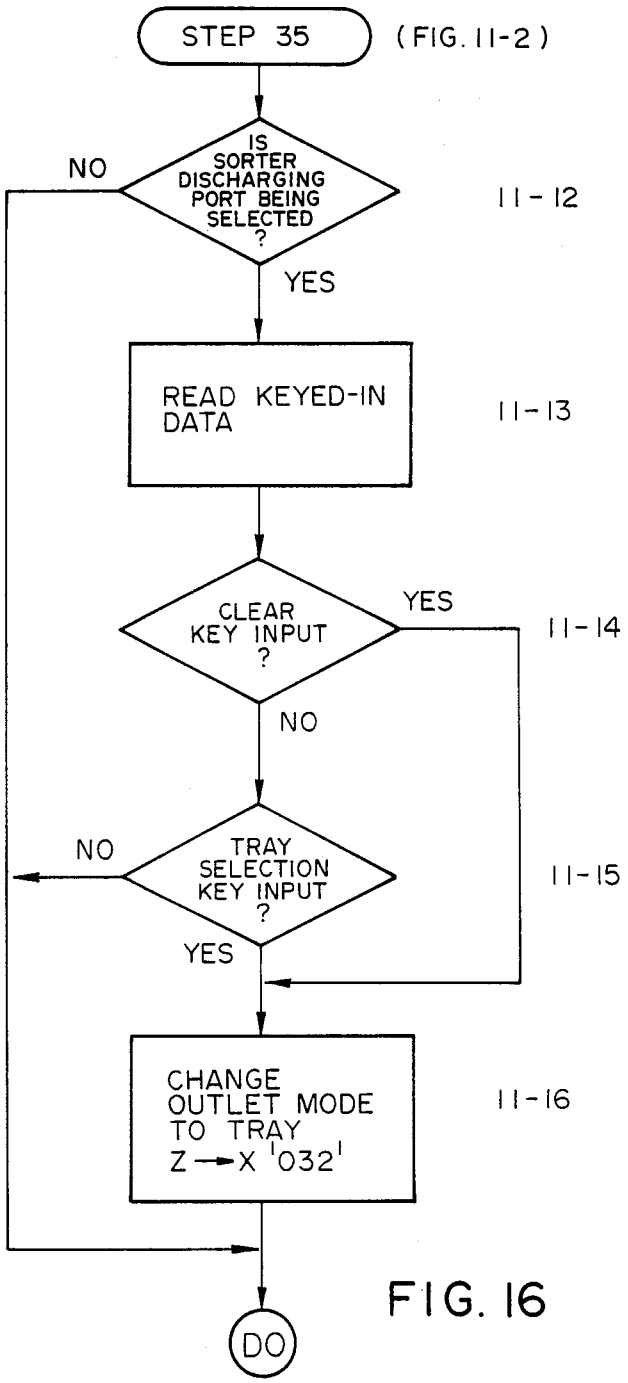
FIGS. 16 to 19 show modified flow charts for an improved control.

After the error indication routine in FIGS. 11-2A, 11-2B and 11-2C, the following routine can be executed in accordance with the flow chart shown in FIG. 16.

At first, check is made as to whether sorter mode is selected by reading the outlet mode memory (X'032') in RAM. When yes, step is advanced to Step 11-3, and when no, it jumps to Do to repeat the above routine (11-2).

At Step 13, Key & I/O apparatus, namely, data keyed in the address X700' is read in. Then, RAM address X'01C' is checked in which keyed-in data is stored. When the data is found to be 6, that is, clear key input, the step is jumped to 11-6 (11-14). When it is not clear key input, the step is advanced to 11-15. At Step 11-15, it is checked whether the data in X'01C' is X'B' namely, input of the tray selection key. When yes, the step is advanced to Step 11-16, and when no, it jumps to Do to repeat the above routine (11-15).

At Step 11-16, the content of outlet mode memory (X'032') is changed to 2 from 1, that is, to tray mode from sorter mode. Thereafter, step jumps to Do to execute the above routine again. In this case, if the detected error is one relating to sorter, no further check as to the sorter error is carried out in the next execution of the routine and therefore the indication on the indicators 23-1 and 23-2 is changed over from error indication to usual numeral indication.

As will be understood from the foregoing, according to the above-described diagnostic programs, the machine cannot get free from the program but is locked in its inoperative position until the detected error is completely removed so long as the error is fatal to the normal copying operation of the machine. However, in case that the error concerns an accessory of the machine such as a sorter, it is allowed to bring the copying machine into its operable position by selecting a new tray instead of the sorter. In this case, the escape from diagnostic sequence can be effected using not only the clear key but also the mode change-over key, which assures easiness of operation.

Diagnosis Selective Control

Figure 17:
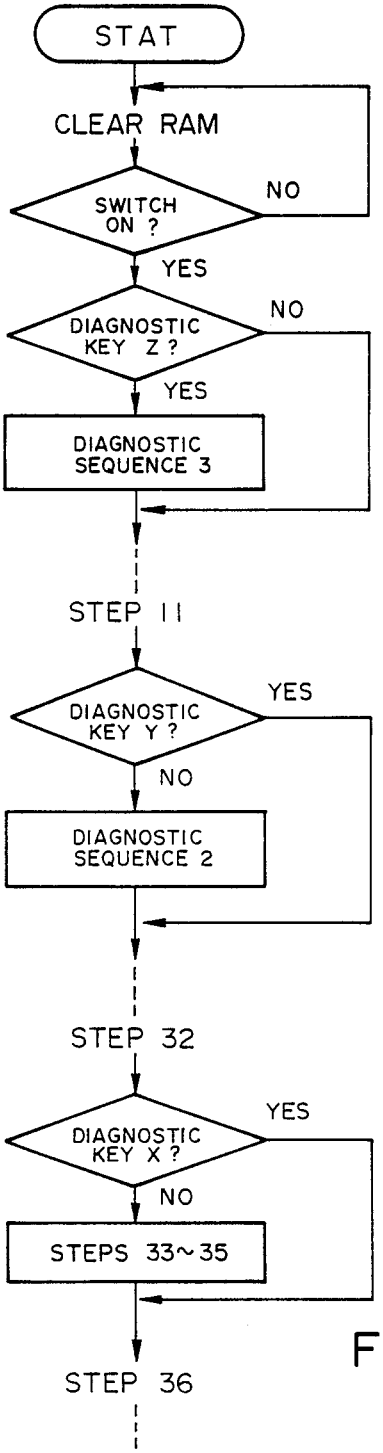

It is sometimes inconvenient, in particular, for test run that the above-described diagnostic sequence 1 after jam and sequence 2 during stand-by are kept always in the position ready for operation. To solve the problem, FIG. 17 shows a sequence for disenabling any diagnostic program. This sequence can be effected by providing diagnosis disenabling switches X and Y not shown in the machine casing. Diagnostic program remains disenabled until the switches are turned off. Similarly, a key switch Z is provided for the initial diagnostic sequence 3 so that the sequence may be executed only when it is required. Switches X and Y are connected to the remaining input part of above mentioned I/O port and key Z is connected to the remaining matrix intersection of key I/O. In this manner, disenabling and selection of the diagnostic program can be controlled by slightly modifying the program.

Figure 18:
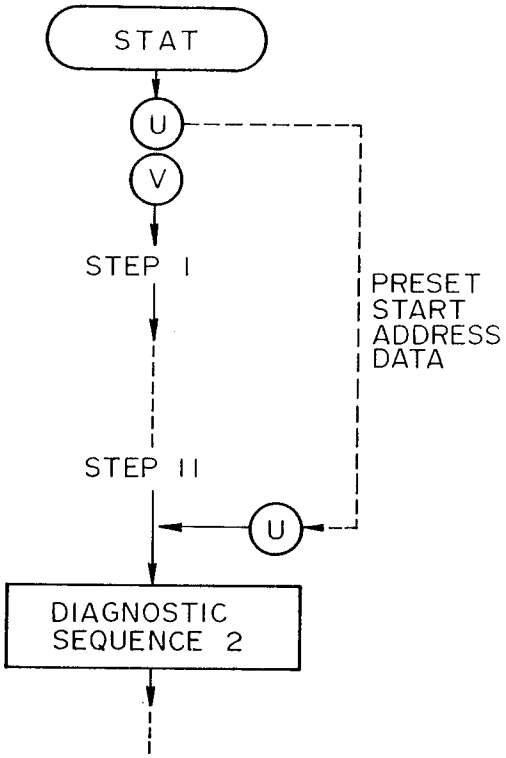

FIG. 18 shows another example. At the time of CPU run start, namely at the time of power on of CPU, 12 bits of address bus data are set so as to make the address bus produce data of ROM address storing diagnostic sequence 2. According to this embodiment, it is allowed to start the execution of the diagnostic program at once by keying on a sub-switch. In this case, power supply to sensors, at least to paper sensors is maintained by the sub-switch.

Escape from diagnostic sequence also may be effected by turning off the main switch SW when an additional step is provided at the beginning of diagnostic sequences shown in FIGS. 10 and 13 (in case of FIG. 10, before Step 33). The step is such one which returns to STAT after checking off of the main switch SW as in Step 10 in FIG. 5-1.

Control of Sorter Bin Initial Set

In FIG. 1-2, designated by 75 is a sorter bin home position sensor the function of which is to detect that the first sorter bin is in the position ready for receiving paper. Numeral 77 designates a paper transportation assisting member the function of which is to deflect the moving direction of paper coming through a paper path 76 in the sorter. The moving direction of the paper in the path 76 is indicated by arrow X. Leaving the path 76, the paper is deflected to the direction indicated by arrow Y and guided down ward vertically by the member 77. The paper thus guided is received in one of sorter bins 20. For each one bin there are provided a pair of entrance rollers and a guide pawl. Such guide pawls are designated by a, b, c, d, . . . in the drawing.

Selection of the bin in which the coming paper is to be received is made by a cam (not shown) which can move upward and downward. The guide pawl at which the cam is stopping deflects the coming paper toward the entrance roller from the direction Y. thus, the paper can enter the selected bin through the entrance roller.

Figure 19:
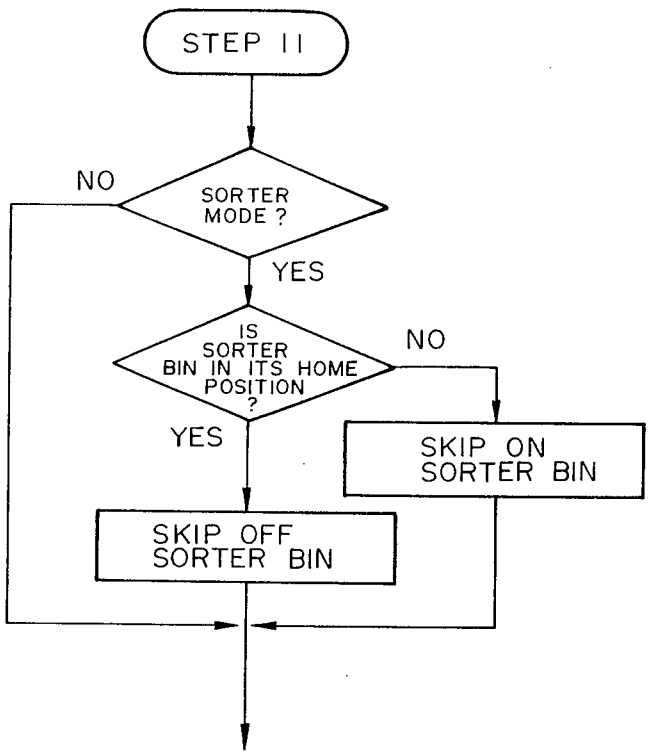

For a sorter of the type described above, the sorter bin in which the first copy paper coming from the copying machine is to be received, may be different case by case which depends primarily upon the state of the copying machine. However, normally the first arrived paper is received in the upper-most bin positioned by the sorter home position sensor. Starting from the uppermost one a, the cam moves downward step by step in the direction of arrow Y so that the second bin b receives the second copy paper, bin c the third, d the fourth . . . so on. Therefore, it is usually required to return the sorter cam back to the position of the home position sensor 75 prior to start of a copying operation. For this purpose, a control sequence as shown in FIG. 19 is interposed in the flow chart in FIGS. 5-1A through 5-1D at the step just before the diagnostic sequence 2.

When the sorter home position sensor does not deliver a signal informing that the sorter is in its home position although sorter mode is selected, a sorter bin skip ON signal is delivered to the sorter to set the cam at the position of sorter home position sensor 75. In this case, a sorter control circuit (not shown), when it receives the sorter bin skip ON signal, makes the cam move continuously to the home position 75 where the cam is stopped. After stopping the cam, the control circuit delivers to the copying machine a signal informing that the sorter is now in its home position. Responding to the signal, the copying machine cuts off the sorter bin skip signal. Therefore, the first completed sheet is always received in the uppermost bin so long as the copying operation is normal.

In case that a paper jam occurred in the copying machine or in the sorter before completion of the set number of copies, the operator restarts copying the remaining number of sheets without checking on the sorter home position signal. The copy sheet arrived first after the restart is received in a bin at the right step. Sorting goes on properly without error. If the operator gave up copying the remaining number of sheets after unjammed and the preset mode was cancelled by the clear key, then step in FIGS. 10A and 10B is returned to (To) after checking the input of the clear key and sorter bin is reset to its home position. Therefore, the first arrived copy sheet in the next copying operation is received in the uppermost bin. This is the same for the case where the copying operation is stopped by keying on the stop key. When the copying operation is interrupted because of paper out and the copying operation is restarted after supply of paper, the same control of the sorter bin as in the above-described interruption case by jam is performed. In any case, the sorter bin is controlled in such a manner that no error in making up the pages of copies may be caused.

Sorter is exchanged from one to another when the first sorter is filled up. A sequence for sorter exchange according to the shown embodiment is as follows:

When the first sorter gets filled up, paper feed is interrupted by a signal from a counter which counts the paper feed signal issued within the machine and indicates the number of copies completed. The signal is issued at the time point when the counts just reaches the total number of bins in the sorter. The machine is brought into its waiting position until the last bin in the first sorter receives the completed copy. During this wait time, the dielectric drum and screen drum rotate idly without formation of secondary latent image. Removing charge and cleaning are carried out for the dielectric drum. The primary latent image on the screen drum is remained unerased. At the time of the last one being received, a detection signal (later described) is issued. By this detection signal the pawl 77 is moved and the formation of secondary image is restarted. The total number of sorter bins is stored in the memory RAM by using a manual digital switch in the main body (not shown) or a digital switch automatically set by the connection of the sorter with the copying machine. Based on the stored member CPU controls the above described interruption and idle operation.

Detection and Treatment of Sorter Jam

Figure 20:
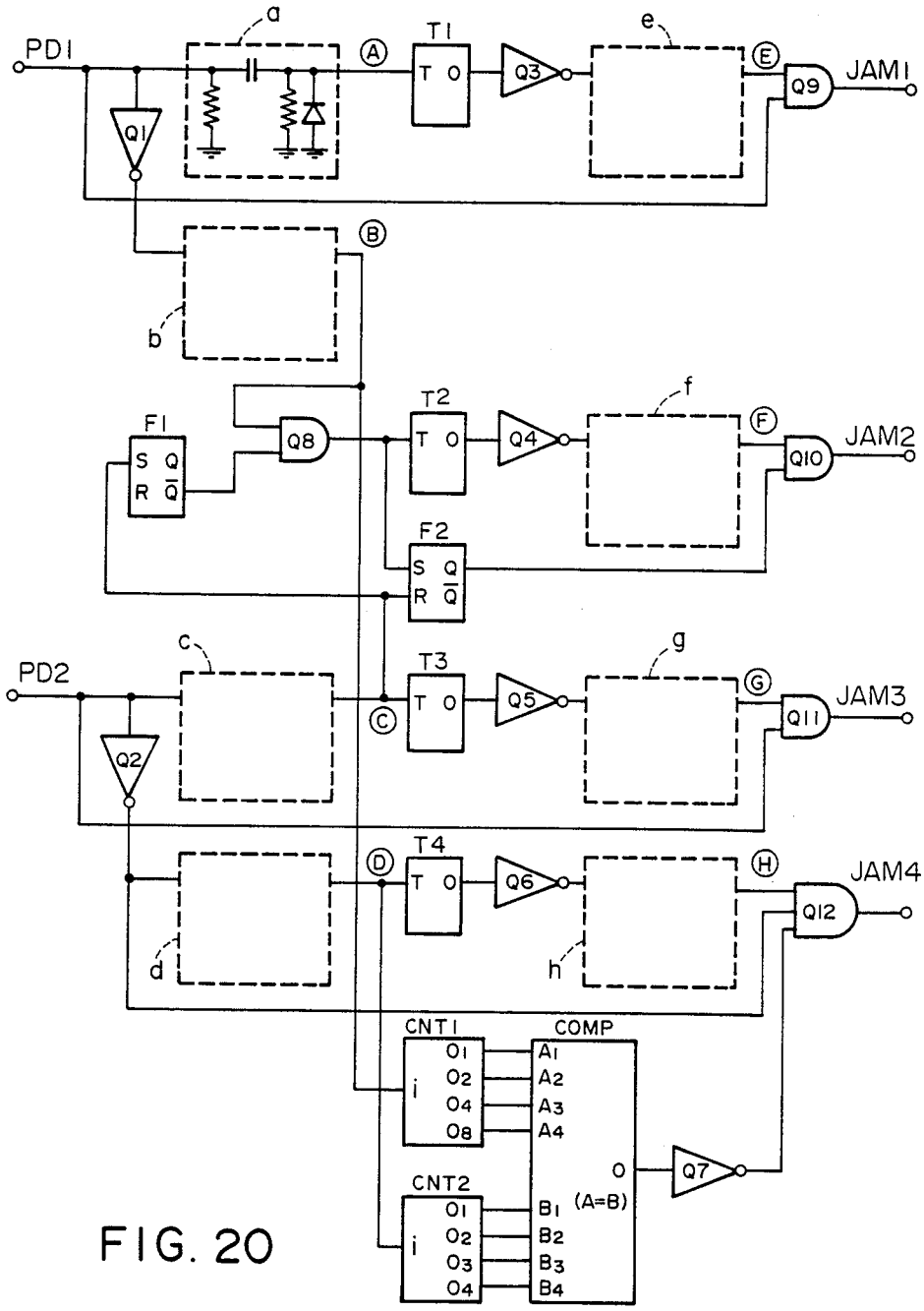
FIG. 20 shows a sorter jam detection circuit.
Figure 21:
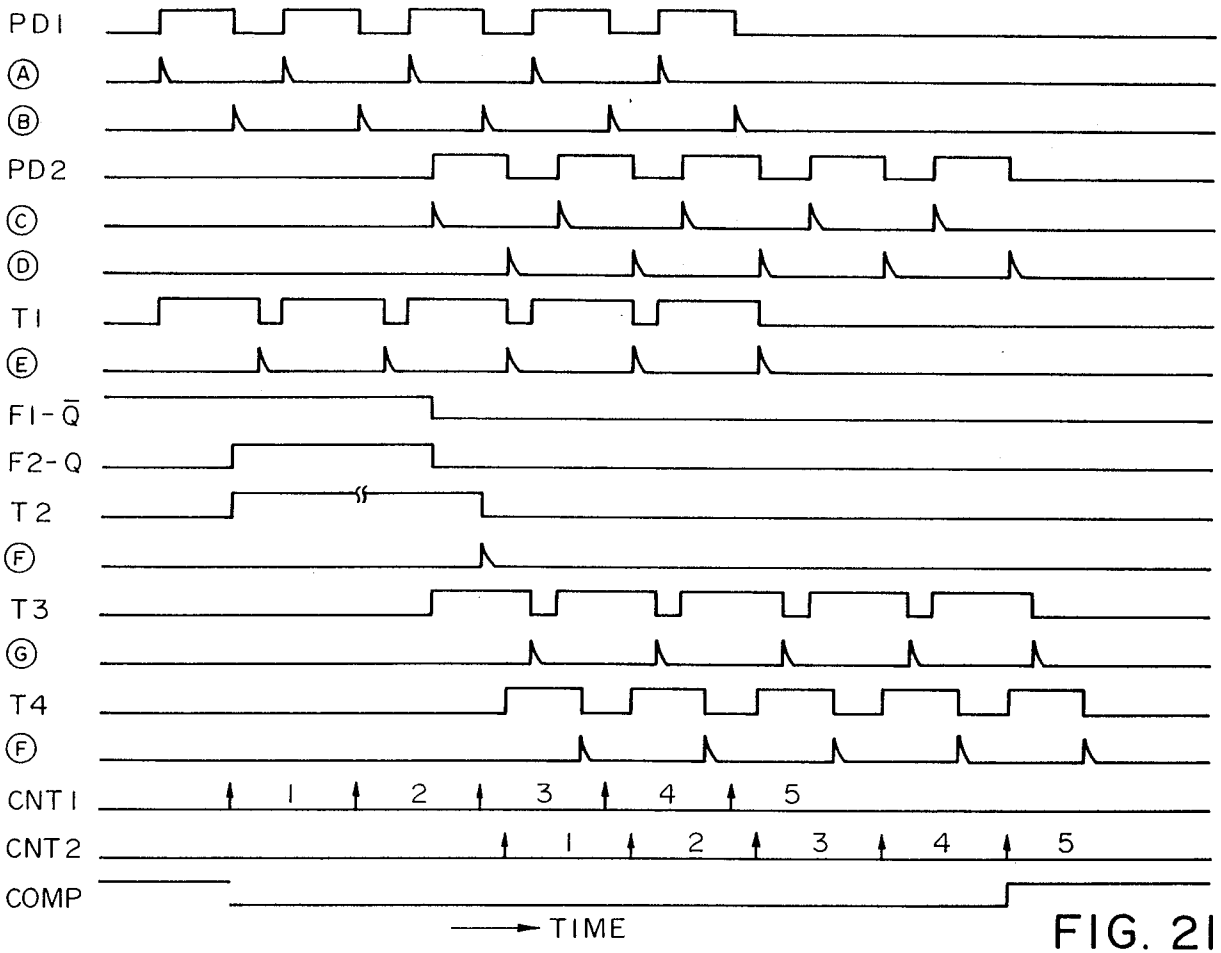
FIG. 21 is a time chart of the operation thereof.

FIG. 20 shows a sorter jam detection circuit. Designated by F1 and F2 are conventional R/S flip-flops. S is set input port and R reset input port Q and $\overline{Q}$ means outputs complementary to each other. T1 through T4 are conventional monostable multivibrators (timers) which are triggered by a positive-going edge of input signals at triger terminals respectively. The output remains at a constant level for a certain time. CNT1 and CNT2 are common 4-bitbinary counters, C is clock input, O is 4 bit binary output terminal and COMP is a conventional 4-bit magnitude comparator. When binary signals at input terminals $A_1$, $A_2$, $A_3$, $A_4$ are all equal to those at other input terminals $B_1$ , $B_2$, $B_3$, $B_4$ respectively, the output O develops a logic level "H". Q1 through Q7 are inverters and Q8 through Q12 are AND gates. Differentiation circuits a, b, c, d, e, f, g and h each issues a differentiation pulse of level "H" at the time of the positive going edge of the input signal. JAM1 represents a jam signal which is issued when paper remains staying at sensor 68 ($PD_1$) for a time period longer than a certain limit time, JAM2 is a jam signal issued when the sheet first delivered toward the sorter fails to reach sensor 69 ($PD_2$) after passing through $PD_1$, and JAM 3 is a jam signal issued when a sheet remains staying at $PD_2$ for a time length longer than a certain limit time. JAM 4 is a jam signal which is issued when a delay longer than a predetermined delay time takes place between one sheet and the next one. FIG. 21 shows a timing chart of the above mentioned various signals in the jam detection circuit. The timing chart is made using the paper detection signals of PD1/ and PD2 as basis.

As mentioned above, sensors $PD_1$ and $PD_2$ issue logic level "H" when papers are staying at the sensors respectively The paper signals $PD_1$ and $PD_2$ passing through differentiation circuits a and c generated signals Ⓐ and Ⓒ (FIG. 21) respectively. On the other hands, the paper signals $PD_1$ and $PD_2$ passing through inverters $Q_1$ and $Q_2$ and differentiation circuits b and d generate signals Ⓑ and Ⓓ respectively. Signal Ⓐ triggers timer T1. At this step, T1 issues from its output Q Level "H" for a certain time (t1). Signal Ⓑ is applied to one input of NAND Q8 to set flip-flot F2 and trigger T2. Further, it is a applied to the count input terminal of counter CNT1 to make an increment of the count number. Signal Ⓒ sets F1, resets F2 and triggers T3. The timer T3 puts out from its output Q level "H" for a certain time length (t3). Setting of F1 makes the output $\overline{Q}$ turned to level "L" and the level "L" is applied to one input of NAND Q8. Thereby the output of AND Q8 is turned to "L" irrespective of another signal of AND Q8 so that no setting of F2 and no triggering of timer are effected. Signal Ⓓ triggers timer T4 which then issues "H" at output Q for a certain time length (t4). Also, signal Ⓓ is applied to the count input terminal of counter CNT2 for increment of the count number. The outputs of the triggered timers T1 through T4 pass through inverters Q3 through Q6 respectively and are inverted by them. After time up, the logic level of each timer changes from "L" to "H". This change makes the differentiation circuits e, f, g, h produce rising differentiation pulses at their outputs Ⓔ, Ⓕ, Ⓖ, Ⓗ respectively. The 4-bit outputs of CNT1 and CNT2 are put into the input terminals A and B of comparator COMP respectively. The output O of COMP becomes "H" when the 4 bits applied to input terminal A are equal to those to B. Therefore, through inverter Q7, one input to AND Q12 becomes "L" and its output becomes "L" irrespective of the level of other two inputs. Thus, JAM4 is not issued when the counts by CNT1 and that by CNT2 are equal to each other. The output of COMP is a signal informing that the last bin of the first sorter has just received the corresponding copy sheet. By means of this signal, the guide pawls 77 are moved turning to the second sorter and the copying operation is restarted. The sheets copied thereafter are delivered to the second sorter through the outlet 81.

When no paper is on PD1 and PD2 and the signal level is L, differentiation pules Ⓔ and Ⓓ 'generated at time-up of T1 and T3 do not appear at outputs Q9 and Q11 and therefore JAM1 and JAM2 are not generated.

Flip-flop F2 is set by rise of PD1 and reset by that of PD2. To set F2 it is necessary that the gate of AND Q8 is open which depends upon $\overline{Q}$ output of F1. Initially, F1 is in its reset position and its output $\overline{Q}$ is "H". It is set by rise of PD2 and its output $\overline{Q}$ is turned to "L". From this time point, the gate of AND Q8 is closed so that setting of F2 and triggering of T2 no longer take place. This means that $\overline{Q}$ output of the flip-flop F1 continue to be "H" during the time of the first sheet being moved from PD1 to PD2. F2 is reset by the paper arrival signal from PD2 and when the output $\overline{Q}$ is "L" no JAM 2 is issued because of AND Q10 being closed.

If a copy sheet, for example, the third sheet directed to the sorter is jammed at PD1, then the signal level of PD1 continues to be "H". Since the gate of AND Q9 is open when T1 times up and signal Ⓔ is generated, there is issued jam signal JAM 1.

If paper directed to the sorter fails to reach the area of PD2 after passing over PD1 the rising signal of which sets F2 and triggers T2, then F2 which is normally reset by signal Ⓒ with the rise of PD2 remains set and AND Q10 remains opened. Therefore, signal Ⓕ generated at the time of time-up of timer T2 appears at its output so that jam signal JAM2 is issued.

Like the case of JAM 1, if the third paper directed to the sorter is jammed at PD2, then the signal level of PD2 continues to be "H", timer T3 triggered by signal Ⓒ is timed up and jam signal JAM3 is issued because the gate of AND Q11 is open when signal Ⓒ is generated.

If paper sheets up to the third at safely received by the sorter but the fourth paper fails to reach the area of PD2, then the inverted signal of PD2 continues to be "H". At this stage, the count of CNT1 is 5 and that of CNT2 is 3. The output O of the comparator is "L" which is inverted to "H" by inverter Q7. This "H" level signal is applied to AND Q12. Therefore, its two inputs are turned to Ⓗ and the gate is opened. Signal Ⓗ is generated by time-up of timer T4. The signal passes through AND Q12 and generates jam signal JAM4.

As sensor PD1, the outlet sensor 67 in the main body may be used. By doing so, it is made possible to detect jam of papers continuously conveyed to the sorter by only one sensor.

When there occurs any sorter jam as described above, paper feeding operation in the main body and sorting operation (in the direction of arrow Y) in the sorter are stopped at once. As for the paper already fed in the paper path in the main body, conveying operation of such paper are continued until the paper is discharged from the main body. As soon as a sorter jam occurs the cover member 79 of the sorter 18 is automatically turned up about the pivot 80 as indicated by arrow to prevent the paper from being discharged outward or toward a bin from the passage 76. The sheet arrived at the sorter after the jam is held in the passage 76.

Detection and Treatment of Jam in Main Body

Figure 22:
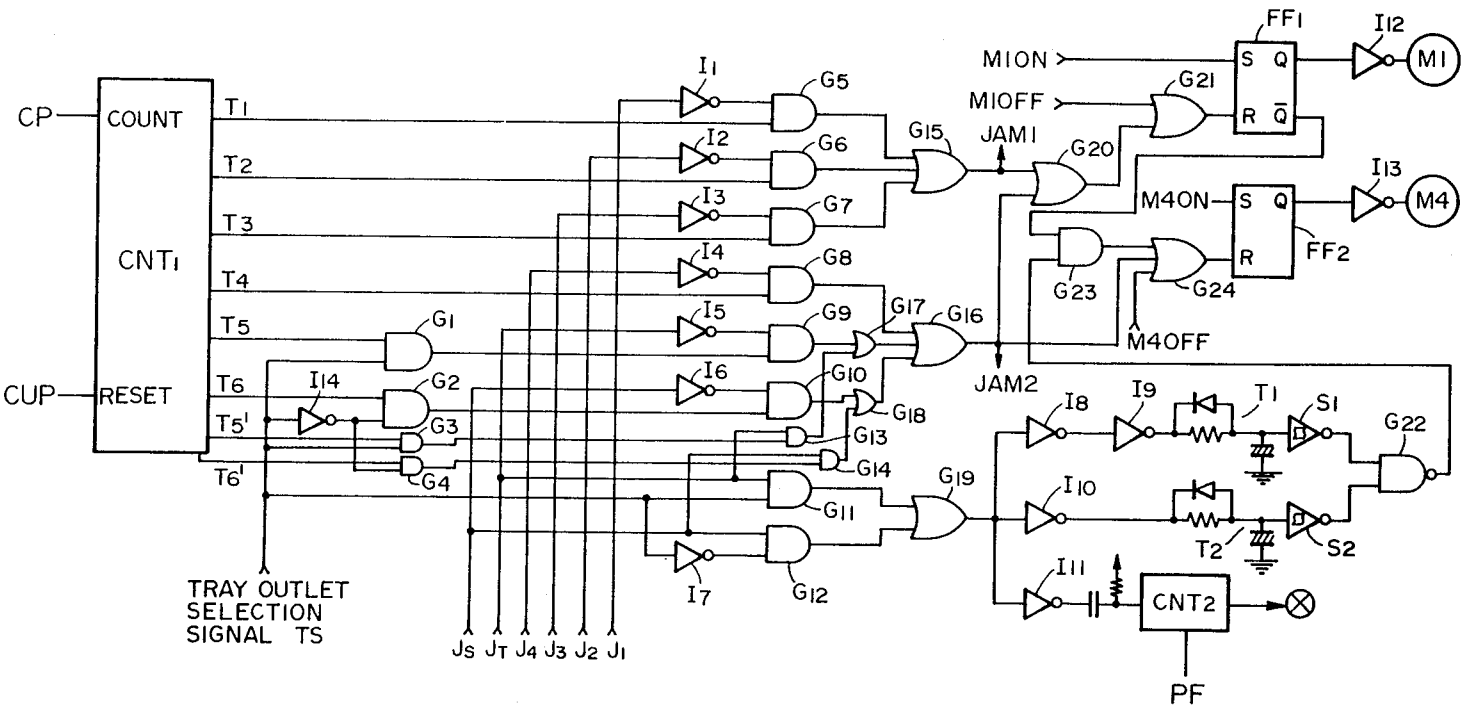
FIG. 22 shows a copier jam processing circuit.

FIGS. 22 and 23 show jam detection circuit according to the invention.

Designated by CNT is a counter for counting clock pulse CP and putting out jam check signals $T_1$–$T_6'$. $G_1$–$G_4$ are AND gates for checking the paper detection signals of tray and sorter 66 and 67, $G_5$–$G_{10}$ are AND gates for checking the paper detection signals of sensors 62–65 along the paper path, $G_{11}$ and $G_{12}$ are AND gates for further detecting jam after a detected jam and $G_{13}$ and $G_{14}$ are AND gates for checking paper staying at the outlet. $G_{15}$–$G_{21}$ are OR gates for outputting jam detection signals and $G_{22}$, $G_{23}$ and $G_{24}$ are NAND, AND and OR gates for outputting further jam detection signals respectively. $I_1$–$I_{14}$ are inverters, $T_{11}$–$T_{12}$ are timers for detecting further jamming, $S_1$ and $S_2$ are waveform shaping Schmitt trigger circuits and $CNT_2$ is an up-down or reversible counter. The counter $CNT_2$ takes an increment (+1) by signal PF which turns the feeding roller 9 on for feeding paper, and takes a decrement (−1) by paper discharge signals $J_s$ and $J_t$. $J_1$–$J_4$ are signals each of which is 1 when paper is detected by paper sensors 62–65. CUP is a signal which is 1 when the set number of copies and the number of completed copies are made equal to each other. This signal CUP resets the counter $CNT_1$. $FF_1$ is a flip-flop for controlling the operation of main motor $M_1$ and $FF_2$ is a flip-flop for controlling that of rear belt motor $M_4$. When 1 is at port S, they output 1 at port Q to drive the motors $M_1$ and $M_4$, and when 1 is at port R they output O at port Q to stop the motors. $T_1$–$T_6$ are pulses as shown in FIG. 24 and they are issued in timings timed to the time points at which paper normally passes over the sensors 62–67 respectively. $T'_5$ and $T'_6$ are also pulses issued in timings timed to the time points in which normally the interval between one sheet and the next one fed continuously reaches the area of outlet sensors 66 and 67 respectively.

The main motor $M_1$ can drive the drums 1 and 7, registering roller 35 and front belt 12. $M_4$ can drive the rear belt 12, fixing roller 13, di-charging belt 19 and discharging roller 50 independently of the main motor $M_1$.

The manner of operation of the apparatus shown in FIG. 22 is as follows:

At first, the copy key is depressed, which produces a $M_1$ On signal to set $FF_1$. Thus, the main motor $M_1$ is brought into operation and the drum 1 starts rotating from its stop position. The rotation of the drum generates pulses from encoder 82. Counter $CNT_1$ begins counting the pulse. After the rotation of the screen drum 1, a secondary latent image is formed on the dielectric drum 7 through exposure and modulation. When the counts of pulses reach a predetermined number, a paper feed signal PF is issued. Here, it is to be noted that the motor $M_4$ is brought into operation with a certain delay to $M_1$. Paper sheets are fed through paper feeding roller 9 from the upper or lower cassette. When the paper properly reaches the sensor 62 at the timing pulse of $T_1$, the output of gate $G_5$ is 0 and therefore filip-flop $FF_1$ cannot be reset. Similarly, when, passing the sensor 62, the paper properly reach sensors 63, 64 and 65 at timing pulses $T_2$, $T_3$ and $T_4$ respectively, the outputs of $G_6$, $G_7$ and $G_8$ are all 0 and therefore $FF_1$ cannot be reset. Timing relation between $T_1$–$T_6$ and $J_1$–$J_5$ is normally that shown in FIG. 24.

If paper gets jammed in the paper path and it fails to reach sensors 62–64 in the preset timings mentioned above, then any one of gates $G_5$–$G_7$ putouts 1 which resets $FF_1$ so that the motor $M_1$ is stopped at once. The operator can remove the jammed paper. At this time, $FF_2$ remains unchanged and therefore the motor $M_4$ can continue rotating. The rear belt 12 continues moving to effect discharging the paper passing the vicinity of the fixing roller 13 at the time of jam. In this manner, when paper gets jammed in the path near the paper feed station or transferring station, only the driving and conveying system at the upstream side of the jam point is stopped and the remainder at the downstream side continues operating. This saves papers at the downstream side and loss of paper by jam trouble can be reduced to minimum.

Now, description is made of a jam occurred at the downstream side of the rear belt 12.

When the tray is selected by outlet selection signal Ts=1, timing pulse $T_5$ is generated in response to tray sensor 66 through gate $G_1$. For sorter sensor 67, pulse $T_6$ is generated through gate $G_2$. So long as the paper detection signal Jt from tray sensor 66 or Js from sorter sensor 67 is present at $T_5$ or $T_6$, flip-flop FF cannot be reset because of no output from $G_9$ and $G_{10}$.

However, if the selected sensor 66 or 67 detects no paper at $T_4$, $T_5$ and $T_6$, flip-flop $FF_2$ is reset through OR gates $Q_{16}$–$Q_{18}$ to stop the motor $M_4$. Thus, roller 13 and belt 19 positioned downstream the belt 12 are stopped. At the same time, $FF_1$ is reset through $G_{20}$ and $G_{21}$ to turn the motor $M_1$ off. Therefore, the registering roller 35 positioned at the upstream side of the belt 12 is also stopped. thus, the entire driving system is cut off. In this manner, when a paper gets jammed at a point near the paper discharge section, paper feeding operation at the upstream side of the jam point is stopped to prevent any further extension of jam.

If a paper sheet gets jammed at the area of outlet sensor 66 or 67, it can be detected by pulse $T'_5$ or $T'_6$. In this case, gate $G_3$ or $G_4$ is selected and its pulse is applied to $G_{13}$ or $G_{14}$ to check whether paper is at the sensor 66 or 67. When there is no paper, it means no jam and when there is a paper it menas a jam. In the latter case, flip-flops $FF_1$ and $FF_2$ are reset in the same manner as above.

Sometimes there happens such case that after a jam has been detected at the upstream side (area near paper feed section and transferring section), another jam takes place at the downstream side (area near the rear outlet). The second jam is caused, for example, by such paper which was present at the down stream side at the first jam and then caught in the roller 13 at the time of further movement for discharge. In such double jam case, if the motor $M_4$ be remained operating for a long time, the jam trouble may be made so much complicated to the extent that jam treatment such removal of the jammed paper may be no longer possible. According to the present invention such serious trouble can be prevented effectively. This is attained by further checking any paper jam at the downstream side after a paper jam has been detected at the upstream side and the motor $M_1$ has been stopped.

For example, it is assumed that tray outlet is selected. In this case, the tray sensor 66 detects paper and its signal triggers timer $T_{11}$ through gates $G_{11}$ and $G_{19}$. When the paper correctly goes over the sensor 66 within the timer time $T_{11}$, $G_{19}$ changes its signal from 1 to 0. Since no output is issued from gate $G_{22}$, $FF_2$ cannot be reset. However, if the signal of $G_{19}$ continues to be 1 for a longer time than $T_{11}$, then gate $G_{22}$ will produce an output to one input of gate $G_{23}$ the other input of which is 1. Turn-on of $G_{23}$ resets $FF_2$ and turns $M_4$ off. $T_{12}$ starts when the signal of $G_{19}$ is turned to 0 by the passage of paper on the sensor 66. If the signals of gate $G_{19}$ does not change from 0 to 1 within the timer time $T_{12}$, then $FF_2$ is reset through $G_{22}$ and $G_{23}$ to stop the motor $M_4$. In case that sorter outlet is selected, the motor is stopped through gates $G_{12}$ and $G_{19}$ in the same manner as above.

FIG. 25 is a time chart of the above described operation.

If charged voltage is over the threshold levels $S_1$ and $S_2$ when paper available and when paper out respectively, then $G_{22}$ has an output. Therefore, it is possible to continue jam detection in the downstream part of the paper path even after a jam has been detected in the upstream part. A further jam at the fixing roller or the like occurred immediately after the first jam can be detected promptly in this manner and any escalation of trouble can be prevented. As the main motor $M_1$ is turned off by a detected jam in the upstream part, jam check pulse is no longer generated. But, the jam check at the downstream part is effected by sensing the fore edge of paper and actuating the timer circuit. This operation can be performed independently of the process sequence. Even after the occurrence of jam in the main body, paper conveying operation at the sorter's side continues to receive the arrived paper in the corresponding bin. Also, checking on sorter jam as to the arrived paper is continued. After receiving the arrived paper in the bin, the guide pawls are set for the second sorter.

Paper discharge signal coming from $G_{19}$ makes the up-down counter $CNT_2$ count down by a discrement (−1). Therefore, $CNT_2$ always counts only the number of papers existing in the paper path. This number can be indicated on an indicator when jammed. FIG. 23 shows an example thereof. In this example, the number is displayed on the indicator 23-2.

JAM 1 is an upstream jam detection signal coming from the gate $G_{15}$ shown in FIG. 22. By means of the signal, flip-flop 25 is set to introduce the above number of $CNT_2$ into the segment decoder 30. thus, the number is indicated by the indicator 23-2. At this time, gate 26 is blocked and therefore the copy counter 21 cannot indicate the number of copies. This is the same for JAM 2. Since the jam output of flip-flop 25 is put in the segment decoder 30, the indicator 23-2 indicates also an symbol Σ at its third figure in addition to the number of $CNT_2$.

It is also possible to make the indicator 23-1 the number of $CNT_2$ as P-n at jam while the indication on the indicator 23-2 changing to the number of discharged copies from the number of sheets fed. Normally it is convenient to the operator that the number of sheets fed is displayed on the indicator 23-2, in particular when it is wished to interrupt a repeat copying operation.

By combining the above described jam detection process with the previously described sorter jam detection process and/or diagnosis control process there can be provided copying machine, printer and FAX having improved reliability. Since the paper conveying path is divided into two parts which can be driven independently of each other and can be jam checked independently, process speed of copying machine and the like can be increased up essentially and also escalation of jam trouble can be prevented effectively. Furthermore, the operator can know the number of sheets remained in the conveying path at jam by reading the indication on the indicator.

Paper Feed Section Stand-by Control

In a high speed copying machine, decrease in contact pressure between paper and feeding roller with increase of the number of paper fed is usually compensated by gradually lifting the paper deck. When all the papers are fed out, the deck is manually moved downward for paper supply. This deck operation and paper supply in a large number of sheets require relatively long time, which results in reduction of copy speed as a whole by delayed restart of copying operation. Moreover, if paper gets jammed in area near the paper feeding section from the deck, treatment of the jam gives a difficult problem to the operator. Since the deck has a large number of sheets laid thereon, it is very difficult for the operator to handle the deck. This causes also a long delay of restart.

According to one embodiment of the present invention, the above mentioned problem is solved in the following manner:

Paper containing device such as deck or filter is moved and spaced from the set position of the paper containing section when any of such detection signals is issued which inform: paper out in the containing section; paper jam; trouble occurred in the vicinity of paper feed section such as trouble of paper feeding roller; and opening of the side plate of the copying machine. In particular, such a paper containing device which is gradually moved upward in operation to maintain an optimum contact pressure between the paper and the paper feeding roller, is moved downward by the detection signal mentioned above to assure a safe and easy handling of papers. Furthermore, the detection signal makes the paper feeding path illuminated to make paper supply and treatment of jam much more easy.

Figure 26:
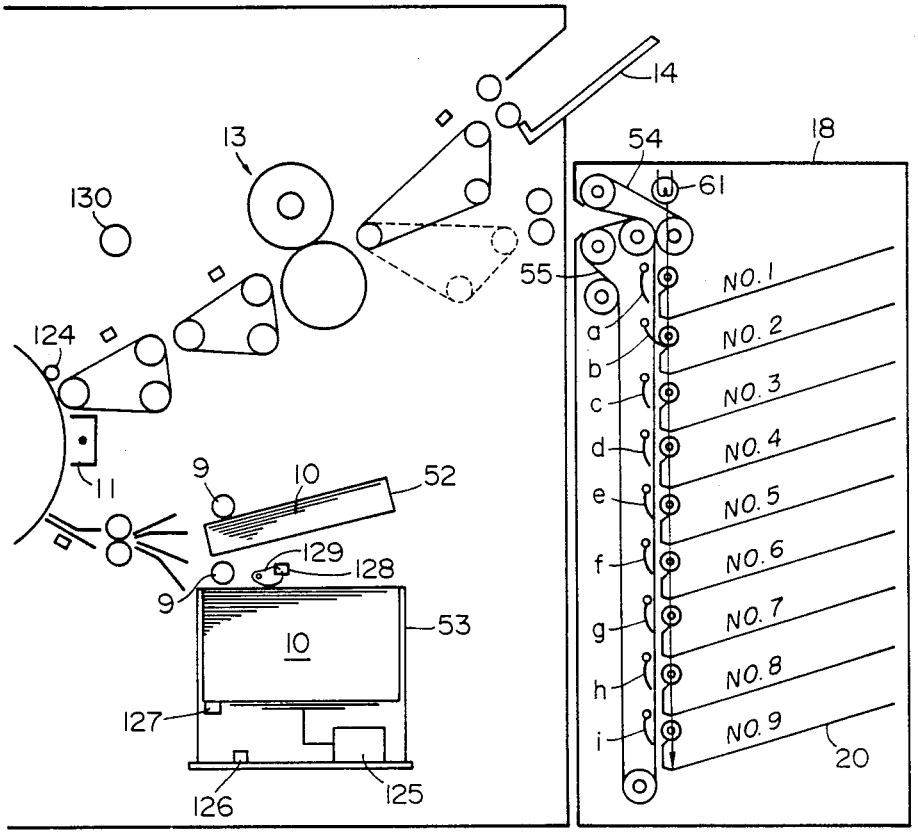
FIG. 26 is a schematic cross-sectional view of another example of a copier with a sorter.

FIG. 26 illustrates an embodiment thereof in a cross-sectional view.

In FIG. 26, designated by 53 is a lifter containing therein a large number of papers 10. The lifter is movable upward and downward by a motor 125. When the lifter reaches the lowermost position, a microswitch 126 is turned on. When all of paper sheets have been fed from the lifter 53, a microswitch 127 is turned on. When the uppermost one of paper sheets 10 reaches the paper feeding section, a photointerrupter type switch 128 is turned on through a lever 129. The lever 129 is provided in the vicinity of the paper feeding roller 9 is such a manner that the lever may be raised up by the paper in the lifter. After a number of paper sheets being fed from the lifter 53, the lever comes down to its inoperative position. At the time, the motor 125 is turned on to move the lifter upward. Again, switch 128 is turned on by the lever 129 and motor 125 is turned off when the lifter has been lifted by a certain distance. To prevent the lift from moving down due to its own weight, a brake is actuated to the motor. Numeral 130 denotes a lamp for illuminating the paper path after transferring station.

Figure 27:
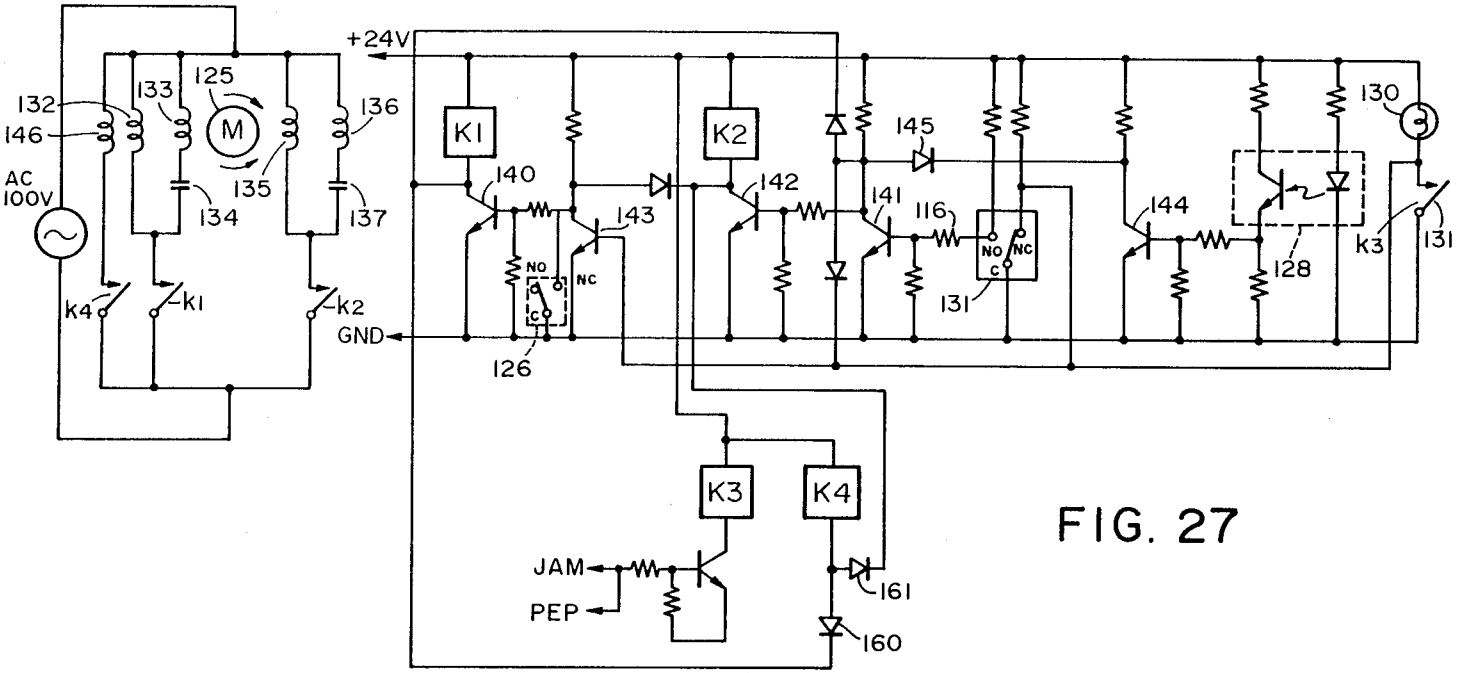
FIG. 27 shows a lift control circuit.

FIG. 27 shows control circuitry for controlling the lifting operation for lifter 53.

Designated by 131 is a microswitch (door switch) whose contact comes into NO when the casing side plate of copying machine is opened. K1–K4 are relays and K1–K4 are contacts which are closed when the relays are on respectively. Of the relays K1 is used for moving the lifter down, K2 is for moving it up, K3 for jam and K4 for brake. In the circuit part for motor 125 there are a main coil 132 for lifter (deck) down, a sub-coil 133 for lifter down, a condenser 135 for lifter down, a main coil 135 for lifter up, a sub-coil 136 for lifter up, a condenser 137 for lifter up and a coil 146 for brake.

The manner of operation of the apparatus is described hereinafter in connection with, for example, the case in which a paper supply is carried out for the deck in its lowermost position.

In this position, the lower limit detection switch 126 is in NC and transistor 140 is Off. Therefore, relay K1 is inactive and no current is supplied to the motor coil 132 and 133 for lifter down. For paper supply, the side plate is opened and therefore the door switch 131 is also in NC. Transistor 141 is on and 142 is off. Relay K2 is inactive and therefore no current flows in the coils for lifter up. Briefly speaking, the lifter is stopped in the position. After completing the paper supply to the lifter, the side plate is closed which turns the door switch 131 to NO. Transistor 141 is turned off and 142 on. Therefore, relay K2 is made active and current flows into coil 136. Motor 125 starts rotating to move the lifter up. With the upward movement of the lifter the lower limit detection switch 126 is turned to NO. However, since transistor 143 is turned on by off of transistor 141, transistor 140 remains off and therefore relay K1 for lifter down remains inactive. The lifter moved up in this manner comes into contact with the feeding roller 9 at the top sheet in the lifter. The feeding roller is raised up and also the above mentioned lever 129 is raised up by the top sheet. As a result the optical axis of photointerrupter 128 is opened and photo interrupter 129 is turned on. Thereby, transistor 144 is turned on which in turn makes the base electrode of transistor 142 grounded through diode 145. Transistor 142 is turned off and relay K2 is off so that the lift motor stops rotation. The lifter stops in the position. In this position, the contact pressure between the top sheet and the feeding roller 9 is at the optimum level and copying operation can be started at once. With the start of copying operation, paper is fed from the lifter. With the increase of number of sheets fed from the lifter, the lever 129 for detecting the contact pressure (that really detected by the lever is the position of top sheet relative to the feeding roller) lowers gradually. At last, it shuts the optical axis of photointerrupter 28 which is then turned off. Namely, this is the position in which no further decrease of the contact pressure is allowable. So, transistor 144 is turned off and 142 is turned on by 24V voltage cut off by diode 145. Relay K2 is energized and the lift motor 125 is rotated by contact K2 to move the lifter up. The above operation is repeated so long as copying continues.

When all the sheets on the lifter are out, switch 127 is turned off and relay K3 is actuated by signal PEP to put on the lamp 130 in the apparatus. The base of transistor 143 is grounded, 143 is off and 140 is on. Therefore, relay K1 is actuated and the motor 125 is rotated to move the lifter down.

When the side plate is opened for any reason, the door switch 131 is turned to NC side. Transistor 143 is turned off and 140 on. Thus, relay K1 is actuated and the motor is rotated in the direction of lifter down like the above.

Similarly, the lifter is moved down by actuating relay K3 by above mentioned jam detection signal JAM. Therefore, the lifter can be moved down at the same time as a jam is detected. When the lifter reaches its lower limit, it turns the switch 126 to NC side to turn transistor off. Relay is made inactive and the motor is stopped rotating. The lifter stops at its lower limit position.

Lifter down at the time of paper out is preferably carried out after the last paper has passed through the transferring station. If the lifter is moved down before completion of transference toner image to the last paper, then vibration of the copying machine may be caused by rotation of the lifter motor. Moreover, the source voltage may be dropped. Drop in source voltage often changes corona discharge of charger 11 for transferring. Also, it is advisable that the copying machine be stopped at once to interrupt the process when a jam occurs. However, when the jam is at the upstreamside of the transferring station, it is preferable that operation to discharge paper in the path at the downstream side of the station be continued as previously described. By doing so, the interrupted process can be restarted very smoothly.

The manner of operation for locking the lifter motor 125 is as follows:

An electromagnetic braking clutch is provided on the shaft of motor 125. The clutch operated with AC 100V. When AC 100V is applied to the clutch by turning on the main switch on the operation part, the clutch is actuated to unlock the rotor of motor 125. When AC 100 is cut off by off of the main switch, the clutch is made inactive so that the rotor of motor is mechanically locked.

Since relay K4 continues to be excited through diodes 160 and 161 when relays K1 and K2 are excited, AC 100V is applied to electromagnetic clutch coil at this time and the rotor is free. However, when relays K1 and K2 are in their inactive positions (the lifter is stopping at a position), relay K4 is inoperative and therefore the motor 125 is always in the state locked and braked. It never happens that the lift at an elevated position moves down due to the weight of papers on the lifter.

To assure the above brake operation and lifter up and down operation, AC 100V and 24V should not be cut off by opening of the door switch. Further safety is attained by using a timer. The timer is triggered by switching the lower limit position switch 126 to NC, jam detection signal and door switch off. At time-up of a certain timer time, the timer cuts off power sources, in particular, those for AC 100 and charger with the exception of illumination lamp 130. It is also possible to provide a reset switch in parallel with the door switch 131 so that the motor 125 can be rotated in the direction of lifter up by closing manually the reset switch. In this case, it is made possible to observe and adjust the contact of paper with the roller 9 while manually moving the lifter upward when off of the reset switch is interlocked with the motion of the door switch to NC side.

The lifter can be moved down during wait mode or immediately after completing copying operation or at time-up of above mentioned 30 sec. after the end of a copying process. By keeping the deck at its elevated position only for a time length actually required for paper feeding from the deck and keeping it at its lowered position for the remaining time, deformation of parts and structural elements caused by the weight of the deck containing a large number of sheets can be minimized.

In this manner, according to the embodiment, the copy sheet container such as a lifter or elevator deck is moved to a position most desirable for paper treatment and paper supply when the side plate of copying machine is opened or when a jam trouble occurs or other times. This makes paper treatment and jam treatment easy and improves safeness. In particular, when this embodiment is applied to a high speed copying machine provided with a paper container containing a large number of copy sheets such as elevator deck, a sooner restart of operation is assured and the copy speed can be essentially increased up.

While the invention has been particularly shown and described with reference to the preferred embodiments thereof, it will be understood by those skilled in the art that the foregoing and other changes in form and details can be made therein without departing from the spirit and scope of the invention.

What we claim is:

1. Image forming apparatus comprising:

image forming means for forming an image on a recording medium;

data set means for setting a plurality of image formation data necessary to command a desired image formation;

first display means for indicating the plurality of image formation data set by said data set means;

second display means for indicating a ready condition in which the apparatus is ready to perform an image forming operation after initiation of a supply of electric power to the apparatus;

starter means for commanding a start of the image forming operation;

timer means operable to initiate a timer operation in response to setting of the image formation data by said data set means;

returning means for returning each of the plurality of image formation data automatically to respective predetermined data, if the starter means fails to command the start of an image forming operation during a predetermined period of time of the timer operation by said timer means; and control means for controlling said image forming means to perform an image forming operation in accordance with the plurality of image formation data if said starter means commands the start of an image forming operation after the apparatus has become ready to perform an image forming operation, said control means controlling said data set means to permit said data set means to set the plurality of image formation data even if the apparatus is not ready to perform the image forming operation after initiation of a supply of electric power to the apparatus, said control means controlling said timer means to actuate said timer means after the apparatus has become ready to perform the image forming operation, and said control means 2. Apparatus according to claim 1, wherein said data set means is adapted to set data related to the desired number of image formations.

3. Apparatus according to claim 1, wherein said data set means is adapted to set data related to a density of an image to be formed.

4. Apparatus according to claim 1, wherein said data set means is adapted to set data related to a magnification of the image formation.

5. Apparatus according to claim 1, further comprising memory means for storing the data set by said data set means.

6. Apparatus according to claim 1, wherein said data set means is adapted to set data related to a feeding position of the recording medium or a delivery position thereof.

7. Image forming apparatus comprising:

image forming means for forming an image on a recording medium;

data set means for setting a plurality of image formation data necessary to command a desired image formation;

display means for indicating the plurality of image formation data set by said data set means;

starter means for commanding a start of the image forming operation;

timer means operable to initiate a timer operation in response to setting of the image formation data by said data set means;

returning means for returning each of the plurality of image formation data automatically to respective predetermined data, if said starter means fails to command the start of an image forming operation during a predetermined period of time of the timer operation by said timer means; and control means for controlling said image forming means to perform an image forming operation in accordance with the plurality of image formation data set by said data set means if said starter means commands the start of an image forming operation after the apparatus has become ready to perform an image forming operation, and said control means further controlling said timer means to reset and to initiate the timer operation again in the event that one of the plurality of image formation data is set by said data set means during the predetermined period of time after the previous data is set by said data set means.

8. Apparatus according to claim 7, wherein said data set means is adapted to set data related to the desired number of image formations.

9. Apparatus according to claim 7, wherein said data set means is adapted to set data related to a density of an image to be formed.

10. Apparatus according to claim 7, wherein said data set means is adapted to set data related to a magnification of the image formation.

11. Apparatus according to claim 7, further comprising memory means for storing the data set by said data set means.

12. Apparatus according to claim 7, wherein said data set means is adapted to set data related to a feeding position of the recording medium or a delivery position thereof.

13. Apparatus according to claim 7, wherein said control means further controls the data set means to permit the data set means to set the plurality of image formation data for a desired image formation even if the apparatus is not ready to perform the image forming operation after initiation of a supply of electric power to the apparatus.

14. Apparatus according to claim 13, wherein said control means controls the timer means to actuate the timer means after the apparatus has become ready to perform the image forming operation.

* * * * *

UNITED STATES PATENT AND TRADEMARK OFFICE

CERTIFICATE OF CORRECTION

PATENT NO. : 4,952,988

DATED : August 28, 1990

INVENTOR(S) : KATSUSHI FURUICHI ET AL.

It is certified that error appears in the above-identified patent and that said Letters Patent is hereby corrected as shown below:

COLUMN 2

Line 23, "eliminate" should read --eliminates--.

COLUMN 3

Line 12, insert --According to the present invention, an image forming apparatus comprises means for setting data for a desired image formation, which data is displayed. Also displayed is an indication of a ready condition in which the apparatus is ready for image formation. A starter is provided for commanding the start of image formation. A timer returns the set data automatically to a predetermined value or set of values, as the case may be, if image formation is not commanded by the starter within a predetermined period of time. A control means permits setting of image formation data even when the apparatus stands ready to perform image formation, and controls the timer to actuate the latter after the apparatus is ready to perform image formation.--.

Line 20, "in" should read --in which--.

COLUMN 5

Line 32, "a" (second occurrence) should read --as--.

COLUMN 6

Line 7, "complete" should read --completed--.

UNITED STATES PATENT AND TRADEMARK OFFICE

CERTIFICATE OF CORRECTION

PATENT NO. : 4,952,988

DATED : August 28, 1990

INVENTOR(S) : KATSUSHI FURUICHI ET AL.

It is certified that error appears in the above-identified patent and that said Letters Patent is hereby corrected as shown below:

COLUMN 12

Line 11, "Sine" should read --Since--.
Line 14, "de" should read --device--.
Line 67, "pluged" should read --plugged--.

COLUMN 15

Line 6, "sensor" should read --sensors--.

COLUMN 18

Line 48, "another" should read --other--.

COLUMN 20

Line 29, "describes" should read --described--.

COLUMN 24

Line 64, "down ward" should read --downward--.

COLUMN 27

Line "at" should read --are--.

COLUMN 29

Line 13, "reach" should read --reaches--.

COLUMN 30

Line 62, "thus," should read --Thus,--.

UNITED STATES PATENT AND TRADEMARK OFFICE

CERTIFICATE OF CORRECTION

PATENT NO. : 4,952,988

DATED : August 28, 1990

INVENTOR(S) : KATSUSHI FURUICHI ET AL.

It is certified that error appears in the above-identified patent and that said Letters Patent is hereby corrected as shown below:

COLUMN 35

Line 5, "control means" should read --control means further controlling said timer means to reset and to initate the timer operation again in the event that one of the plurality of image formation data is set by said data set means during the predetermined period of time after the previous data is set by said data set means.--.

Signed and Sealed this

Twenty-first Day of April, 1992

*Attest:*

*Attesting Officer*

HARRY F. MANBECK, JR.

*Commissioner of Patents and Trademarks*